US007438133B2

(12) United States Patent
Brisco

(10) Patent No.: US 7,438,133 B2
(45) **Date of Patent: *Oct. 21, 2008**

(54) APPARATUS AND METHOD FOR RADIALLY EXPANDING AND PLASTICALLY DEFORMING A TUBULAR MEMBER

(75) Inventor: David Paul Brisco, Duncan, OK (US)

(73) Assignee: Enventure Global Technology, LLC, Houston, TX (US)

( * ) Notice: Subject to any disclaimer, the term of this patent is extended or adjusted under 35 U.S.C. 154(b) by 302 days.

This patent is subject to a terminal disclaimer.

(21) Appl. No.: 10/546,548

(22) PCT Filed: Feb. 26, 2004

(86) PCT No.: PCT/US2004/006246

§ 371 (c)(1),
(2), (4) Date: Aug. 23, 2005

(87) PCT Pub. No.: WO2004/076798

PCT Pub. Date: Sep. 10, 2004

(65) Prior Publication Data

US 2006/0169460 A1 Aug. 3, 2006

Related U.S. Application Data

(60) Provisional application No. 60/450,504, filed on Feb. 26, 2003.

(51) Int. Cl.
*E21B 43/00* (2006.01)

(52) U.S. Cl. ..... 166/380; 166/207; 166/285; 166/177.4

(58) Field of Classification Search ..... 166/285, 166/287, 207, 177.4, 380, 386, 212
See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |

(Continued)

FOREIGN PATENT DOCUMENTS

AU 01/269810 B2 6/2000

(Continued)

OTHER PUBLICATIONS

Examination Report dated Oct. 13, 2006 on Australian Patent Application No. 200400246.

(Continued)

*Primary Examiner*—David Bagnell
*Assistant Examiner*—David Andrews
(74) *Attorney, Agent, or Firm*—Conley Rose, P.C.

(57) ABSTRACT

An apparatus for radially expanding and plastically deforming a tubular member that includes a valve assembly for permitting the injection of a hardenable fluidic sealing material into an annulus between the tubular member and a pre-existing structure.

25 Claims, 45 Drawing Sheets

U.S. PATENT DOCUMENTS

| | | | | |
|---|---|---|---|---|
| 984,449 | A | | 2/1911 | Stewart |
| 1,166,040 | A | | 12/1915 | Burlingham |
| 1,233,888 | A | | 7/1917 | Leonard |
| 1,358,818 | A | | 11/1920 | Bering |
| 1,494,128 | A | | 5/1924 | Primrose |
| 1,589,781 | A | | 6/1926 | Anderson |
| 1,590,357 | A | | 6/1926 | Feisthamel |
| 1,597,212 | A | | 8/1926 | Spengler |
| 1,613,461 | A | | 1/1927 | Johnson |
| 1,739,932 | A | | 12/1929 | Ventresca |
| 1,756,531 | A | | 4/1930 | Aideen et al. |
| 1,880,218 | A | | 10/1932 | Simmons |
| 1,952,652 | A | | 3/1934 | Brannon |
| 1,981,525 | A | | 11/1934 | Price |
| 2,046,870 | A | | 7/1936 | Clasen et al. |
| 2,087,185 | A | | 7/1937 | Dillon |
| 2,110,913 | A | | 3/1938 | Lowrey |
| 2,122,757 | A | | 7/1938 | Scott |
| 2,134,311 | A | | 10/1938 | Minor et al. |
| 2,145,168 | A | | 1/1939 | Flagg |
| 2,160,263 | A | | 5/1939 | Fletcher |
| 2,187,275 | A | | 1/1940 | McLennan |
| 2,204,586 | A | | 6/1940 | Grau |
| 2,211,173 | A | | 8/1940 | Shaffer |
| 2,214,226 | A | | 9/1940 | English |
| 2,226,804 | A | | 12/1940 | Carroll |
| 2,273,017 | A | | 2/1942 | Boynton |
| 2,301,495 | A | | 11/1942 | Abegg |
| 2,305,282 | A | | 12/1942 | Taylor, Jr. et al. |
| 2,371,840 | A | | 3/1945 | Otis |
| 2,383,214 | A | | 8/1945 | Prout |
| 2,407,552 | A | | 9/1946 | Hoesel |
| 2,447,629 | A | | 8/1948 | Beissinger et al. |
| 2,481,637 | A | | 9/1949 | Yancey |
| 2,500,276 | A | | 3/1950 | Church |
| 2,546,295 | A | | 3/1951 | Boice |
| 2,583,316 | A | | 1/1952 | Bannister |
| 2,609,258 | A | | 9/1952 | Taylor, Jr. et al. |
| 2,627,891 | A | | 2/1953 | Clark |
| 2,647,847 | A | | 8/1953 | Black et al. |
| 2,664,952 | A | | 1/1954 | Losey |
| 2,691,418 | A | | 10/1954 | Connolly |
| 2,695,449 | A | | 11/1954 | Chauvin |
| 2,723,721 | A | | 11/1955 | Corsette |
| 2,734,580 | A | | 2/1956 | Layne |
| 2,735,485 | A | | 2/1956 | Metcalf, Jr. |
| 2,762,440 | A | * | 9/1956 | Reed ..... 166/154 |
| 2,796,134 | A | | 6/1957 | Binkley |
| 2,812,025 | A | | 11/1957 | Teague et al. |
| 2,877,822 | A | | 3/1959 | Buck |
| 2,907,589 | A | | 10/1959 | Knox |
| 2,919,741 | A | | 1/1960 | Strock et al. |
| 2,929,741 | A | | 3/1960 | Steinberg |
| 3,015,362 | A | | 1/1962 | Moosman |
| 3,015,500 | A | | 1/1962 | Barnett |
| 3,018,547 | A | | 1/1962 | Marskell |
| 3,039,530 | A | | 6/1962 | Condra |
| 3,067,801 | A | | 12/1962 | Sortor |
| 3,067,819 | A | | 12/1962 | Gore |
| 3,068,563 | A | | 12/1962 | Reverman |
| 3,104,703 | A | | 9/1963 | Rike et al. |
| 3,111,991 | A | | 11/1963 | O'Neal |
| 3,162,245 | A | | 12/1964 | Howard et al. |
| 3,167,122 | A | | 1/1965 | Lang |
| 3,175,618 | A | | 3/1965 | Lang et al. |
| 3,179,168 | A | | 4/1965 | Vincent |
| 3,188,816 | A | | 6/1965 | Koch |
| 3,191,677 | A | | 6/1965 | Kinley |
| 3,191,680 | A | | 6/1965 | Vincent |
| 3,203,451 | A | | 8/1965 | Vincent |
| 3,203,483 | A | | 8/1965 | Vincent |
| 3,209,546 | A | | 10/1965 | Lawton |
| 3,210,102 | A | | 10/1965 | Joslin |
| 3,233,315 | A | | 2/1966 | Levake |
| 3,245,471 | A | | 4/1966 | Howard |
| 3,270,817 | A | | 9/1966 | Papaila |
| 3,297,092 | A | | 1/1967 | Jennings |
| 3,326,293 | A | | 6/1967 | Skipper |
| 3,343,252 | A | | 9/1967 | Reesor |
| 3,353,599 | A | | 11/1967 | Swift |
| 3,354,955 | A | | 11/1967 | Berry |
| 3,358,760 | A | | 12/1967 | Blagg |
| 3,358,769 | A | | 12/1967 | Berry |
| 3,364,993 | A | | 1/1968 | Skipper |
| 3,371,717 | A | | 3/1968 | Chenoweth |
| 3,397,745 | A | | 8/1968 | Owens et al. |
| 3,412,565 | A | | 11/1968 | Lindsey et al. |
| 3,419,080 | A | | 12/1968 | Lebourg |
| 3,422,902 | A | | 1/1969 | Bouchillon |
| 3,424,244 | A | | 1/1969 | Kinley |
| 3,427,707 | A | | 2/1969 | Nowosadko |
| 3,463,228 | A | | 8/1969 | Hearn |
| 3,477,506 | A | | 11/1969 | Malone |
| 3,489,220 | A | | 1/1970 | Kinley |
| 3,489,437 | A | | 1/1970 | Duret |
| 3,498,376 | A | | 3/1970 | Sizer et al. |
| 3,504,515 | A | | 4/1970 | Reardon |
| 3,508,771 | A | | 4/1970 | Duret |
| 3,520,049 | A | | 7/1970 | Lysenko et al. |
| 3,528,498 | A | | 9/1970 | Carothers |
| 3,532,174 | A | | 10/1970 | Diamantides |
| 3,568,773 | A | | 3/1971 | Chancellor |
| 3,572,777 | A | | 3/1971 | Blose et al. |
| 3,574,357 | A | | 4/1971 | Alexandru |
| 3,578,081 | A | | 5/1971 | Bodine |
| 3,579,805 | A | | 5/1971 | Berdolt |
| 3,581,817 | A | | 6/1971 | Kammerer |
| 3,605,887 | A | | 9/1971 | Lambie |
| 3,631,926 | A | | 1/1972 | Young |
| 3,665,591 | A | | 5/1972 | Kowal |
| 3,667,547 | A | | 6/1972 | Ahlstone |
| 3,669,190 | A | | 6/1972 | Sizer et al. |
| 3,678,727 | A | | 7/1972 | Jackson |
| 3,682,256 | A | | 8/1972 | Stuart |
| 3,687,196 | A | | 8/1972 | Mullins |
| 3,691,624 | A | | 9/1972 | Kinley |
| 3,693,717 | A | | 9/1972 | Wuenschel |
| 3,704,730 | A | | 12/1972 | Witzig |
| 3,709,306 | A | | 1/1973 | Curlington |
| 3,711,123 | A | | 1/1973 | Arnold |
| 3,712,376 | A | | 1/1973 | Owen et al. |
| 3,746,068 | A | | 7/1973 | Deckert et al. |
| 3,746,091 | A | | 7/1973 | Owen et al. |
| 3,746,092 | A | | 7/1973 | Land |
| 3,764,168 | A | | 10/1973 | Kisling, III et al. |
| 3,776,307 | A | | 12/1973 | Young |
| 3,779,025 | A | | 12/1973 | Godley |
| 3,780,562 | A | | 12/1973 | Kinley |
| 3,781,966 | A | | 1/1974 | Lieberman |
| 3,785,193 | A | | 1/1974 | Kinley et al. |
| 3,797,259 | A | | 3/1974 | Kammerer, Jr. |
| 3,805,567 | A | | 4/1974 | Agius Sinerco |
| 3,812,912 | A | | 5/1974 | Wuenschel |
| 3,818,734 | A | | 6/1974 | Bateman |
| 3,826,124 | A | | 7/1974 | Baksay |
| 3,830,294 | A | | 8/1974 | Swanson, Jr. |
| 3,830,295 | A | | 8/1974 | Crowe |
| 3,834,742 | A | | 9/1974 | McPhillips |
| 3,848,668 | A | | 11/1974 | Sizer |
| 3,866,954 | A | | 2/1975 | Slator et al. |
| 3,874,446 | A | | 4/1975 | Crowe |
| 3,885,298 | A | | 5/1975 | Pognowski |
| 3,887,006 | A | | 6/1975 | Pitts |
| 3,893,718 | A | | 7/1975 | Powell |

3,898,163 A 8/1975 Mott
3,915,478 A 10/1975 Al et al.
3,915,763 A 10/1975 Jennings
3,935,910 A 2/1976 Gaudy et al.
3,942,824 A 3/1976 Sable
3,945,444 A 3/1976 Knudson
3,948,321 A 4/1976 Owen et al.
3,963,076 A 6/1976 Winslow
3,970,336 A 7/1976 O'Sickey
3,977,076 A 8/1976 Vieira et al.
3,977,473 A 8/1976 Page, Jr.
3,989,280 A 11/1976 Schwarz
3,997,193 A 12/1976 Tsuda et al.
3,999,605 A 12/1976 Braddick
4,011,652 A 3/1977 Black
4,018,634 A 4/1977 Fencl
4,019,579 A 4/1977 Thuse
4,026,583 A 5/1977 Gottlieb
4,047,568 A 9/1977 Aulenbacher
4,053,247 A 10/1977 Marsh, Jr.
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchison et al.
4,118,954 A 10/1978 Jenkins
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,358,511 A 11/1982 Smith, Jr. et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida et al.
4,495,073 A 1/1985 Beimgraben
4,501,327 A 2/1985 Retz
4,505,017 A 3/1985 Schukei
4,505,987 A 3/1985 Yamada et al.
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,521,258 A 6/1985 Tamehiro et al.
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,573,540 A 3/1986 Dellinger et al.
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres et al.
4,595,063 A 6/1986 Jennings et al.
4,596,913 A 6/1986 Takechi et al.
4,598,938 A 7/1986 Boss et al.
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,627,488 A 12/1986 Szarka
4,629,218 A 12/1986 Dubois
4,629,224 A 12/1986 Landriault
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,676,563 A 6/1987 Curlett et al.
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,732,416 A 3/1988 Dearden et al.

4,735,444 A 4/1988 Skipper
4,739,654 A 4/1988 Pilkington et al.
4,739,916 A 4/1988 Ayres et al.
4,754,781 A 7/1988 Jan de Putter
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,799,544 A 1/1989 Curlett
4,817,710 A 4/1989 Edwards et al.
4,817,712 A 4/1989 Bodine
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,278 A 6/1989 Stone et al.
4,836,579 A 6/1989 Wester et al.
4,838,349 A 6/1989 Berzin
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Chang
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,949,745 A 8/1990 McKeon
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundell
5,074,355 A 12/1991 Lennon
5,079,837 A 1/1992 Vanselow
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet et al.
5,150,755 A 9/1992 Cassel et al.
5,156,043 A 10/1992 Ose
5,156,213 A 10/1992 George et al.
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche P. et al.
5,242,017 A 9/1993 Hailey
5,249,628 A 10/1993 Surjaatmadia
5,253,713 A 10/1993 Gregg et al.
RE34,467 E 12/1993 Reeves
5,273,075 A 12/1993 Skaer
5,275,242 A 1/1994 Payne
5,282,508 A 2/1994 Ellingsen et al.
5,282,652 A 2/1994 Werner
5,286,393 A 2/1994 Oldiges et al.
5,297,629 A 3/1994 Barrington et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Baro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.

5,419,595 A 5/1995 Yamamoto et al.
5,425,559 A 6/1995 Nobileau
5,426,130 A 6/1995 Thurber et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,498,809 A 3/1996 Emert et al.
5,507,343 A 4/1996 Carlton et al.
5,511,620 A 4/1996 Baugh et al.
5,513,703 A 5/1996 Mills et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A * 9/1997 Gill et al. ..... 166/295
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,409 A 8/1998 Flanders
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris et al.
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,594 A 5/1999 Wasson et al.
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
5,985,053 A 11/1999 Hara et al.
6,009,611 A 1/2000 Adams et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,013,724 A 1/2000 Mizutani et al.
6,015,012 A 1/2000 Reddick
6,017,168 A 1/2000 Fraser, Jr. et al.
6,021,850 A 2/2000 Wood et al.
6,024,181 A 2/2000 Richardson et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,148,915 A 11/2000 Mullen et al.
6,155,613 A 12/2000 Quadflieg et al.
6,158,785 A 12/2000 Beaulier et al.
6,158,963 A 12/2000 Hollis et al.
6,167,970 B1 1/2001 Stout et al.
6,182,775 B1 2/2001 Hipp
6,183,013 B1 2/2001 Mackenzie et al.
6,183,573 B1 2/2001 Fujiwara et al.
6,189,616 B1 2/2001 Gano et al.
6,196,336 B1 3/2001 Fincher et al.
6,216,509 B1 4/2001 Lotspaih et al.
6,220,306 B1 4/2001 Omura et al.
6,226,855 B1 5/2001 Maine
6,231,086 B1 5/2001 Tierling
6,237,967 B1 5/2001 Yamamoto et al.
6,250,385 B1 6/2001 Montaron
6,253,846 B1 7/2001 Nazzai et al.
6,253,850 B1 7/2001 Nazzai et al.

6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,558 B1 9/2001 Quigley et al.
6,286,614 B1 9/2001 Gano et al.
6,302,211 B1 10/2001 Nelson et al.
6,311,792 B1 11/2001 Scott et al.
6,315,040 B1 11/2001 Donnelly
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,349,521 B1 2/2002 McKeon et al.
6,352,112 B1 3/2002 Mills
6,354,373 B1 3/2002 Vercaemer et al.
6,357,485 B2 3/2002 Quigley et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,443,247 B1 9/2002 Wardley
6,445,323 B1 9/2002 Metcalfe et al.
6,446,323 B1 9/2002 Metcalfe et al.
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,461,999 B1 10/2002 Fanta et al.
6,464,008 B1 10/2002 Roddy et al.
6,464,014 B1 10/2002 Bernat
6,470,966 B2 10/2002 Cook et al.
6,470,996 B1 10/2002 Kyle et al.
6,478,091 B1 11/2002 Gano
6,478,092 B2 11/2002 Voll et al.
6,491,108 B1 12/2002 Slup et al.
6,497,289 B1 12/2002 Cook et al.
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,460 B2 5/2003 Hester
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Haut et al.
6,575,250 B1 6/2003 Wijsman
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson et al.
6,604,763 B1 8/2003 Ring et al.
6,607,220 B2 8/2003 Sivley, IV
6,609,735 B1 8/2003 DeLange et al.
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,930 B2 12/2003 Hoffman
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson et al.
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,723,683 B2 4/2004 Crossman et al.
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,749,954 B2 6/2004 Toyooka et al.
6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,826,937 B2 12/2004 Su
6,832,649 B2 12/2004 Bode et al.
6,834,725 B2 12/2004 Whanger et al.
6,843,319 B2 1/2005 Tran et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,907,652 B1 6/2005 Heijnen
6,923,261 B2 8/2005 Metcalfe et al.

6,935,429 B2 8/2005 Badrak
6,935,430 B2 8/2005 Harrall et al.
6,966,370 B2 11/2005 Cook et al.
6,968,618 B2 11/2005 Cook et al.
6,976,539 B2 12/2005 Metcalfe et al.
6,976,541 B2 12/2005 Brisco et al.
6,977,096 B2 12/2005 LeClaire
7,000,953 B2 2/2006 Berghaus
7,007,760 B2 3/2006 Lohbeck
7,011,161 B2 3/2006 Ring et al.
7,021,390 B2 4/2006 Cook et al.
7,036,582 B2 5/2006 Cook et al.
7,040,396 B2 5/2006 Cook et al.
7,044,218 B2 5/2006 Cook et al.
7,044,221 B2 5/2006 Cook et al.
7,048,062 B2 5/2006 Ring
7,048,067 B1 5/2006 Cook et al.
7,055,608 B2 6/2006 Cook et al.
7,063,142 B2 6/2006 Cook et al.
7,063,149 B2 6/2006 Simpson et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,684 B2 9/2006 Cook et al.
7,100,685 B2 9/2006 Cook et al.
7,108,061 B2 9/2006 Cook et al.
7,108,072 B2 9/2006 Cook et al.
7,114,559 B2 10/2006 Sonnier et al.
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
7,146,702 B2 12/2006 Cook et al.
7,147,053 B2 12/2006 Cook et al.
7,159,665 B2 1/2007 Cook et al.
7,159,667 B2 1/2007 Cook et al.
7,164,964 B2 1/2007 Stacklies
7,168,496 B2 1/2007 Cook et al.
7,168,499 B2 1/2007 Cook et al.
7,172,019 B2 2/2007 Cook et al.
7,172,021 B2 2/2007 Brisco et al.
7,172,024 B2 2/2007 Cook et al.
7,174,964 B2 2/2007 Cook et al.
7,185,710 B2 3/2007 Cook et al.
7,191,841 B2 3/2007 Sivley, IV
7,225,879 B2 6/2007 Wylie et al.
7,231,985 B2 6/2007 Cook et al.
7,234,531 B2 6/2007 Kendziora et al.
7,234,968 B2 6/2007 Lottmann et al.
7,240,728 B2 7/2007 Cook et al.
7,240,729 B2 7/2007 Cook et al.
2001/0002626 A1 6/2001 Frank et al.
2001/0018354 A1 8/2001 Pigni
2001/0020532 A1 9/2001 Naugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Sivley, IV
2003/0075337 A1 4/2003 Maguire
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith et al.
2003/0159764 A1 8/2003 Goto
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045646 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0112610 A1 6/2004 Tran et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0159446 A1 8/2004 Haugen et al.
2004/0174017 A1 9/2004 Brill et al.
2004/0188099 A1 9/2004 Cook et al.
2004/0194278 A1 10/2004 Brill et al.
2004/0194966 A1 10/2004 Zimmerman
2004/0195826 A1 10/2004 Goto
2004/0216506 A1 11/2004 Simpson et al.
2004/0216873 A1 11/2004 Frost, Jr. et al.
2004/0221996 A1 11/2004 Burge
2004/0228679 A1 11/2004 Reavis et al.
2004/0231839 A1 11/2004 Ellington et al.
2004/0231843 A1 11/2004 Simpson et al.
2004/0231855 A1* 11/2004 Cook et al. ..... 166/378
2004/0238181 A1 12/2004 Cook et al.
2004/0244968 A1 12/2004 Cook et al.
2004/0251034 A1 12/2004 Kendziora et al.
2004/0262014 A1 12/2004 Cook et al.
2005/0011641 A1 1/2005 Cook et al.
2005/0015963 A1 1/2005 Costa et al.

| | | | |
|---|---|---|---|
| 2005/0028988 | A1 | 2/2005 | Cook et al. |
| 2005/0039910 | A1 | 2/2005 | Lohbeck |
| 2005/0039928 | A1 | 2/2005 | Cook et al. |
| 2005/0045324 | A1 | 3/2005 | Cook et al. |
| 2005/0045341 | A1 | 3/2005 | Cook et al. |
| 2005/0045342 | A1 | 3/2005 | Luke et al. |
| 2005/0056433 | A1 | 3/2005 | Ring et al. |
| 2005/0056434 | A1 | 3/2005 | Watson et al. |
| 2005/0077051 | A1 | 4/2005 | Cook et al. |
| 2005/0081358 | A1 | 4/2005 | Cook et al. |
| 2005/0087337 | A1 | 4/2005 | Brisco et al. |
| 2005/0098323 | A1 | 5/2005 | Cook et al. |
| 2005/0103502 | A1 | 5/2005 | Watson et al. |
| 2005/0123639 | A1 | 6/2005 | Ring et al. |
| 2005/0133225 | A1 | 6/2005 | Oosterling |
| 2005/0138790 | A1 | 6/2005 | Cook et al. |
| 2005/0144771 | A1 | 7/2005 | Cook et al. |
| 2005/0144772 | A1 | 7/2005 | Cook et al. |
| 2005/0144777 | A1 | 7/2005 | Cook et al. |
| 2005/0150098 | A1 | 7/2005 | Cook et al. |
| 2005/0150660 | A1 | 7/2005 | Cook et al. |
| 2005/0161228 | A1 | 7/2005 | Cook et al. |
| 2005/0166387 | A1 | 8/2005 | Cook et al. |
| 2005/0166388 | A1 | 8/2005 | Cook et al. |
| 2005/0172473 | A1 | 8/2005 | Cook et al. |
| 2005/0173108 | A1 | 8/2005 | Cook |
| 2005/0183863 | A1 | 8/2005 | Cook et al. |
| 2005/0205253 | A1 | 9/2005 | Cook et al. |
| 2005/0217768 | A1 | 10/2005 | Asahi et al. |
| 2005/0217865 | A1 | 10/2005 | Ring |
| 2005/0217866 | A1 | 10/2005 | Watson et al. |
| 2005/0223535 | A1 | 10/2005 | Cook et al. |
| 2005/0224225 | A1 | 10/2005 | Cook et al. |
| 2005/0230102 | A1 | 10/2005 | Cook et al. |
| 2005/0230103 | A1 | 10/2005 | Cook et al. |
| 2005/0230104 | A1 | 10/2005 | Cook et al. |
| 2005/0230123 | A1 | 10/2005 | Waddell et al. |
| 2005/0236159 | A1 | 10/2005 | Costa et al. |
| 2005/0236163 | A1 | 10/2005 | Cook et al. |
| 2005/0244578 | A1 | 11/2005 | Egmond et al. |
| 2005/0246883 | A1 | 11/2005 | Alliot et al. |
| 2005/0247453 | A1 | 11/2005 | Shuster et al. |
| 2005/0265788 | A1 | 12/2005 | Renkema |
| 2005/0269107 | A1 | 12/2005 | Cook et al. |
| 2006/0027371 | A1 | 2/2006 | Gorrara |
| 2006/0032640 | A1 | 2/2006 | Costa et al. |
| 2006/0048948 | A1 | 3/2006 | Noel |
| 2006/0054330 | A1 | 3/2006 | Ring et al. |
| 2006/0065403 | A1 | 3/2006 | Watson et al. |
| 2006/0065406 | A1 | 3/2006 | Shuster et al. |
| 2006/0096762 | A1 | 5/2006 | Brisco |
| 2006/0102360 | A1 | 5/2006 | Brisco |
| 2006/0112768 | A1 | 6/2006 | Shuster et al. |
| 2006/0113086 | A1 | 6/2006 | Costa et al. |
| 2006/0162937 | A1 | 7/2006 | Costa et al. |
| 2006/0163460 | A1 | 7/2006 | Kerstan et al. |
| 2006/0196679 | A1 | 9/2006 | Brisco et al. |
| 2006/0207760 | A1 | 9/2006 | Watson et al. |
| 2006/0208488 | A1 | 9/2006 | Costa |
| 2006/0213668 | A1 | 9/2006 | Cook et al. |
| 2006/0219414 | A1 | 10/2006 | Shuster |
| 2006/0225892 | A1 | 10/2006 | Watson et al. |
| 2006/0243444 | A1 | 11/2006 | Brisco et al. |
| 2006/0266527 | A1 | 11/2006 | Brisco et al. |
| 2006/0272826 | A1 | 12/2006 | Shuster et al. |
| 2007/0012456 | A1 | 1/2007 | Cook et al. |
| 2007/0017572 | A1 | 1/2007 | Cook et al. |
| 2007/0034383 | A1 | 2/2007 | Shuster et al. |
| 2007/0039742 | A1 | 2/2007 | Costa |
| 2007/0131431 | A1 | 6/2007 | Shuster et al. |
| 2007/0154270 | A1 | 7/2007 | Waddell et al. |

FOREIGN PATENT DOCUMENTS

| | | | |
|---|---|---|---|
| AU | 767364 | | 6/2000 |
| AU | 770008 | | 8/2000 |
| AU | 770359 | | 8/2000 |
| AU | 771884 | | 8/2000 |
| AU | 776580 | | 1/2001 |
| AU | 782901 | | 4/2001 |
| AU | 783245 | | 5/2001 |
| AU | 773168 | | 7/2001 |
| AU | 780123 | | 8/2001 |
| AU | 01/283026 | | 2/2002 |
| AU | 01/292695 | B2 | 3/2002 |
| AU | 01/294802 | B2 | 4/2002 |
| AU | 02/239857 | B2 | 9/2002 |
| CA | 736288 | | 6/1966 |
| CA | 771462 | | 11/1967 |
| CA | 1171310 | | 7/1984 |
| CA | 2289811 | | 11/1999 |
| CA | 2292171 | | 6/2000 |
| CA | 2497854 | | 6/2000 |
| CA | 2298139 | | 8/2000 |
| CA | 2414449 | | 2/2002 |
| CA | 2419806 | | 4/2002 |
| CA | 2453034 | | 1/2003 |
| CA | 2453034 | A1 * | 1/2003 |
| CA | 2234386 | | 3/2003 |
| CA | 2398001 | | 4/2003 |
| CA | 2466685 | | 3/2004 |
| CA | 2249139 | | 1/2007 |
| DE | 174521 | | 9/1952 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | A | 6/1988 |
| EP | 0294264 | A1 | 12/1988 |
| EP | 0553566 | A1 | 8/1993 |
| EP | 620289 | A1 | 10/1994 |
| EP | 0633391 | A2 | 1/1995 |
| EP | 0713953 | B1 | 11/1995 |
| EP | 0823534 | A1 | 2/1998 |
| EP | 0881354 | A2 | 12/1998 |
| EP | 0881359 | A1 | 12/1998 |
| EP | 0899420 | A1 | 3/1999 |
| EP | 0937861 | A2 | 6/1999 |
| EP | 0952305 | A1 | 10/1999 |
| EP | 0952306 | A1 | 10/1999 |
| EP | 1141515 | | 6/2000 |
| EP | 1235972 | | 5/2001 |
| EP | 1106778 | A1 | 6/2001 |
| EP | 1152119 | A2 | 11/2001 |
| EP | 1152120 | A2 | 11/2001 |
| EP | 1152120 | A3 | 6/2002 |
| EP | 1306519 | A2 | 5/2003 |
| EP | 1505251 | | 2/2005 |
| EP | 1505251 | A2 | 2/2005 |
| EP | 1555386 | A1 | 7/2005 |
| EP | 1505251 | A3 | 2/2007 |
| FR | 1325596 | | 3/1963 |
| FR | 2583398 | A1 | 12/1986 |
| FR | 2717855 | A1 | 9/1995 |
| FR | 2741907 | A1 | 6/1997 |
| FR | 2780751 | | 1/2000 |
| FR | 2841626 | A1 | 1/2004 |
| GB | 2275705 | | 3/1942 |
| GB | 557823 | | 12/1943 |
| GB | 788150 | | 12/1957 |
| GB | 851096 | | 10/1960 |
| GB | 961750 | | 6/1964 |

| | | | |
|---|---|---|---|
| GB | 1000383 | | 10/1965 |
| GB | 1008383 | | 10/1965 |
| GB | 1062610 | | 3/1967 |
| GB | 1520552 | | 8/1976 |
| GB | 1448304 | | 9/1976 |
| GB | 1460864 | | 1/1977 |
| GB | 1542847 | | 3/1979 |
| GB | 1563740 | | 3/1980 |
| GB | 1582767 | | 1/1981 |
| GB | 2058877 | | 4/1981 |
| GB | 2108228 | | 5/1983 |
| GB | 2115860 | | 9/1983 |
| GB | 2124275 | A | 2/1984 |
| GB | 2125876 | | 3/1984 |
| GB | 2194978 | A | 3/1988 |
| GB | 2211446 | A | 7/1989 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 1/1993 |
| GB | 2275705 | A | 9/1994 |
| GB | 2279383 | | 1/1995 |
| GB | 2305682 | A | 4/1997 |
| GB | 2322655 | A | 9/1998 |
| GB | 2325949 | A | 12/1998 |
| GB | 2326896 | A | 1/1999 |
| GB | 2329916 | A | 4/1999 |
| GB | 2331103 | A | 5/1999 |
| GB | 2329918 | A | 7/1999 |
| GB | 2336383 | A | 10/1999 |
| GB | 2343691 | A | 5/2000 |
| GB | 2344606 | A | 6/2000 |
| GB | 2345608 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2348661 | A | 10/2000 |
| GB | 2350137 | B | 11/2000 |
| GB | 2355738 | A | 12/2000 |
| GB | 2356651 | A | 5/2001 |
| GB | 2357099 | A | 6/2001 |
| GB | 2359837 | B | 9/2001 |
| GB | 2361724 | A | 10/2001 |
| GB | 2365898 | A | 2/2002 |
| GB | 2367842 | A | 4/2002 |
| GB | 2368865 | A | 5/2002 |
| GB | 2370301 | A | 6/2002 |
| GB | 2371064 | A | 7/2002 |
| GB | 2371574 | A | 7/2002 |
| GB | 2373524 | A | 9/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382607 | A | 6/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2384807 | C | 8/2003 |
| GB | 2348223 | B | 9/2003 |
| GB | 2347952 | B | 10/2003 |
| GB | 2348657 | B | 10/2003 |
| GB | 2358358 | B | 10/2003 |
| GB | 2358359 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2391028 | A | 1/2004 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396689 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2398087 | A | 8/2004 |

| | | | |
|---|---|---|---|
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399837 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2040402 | A | 2/2005 |
| GB | 2400624 | B | 2/2005 |
| GB | 2404676 | A | 2/2005 |
| GB | 2404677 | A | 2/2005 |
| GB | 2404680 | A | 2/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406599 | A | 4/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2407593 | A | 5/2005 |
| GB | 2408277 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2410280 | | 7/2005 |
| GB | 2390622 | B | 8/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2410518 | A | 8/2005 |
| GB | 2380503 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2400393 | B | 10/2005 |
| GB | 2412681 | A | 10/2005 |
| GB | 2412682 | A | 10/2005 |
| GB | 2394979 | B | 11/2005 |
| GB | 2414493 | A | 11/2005 |
| GB | 2409217 | B | 12/2005 |
| GB | 2410518 | B | 12/2005 |
| GB | 2414749 | A | 12/2005 |
| GB | 2414750 | A | 12/2005 |
| GB | 2414751 | A | 12/2005 |
| GB | 2415003 | A | 12/2005 |
| GB | 2415215 | | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415982 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2408278 | B | 2/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2406126 | A | 3/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |

| | | | |
|---|---|---|---|
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2414493 | B | 8/2006 |
| GB | 2418690 | B | 8/2006 |
| GB | 2418944 | B | 8/2006 |
| GB | 2421257 | B | 8/2006 |
| GB | 2421258 | B | 8/2006 |
| GB | 2421259 | B | 8/2006 |
| GB | 2422859 | A | 8/2006 |
| GB | 2422860 | A | 8/2006 |
| GB | 2423317 | A | 8/2006 |
| GB | 2404676 | B | 9/2006 |
| GB | 2418941 | B | 9/2006 |
| GB | 2418942 | B | 9/2006 |
| GB | 2418943 | B | 9/2006 |
| GB | 2424077 | A | 9/2006 |
| GB | 2405893 | B | 10/2006 |
| GB | 2413136 | A | 10/2006 |
| GB | 2417273 | B | 10/2006 |
| GB | 2418216 | B | 10/2006 |
| GB | 2418217 | B | 10/2006 |
| GB | 2419907 | B | 10/2006 |
| GB | 2422860 | B | 10/2006 |
| GB | 2406125 | B | 11/2006 |
| GB | 2415004 | B | 12/2006 |
| GB | 2422859 | B | 12/2006 |
| GB | 2423317 | B | 12/2006 |
| GB | 2426993 | A | 12/2006 |
| GB | 2427636 | A | 1/2007 |
| GB | 2427885 | A | 1/2007 |
| GB | 2427886 | A | 1/2007 |
| GB | 2429482 | A | 2/2007 |
| GB | 2410280 | B | 4/2007 |
| GB | 2412178 | B | 5/2007 |
| GB | 2415215 | B | 5/2007 |
| GN | 1111536 | | 5/1968 |
| ID | P01.012.197/2005 | | 8/2004 |
| ID | 044.392 | A | 9/2005 |
| ID | 046.2804 | A | 8/2006 |
| JP | 208458 | | 10/1985 |
| JP | 6475715 | | 3/1989 |
| JP | 102875 | | 4/1995 |
| JP | WO 96/10710 | | 11/1996 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 1295799 | A1 | 2/1995 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 6/1978 |
| SU | 620582 | | 8/1978 |
| SU | 641070 | | 1/1979 |
| SU | 909114 | | 5/1979 |
| SU | 874952 | | 6/1979 |
| SU | 832049 | | 5/1981 |
| SU | 976019 | | 5/1981 |
| SU | 976020 | | 5/1981 |
| SU | 853089 | | 8/1981 |
| SU | 894169 | | 12/1981 |
| SU | 899850 | | 1/1982 |
| SU | 907220 | | 2/1982 |
| SU | 953172 | | 8/1982 |
| SU | 959878 | | 9/1982 |
| SU | 989038 | | 1/1983 |
| SU | 1002514 | | 3/1983 |
| SU | 1041671 | | 9/1983 |
| SU | 1051222 | A | 10/1983 |
| SU | 1077803 | A | 3/1984 |
| SU | 1086118 | A | 4/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | A1 | 7/1988 |
| SU | 1430498 | A1 | 10/1988 |
| SU | 1432190 | A1 | 10/1988 |
| SU | 1601330 | A1 | 10/1990 |
| SU | 1627663 | A | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A1 | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| WO | WO 81/00132 | A1 | 1/1981 |
| WO | WO 90/05598 | A | 5/1990 |
| WO | WO 92/01859 | A1 | 2/1992 |
| WO | WO 92/08875 | A2 | 5/1992 |
| WO | WO 93/25799 | A1 | 12/1993 |
| WO | WO 93/25800 | | 12/1993 |
| WO | WO 93/25800 | A1 | 12/1993 |
| WO | WO 94/21887 | A1 | 9/1994 |
| WO | WO 94/25655 | A1 | 11/1994 |
| WO | WO 95/03476 | A1 | 2/1995 |
| WO | WO 95/01937 | A1 | 1/1996 |
| WO | WO 96/10710 | | 4/1996 |
| WO | WO 96/21083 | A1 | 7/1996 |
| WO | WO 96/26350 | A1 | 8/1996 |
| WO | WO 96/37681 | A1 | 11/1996 |
| WO | WO 97/06346 | A1 | 2/1997 |
| WO | WO 97/11306 | A1 | 3/1997 |
| WO | WO 97/17524 | A2 | 5/1997 |
| WO | WO 97/17526 | A2 | 5/1997 |
| WO | WO 97/17527 | A2 | 5/1997 |
| WO | WO 97/20130 | A2 | 6/1997 |
| WO | WO 97/21901 | A2 | 6/1997 |
| WO | WO 97/35084 | A1 | 9/1997 |
| WO | WO 98/00626 | A1 | 1/1998 |
| WO | WO 98/07957 | A1 | 2/1998 |
| WO | WO 98/09053 | A2 | 3/1998 |
| WO | WO 98/22690 | A1 | 5/1998 |
| WO | WO 98/26152 | A1 | 6/1998 |
| WO | WO 98/42947 | A1 | 10/1998 |

| | | | | |
|---|---|---|---|---|
| WO | WO 98/49423 | A1 | | 11/1998 |
| WO | WO 99/02818 | A1 | | 1/1999 |
| WO | WO 99/04135 | A1 | | 1/1999 |
| WO | WO 99/06670 | A1 | | 2/1999 |
| WO | WO 99/08827 | A1 | | 2/1999 |
| WO | WO 99/08828 | A1 | | 2/1999 |
| WO | WO 99/18328 | A1 | | 4/1999 |
| WO | WO 99/23354 | A1 | | 5/1999 |
| WO | WO 99/25524 | A1 | | 5/1999 |
| WO | WO 99/25951 | A1 | | 5/1999 |
| WO | WO 99/35368 | A1 | | 7/1999 |
| WO | WO 99/43923 | A1 | | 9/1999 |
| WO | WO 00/01926 | A1 | | 1/2000 |
| WO | WO 00/04271 | A1 | | 1/2000 |
| WO | WO 03/00690 | | | 1/2000 |
| WO | WO 00/08301 | A2 | | 2/2000 |
| WO | WO 00/18635 | | | 4/2000 |
| WO | WO 00/26500 | A1 | | 5/2000 |
| WO | WO 00/26501 | A1 | | 5/2000 |
| WO | WO 00/26502 | A1 | | 5/2000 |
| WO | WO 00/31375 | A1 | | 6/2000 |
| WO | WO 00/37766 | A2 | | 6/2000 |
| WO | WO 00/37767 | A2 | | 6/2000 |
| WO | WO 00/37768 | A1 | | 6/2000 |
| WO | WO 00/37771 | A1 | | 6/2000 |
| WO | WO 00/37772 | A1 | | 6/2000 |
| WO | WO 00/39432 | A1 | | 7/2000 |
| WO | WO 00/46484 | A1 | | 8/2000 |
| WO | WO 00/50727 | A1 | | 8/2000 |
| WO | WO 00/50732 | A1 | | 8/2000 |
| WO | WO 00/50733 | A1 | | 8/2000 |
| WO | WO 00/66877 | | | 11/2000 |
| WO | WO 00/77431 | A2 | | 12/2000 |
| WO | WO 01/04520 | A1 | | 1/2001 |
| WO | WO 01/04535 | A1 | | 1/2001 |
| WO | WO 01/47161 | | | 2/2001 |
| WO | WO 01/18353 | | | 3/2001 |
| WO | WO 01/18354 | A1 | | 3/2001 |
| WO | WO 01/21929 | A1 | | 3/2001 |
| WO | WO 01/26860 | A1 | | 4/2001 |
| WO | WO 01/33037 | A1 | | 5/2001 |
| WO | WO 01/38693 | A1 | | 5/2001 |
| WO | WO 01/60545 | A1 | | 8/2001 |
| WO | WO 01/83943 | A1 | | 11/2001 |
| WO | WO 01/98623 | A1 | | 12/2001 |
| WO | WO 02/01102 | A1 | | 1/2002 |
| WO | WO 02/10550 | A1 | | 2/2002 |
| WO | WO 02/10551 | A1 | | 2/2002 |
| WO | WO 02/20941 | A1 | | 3/2002 |
| WO | WO 02/23007 | A1 | | 3/2002 |
| WO | WO 02/25059 | A1 | | 3/2002 |
| WO | WO 0223007 | A1 | * | 3/2002 |
| WO | WO 02/28560 | | | 4/2002 |
| WO | WO 02/29199 | A1 | | 4/2002 |
| WO | WO 02/38343 | A2 | | 5/2002 |
| WO | WO 02/038343 | A3 | | 5/2002 |
| WO | WO 02/40825 | A1 | | 5/2002 |
| WO | WO 02/53867 | A2 | | 7/2002 |
| WO | WO 02/53867 | A3 | | 7/2002 |
| WO | WO 02/059456 | A1 | | 8/2002 |
| WO | WO 02/066783 | A1 | | 8/2002 |
| WO | WO 02/068792 | A1 | | 9/2002 |
| WO | WO 02/073000 | A1 | | 9/2002 |
| WO | WO 02/075107 | A1 | | 9/2002 |
| WO | WO 02/077411 | A1 | | 10/2002 |
| WO | WO 02/081863 | A1 | | 10/2002 |
| WO | WO 02/081864 | A2 | | 10/2002 |
| WO | WO 02/086285 | A1 | | 10/2002 |
| WO | WO 02/086286 | A2 | | 10/2002 |
| WO | WO 02/090713 | A1 | | 11/2002 |
| WO | WO 02/095181 | A1 | | 11/2002 |
| WO | WO 02/163192 | | | 11/2002 |
| WO | WO 02/103150 | A2 | | 12/2002 |
| WO | WO 03/004819 | A2 | | 1/2003 |
| WO | WO 03/004819 | A3 | | 1/2003 |
| WO | WO 03/004820 | A2 | | 1/2003 |
| WO | WO 03/004820 | A3 | | 1/2003 |
| WO | WO 03/004837 | | | 1/2003 |
| WO | WO 03/008756 | A1 | | 1/2003 |
| WO | WO 03/012255 | A1 | | 2/2003 |
| WO | WO 03/014153 | | | 2/2003 |
| WO | WO 03/016669 | A2 | | 2/2003 |
| WO | WO 03/016669 | A3 | | 2/2003 |
| WO | WO 03/023178 | A2 | | 3/2003 |
| WO | WO 03/023178 | A3 | | 3/2003 |
| WO | WO 03/023179 | A2 | | 3/2003 |
| WO | WO 03/023179 | A3 | | 3/2003 |
| WO | WO 03/029607 | A1 | | 4/2003 |
| WO | WO 03/029608 | A1 | | 4/2003 |
| WO | WO 03/036018 | A2 | | 5/2003 |
| WO | WO 03/042486 | A2 | | 5/2003 |
| WO | WO 03/042486 | A3 | | 5/2003 |
| WO | WO 03/042487 | A2 | | 5/2003 |
| WO | WO 03/042487 | A3 | | 5/2003 |
| WO | WO 03/042489 | A2 | | 5/2003 |
| WO | WO 03/048520 | A1 | | 6/2003 |
| WO | WO 03/048521 | A2 | | 6/2003 |
| WO | WO 03/055616 | A2 | | 7/2003 |
| WO | WO 03/058022 | A2 | | 7/2003 |
| WO | WO 03/058022 | A3 | | 7/2003 |
| WO | WO 03/059549 | A1 | | 7/2003 |
| WO | WO 03/064813 | A1 | | 8/2003 |
| WO | WO 03/069115 | A3 | | 8/2003 |
| WO | WO 03/071086 | A2 | | 8/2003 |
| WO | WO 03/071086 | A3 | | 8/2003 |
| WO | WO 03/078785 | A2 | | 9/2003 |
| WO | WO 03/078785 | A3 | | 9/2003 |
| WO | WO 03/086675 | A2 | | 10/2003 |
| WO | WO 03/086675 | A3 | | 10/2003 |
| WO | WO 03/089161 | A2 | | 10/2003 |
| WO | WO 03/089161 | A3 | | 10/2003 |
| WO | WO 03/093623 | A2 | | 11/2003 |
| WO | WO 03/093623 | A3 | | 11/2003 |
| WO | WO 03/093624 | | | 11/2003 |
| WO | WO 03/102365 | A1 | | 12/2003 |
| WO | WO 03/104601 | A2 | | 12/2003 |
| WO | WO 03/104601 | A3 | | 12/2003 |
| WO | WO 03/106130 | A2 | | 12/2003 |
| WO | WO 03/106130 | A3 | | 12/2003 |
| WO | WO 2004/000337 | A1 | | 1/2004 |
| WO | WO 2004/007711 | | | 1/2004 |
| WO | WO 2004/008073 | | | 1/2004 |
| WO | WO 2004/009950 | A1 | | 1/2004 |
| WO | WO 2004/010039 | A2 | | 1/2004 |
| WO | WO 2004/010039 | A3 | | 1/2004 |
| WO | WO 2004/010317 | | | 1/2004 |
| WO | WO 2004/010712 | | | 1/2004 |
| WO | WO 2004/010762 | | | 2/2004 |
| WO | WO 2004/011776 | A2 | | 2/2004 |
| WO | WO 2004/011776 | A3 | | 2/2004 |
| WO | WO 2004/011973 | | | 2/2004 |
| WO | WO 2004/013462 | | | 2/2004 |
| WO | WO 2004/015241 | | | 2/2004 |
| WO | WO 2004/018823 | A2 | | 3/2004 |
| WO | WO 2004/018823 | A3 | | 3/2004 |
| WO | WO 2004/018824 | A2 | | 3/2004 |
| WO | WO 2004/018824 | A3 | | 3/2004 |
| WO | WO 2004/020895 | A2 | | 3/2004 |
| WO | WO 2004/020895 | A3 | | 3/2004 |
| WO | WO 2004/023014 | A2 | | 3/2004 |
| WO | WO 2004/023014 | A3 | | 3/2004 |
| WO | WO 2004/026017 | A2 | | 4/2004 |
| WO | WO 2004/026017 | A3 | | 4/2004 |
| WO | WO 2004/026073 | A2 | | 4/2004 |
| WO | WO 2004/026073 | A3 | | 4/2004 |
| WO | WO 2004/026500 | A2 | | 4/2004 |

| | | | |
|---|---|---|---|
| WO | WO 2004/026500 | A3 | 4/2004 |
| WO | WO 2004/027200 | A2 | 4/2004 |
| WO | WO 2004/027200 | A3 | 4/2004 |
| WO | WO 2004/027201 | | 4/2004 |
| WO | WO 2004/027201 | A2 | 4/2004 |
| WO | WO 2004/027204 | A2 | 4/2004 |
| WO | WO 2004/027204 | A3 | 4/2004 |
| WO | WO 2004/027205 | A2 | 4/2004 |
| WO | WO 2004/027205 | A3 | 4/2004 |
| WO | WO 2004/027318 | | 4/2004 |
| WO | WO 2004/027392 | A1 | 4/2004 |
| WO | WO 2004/027786 | A2 | 4/2004 |
| WO | WO 2004/027786 | A3 | 4/2004 |
| WO | WO 2004/028936 | | 4/2004 |
| WO | WO 2004/053434 | A2 | 6/2004 |
| WO | WO 2004/053434 | A3 | 6/2004 |
| WO | WO 2004/057715 | A2 | 7/2004 |
| WO | WO 2004/057715 | A3 | 7/2004 |
| WO | WO 2004/067961 | A2 | 8/2004 |
| WO | WO 2004/067961 | A3 | 8/2004 |
| WO | WO 2004/072436 | A1 | 8/2004 |
| WO | WO 2004/074622 | A2 | 9/2004 |
| WO | WO 2004/074622 | A3 | 9/2004 |
| WO | WO 2004/076798 | A2 | 9/2004 |
| WO | WO 2004/076798 | A3 | 9/2004 |
| WO | WO 2004/081346 | A2 | 9/2004 |
| WO | WO 2004/083591 | A2 | 9/2004 |
| WO | WO 2004/083592 | A2 | 9/2004 |
| WO | WO 2004/083592 | A3 | 9/2004 |
| WO | WO 2004/083593 | A2 | 9/2004 |
| WO | WO 2004/083594 | A2 | 9/2004 |
| WO | WO 2004/083594 | A3 | 9/2004 |
| WO | WO 2004/085790 | A2 | 10/2004 |
| WO | WO 2004/089608 | A2 | 10/2004 |
| WO | WO 2004/089608 | A3 | 10/2004 |
| WO | WO 2004/092527 | A2 | 10/2004 |
| WO | WO 2004/092528 | A2 | 10/2004 |
| WO | WO 2004/092528 | A3 | 10/2004 |
| WO | WO 2004/092530 | A2 | 10/2004 |
| WO | WO 2004/092530 | A3 | 10/2004 |
| WO | WO 2004/094766 | A2 | 11/2004 |
| WO | WO 2004/094766 | A3 | 11/2004 |
| WO | WO 2005/017303 | A2 | 2/2005 |
| WO | WO 2005/021921 | A2 | 3/2005 |
| WO | WO 2005/021921 | A3 | 3/2005 |
| WO | WO 2005/021922 | A2 | 3/2005 |
| WO | WO 2005/021922 | A3 | 3/2005 |
| WO | WO 2005/023391 | | 3/2005 |
| WO | WO 2005/024170 | A2 | 3/2005 |
| WO | WO 2005/024170 | A3 | 3/2005 |
| WO | WO 2005/024171 | A3 | 3/2005 |
| WO | WO 2005/027318 | | 3/2005 |
| WO | WO 2005/028446 | | 3/2005 |
| WO | WO 2005/028451 | | 3/2005 |
| WO | WO 2005/028453 | | 3/2005 |
| WO | WO 2005/028473 | | 3/2005 |
| WO | WO 2005/028641 | | 3/2005 |
| WO | WO 2005/028642 | | 3/2005 |
| WO | WO 2005/028669 | | 3/2005 |
| WO | WO 2005/028803 | A2 | 3/2005 |
| WO | WO 2005/028819 | | 3/2005 |
| WO | WO 20058028936 | | 3/2005 |
| WO | WO 20058043122 | | 5/2005 |
| WO | WO 2005/061852 | | 7/2005 |
| WO | WO 2005/071212 | A1 | 8/2005 |
| WO | WO 2005/079186 | A2 | 9/2005 |
| WO | WO 2005/079186 | A3 | 9/2005 |
| WO | WO 2005/081803 | A2 | 9/2005 |
| WO | WO 2005/086614 | A2 | 9/2005 |
| WO | WO 2006/002449 | | 1/2006 |
| WO | WO 2006/010674 | | 2/2006 |
| WO | WO 2006/014333 | A2 | 2/2006 |
| WO | WO 2006/017459 | A2 | 2/2006 |
| WO | WO 2006/020723 | A2 | 2/2006 |
| WO | WO 2006/020726 | A2 | 2/2006 |
| WO | WO 2006/020734 | A2 | 2/2006 |
| WO | WO 2006/020734 | A3 | 2/2006 |
| WO | WO 2006/020809 | A2 | 2/2006 |
| WO | WO 2006/020810 | A2 | 2/2006 |
| WO | WO 2006/020810 | A3 | 2/2006 |
| WO | WO 2006/020827 | A2 | 2/2006 |
| WO | WO 2006/020913 | A2 | 2/2006 |
| WO | WO 2006/020913 | A3 | 2/2006 |
| WO | WO 2006/020960 | A2 | 2/2006 |
| WO | WO 2006/033720 | A2 | 3/2006 |
| WO | WO 2006/060387 | A2 | 6/2006 |
| WO | WO 2006/060387 | A3 | 6/2006 |
| WO | WO 2006/079072 | A2 | 7/2006 |
| WO | WO 2006/079072 | A3 | 7/2006 |
| WO | WO 2006/088743 | A2 | 8/2006 |
| WO | WO 2006/088743 | A3 | 8/2006 |
| WO | WO 2006/096762 | A1 | 9/2006 |
| WO | WO 2006/102171 | A2 | 9/2006 |
| WO | WO 2006/102556 | A2 | 9/2006 |
| WO | WO 2007/014339 | A2 | 2/2007 |

OTHER PUBLICATIONS

Examination Report dated Sep. 22, 2006 on Australian Patent Application No. 2004200248.
Examination Report dated Mar. 7, 2007 on Australian Patent Application No. 2002367017.
Examination Report dated Jun. 5, 2007 on Brazilian patent application No. PI 9906143-0.
Examination Report dated Jul. 3, 2007 on Canadian Patent Application No. 2536623.
Examination Report dated Jun. 12, 2007 on Canadian Patent Application No. 2516140.
Examination Report dated Feb. 20, 2007 on Canadian Patent Application No. 2428819.
Examination Report dated Feb. 26, 2007 on Canadian Patent Application No. 2389094.
Examination Report dated Jul. 4, 2007 on European Patent Application No. 3728326.4.
Examination Report dated Apr. 2, 2007 on European Patent Application No. 3701281.2.
Examination Report dated Mar. 15, 2007 on British patent application No. 602877.3.
Examination Report dated Sep. 17, 2007 on British patent application No. 602877.3.
Examination Report dated Sep. 18, 2007 on British patent application No. 604359.0.
Examination Report dated Sep. 13, 2007 on British Patent application No. 604360.8.
Examination Report dated May 23, 2007 on British patent application No. 621060.3.
Examination Report dated Jul. 23, 2007 on British patent application No. 621060.3.
Examination Report dated Jun. 21, 2007 on British patent application No. 621059.5.
Examination Report dated Aug. 8, 2007 on British patent application No. 621059.5.
Examination Report dated Jun. 21, 2007 on British patent application No. 621053.8.
Examination Report dated Aug. 13, 2007 on British patent application No. 621053.8.
Examination Report dated Aug. 17, 2007 on British patent application NO. 603576.
Examination Report dated Aug. 7, 2007 on British patent application No. 613924.
Examination Report dated May 23, 2007 on British patent application No. 621062.9.
Examination Report dated Jul. 23, 2007 on British patent application No. 621062.9.
Examination Report dated Apr. 5, 2007 on British patent application No. 613406.8.

Examination Report dated Jun. 22, 2007 on British patent application No. 609173.
Examination Report dated Sep. 14, 2007 on British patent application No. 623634.3.
Examination Report dated Jul. 5, 2007 on British patent application No. 624328.1.
Examination Report dated Sep. 4, 2007 on British patent application No. 624328.1.
Examination Report dated Aug. 7, 2007 on British patent application No. 624327.3.
Examination Report dated Sep. 5, 2007 on British patent application No. 624394.3.
Examination Report dated Sep. 5, 2007 on British patent application No. 624768.
Examination Report dated Sep. 13, 2007 on British patent application No. 624779.5.
Examination Report dated Aug. 15, 2007 on British patent application No. 625615.
Examination Report dated Jul. 26, 2007 on British patent application No. 522049.6.
Examination Report dated Mar. 5, 2007 on British patent application No. 522049.6.
Examination Report dated Sep. 7, 2007 on British patent application No. 522049.6.
Examination Report dated Aug. 16, 2007 on British patent application No. 625636.6.
Examination Report dated Jul. 16, 2007 on British patent application No. 522155.1.
Examination Report dated Sep. 26, 2007 on British patent application No. 624781.1.
Search and Examination Report dated Aug. 16, 2007 on British patent application No. 621054.6.
Search and Examination Report dated Oct. 5, 2007 on British patent application No. 623631.9.
Search and Examination Report dated Mar. 30, 2007 on British patent application No. 702797.2.
Search and Examination Report dated Aug. 2, 2007 on British Patent application No. 702797.2.
Search and Examination Report dated Mar. 19, 2007 on British patent application No. 624327.3.
Search and Examination Report dated Aug. 15, 2007 on British patent application No. 624327.3.
Search and Examination Report dated Mar. 19, 2007 on British patent application No. 625615.
Search and Examination Report dated Jun. 28, 2007 on British patent application No. 707073.3.
Search and Examination Report dated Jul. 31, 2007 on British patent application No. 706794.5.
Search and Examination Report dated Jun. 7, 2007 on British patent application No. 706799.4.
Search and Examination Report dated Sep. 3, 2007 on British patent application No. 715477.6.
Search and Examination Report dated Sep. 3, 2007 on British patent application No. 715478.4.
Search and Examination Report dated Sep. 3, 2007 on British patent application No. 715362.
Search and Examination Report dated Sep. 4, 2007 on British patent application No. 715357.
Search and Examination Report dated Sep. 4, 2007 on British patent application No. 715365.3.
Search and Examination Report dated Mar. 15, 2007 on British patent application No. 625636.6.
Search and Examination Report dated Mar. 15, 2007 on British patent application No. 624394.3.
Search and Examination Report dated Mar. 15, 2007 on British patent application No. 604357.4.
Search and Examination Report dated Mar. 15, 2007 on British patent application No. 623631.9.
Search and Examination Report dated Mar. 15, 2007 on British patent application No. 623634.3.
Search and Examination Report dated Apr. 24, 2007 on British patent application No. 702989.5.
Search and Examination Report dated Mar. 15, 2007 on British patent application No. 624779.5.
Search and Examination Report dated Mar. 15, 2007 on British patent application No. 624790.2.
Search and Examination Report dated Mar. 15, 2007 on British patent application No. 603995.2.
Search and Examination Report dated Oct. 10, 2007 on British patent application No. 603995.2.
Search and Examination Report dated Mar. 15, 2007 on British patent application No. 6043593.
Search and Examination Report dated Mar. 15, 2007 on British patent application No. 604360.8.
Search Report date Jun. 6, 2007 on British patent application No. 613406.8.
Substantive Examination dated Jul. 25, 2007 on Mexican patent application No. PA/A/2004/006681.
Examination Report dated Oct. 5, 2007 on Mexican patent application No. PA/A/2005/003117.
Examination Report dated Oct. 16, 2007 on Mexican patent application No. PA/A/2005/003116.
Examination Report dated Oct. 5, 2007 on Mexican patent application No. PA/A/2004/007922.
Examination Report dated Aug. 31, 2007 on Norwegian Patent Application No. 20002876.
Examination Report dated May 23, 2007 on Norwegian patent application No. 20001281.
Examination Report dated Jul. 26, 2007 on Norwegian patent application No. 20021613.
Examination Report dated Oct. 10, 2005 on Norwegian patent application No. 20000924.
Examination Report dated Aug. 3, 2007 on Norwegian patent application No. 20000924.
International Preliminary Exam Report dated May 23, 2007 on International patent application No. PCT/US06/009886.
Written Opinion of ISA dated Aug. 2, 2007 on International patent application No. PCT/US05/028451.
Search Report of ISA dated Aug. 2, 2007 on International patent application No. PCT/US05/028451.
Neal J. Adams, Drilling Engineering, A Complete Well Planning Approach, pp. 618-627, PennWell Publishing Company, Tulsa, Oklahoma.
Harvey J. Arbuckle, Advanced Laser Texturing Tames Tough Tasks.
Baker Hughes, EXPatch Expandable Cladding System, Copyright 2002, Baker Hughes Inc.
Baker Hughes, EXPress Expandable Screen System, Baker Hughes Inc.
Baker Hughes, FORMlock Expandable Liner Hanger, Baker Hughes Inc.
Dorel Banabic, Analysis of Metal Sheet Formability and its Factors of Influence, Deep-Drawing Optimization by Controlling the Blank-Holding Force, Mathematical Modelling of Some Special Sheet Metal Forming Procedures, Finite Element Simulation of Deep-Drawing, Theoretical and Experimental Research on Anisotropic Behavior of Sheet Metal.
Kate Blasingame, Gerry Cales, Solid Expandable Tubular Technology in Mature Basins, Copyright 2003, pp. 1-10, AAPG/SPE.
J.C.M. Braas, C.O. Aihevba, M. Shandoodi, R.H. Van Noort, M.N. Baaijens, Water Production Management—PDO's Successful Application of Expandable Technology, Copyright 2002, pp. 1-8, Society of Petroleum Engineers.
V. Brizmer, Y. Kligerman, I. Etson, A Laser Surface Textured Parallel Thrust Bearing, 2003, pp. 397-403, vol. 46, Issue 3.
Jim Brock, Scott Costa, Lev Ring, Andrei Filippov, An Expanded Horizon, Feb. 2000, pp. 115-117.
Bill Buckler, Nick Steinsberger, Kevin Waddell, Rune Gusevik, Edwin Zwald, Expandable Cased-hole Liner Remediates Prolific Gas Well and Minimizes Loss of Production, Copyright 2002, pp. 1-6.
Michael D. Bullock, Tubulars Technology—Expandable Tubular Technology Continues to Broaden Range of Applications, Advances Grow Expandable Applications, Sep. 2004, The American Oil & Gas Reporter.

G.L. Cales, The Development and Applications of Solid Expandable Tubular Technology, Jun. 10, 2003, pp. 1-11.
Gerry Cales, Tom Grant, Larry Book, Reducing Non-Productive Time Through the Use of Solid Expandable Tubulars: How to Beat the Curve Through Pre-Planning, Copyright 2004, Offshore Technology Conference.
Gerry Cales, David Shepherd, Brad Wiest, Pat York, Chan Daigle, Larry Rose, Mike Patterson, Subsidence Remediation—Extending Well Life Through the Use of Solid Expandable Casing Systems, Mar. 27, 2001, pp. 1-16, American Association of Drilling Engineers.
Don Campo, Gerald Cales, Colley Andrews, Mike Bullock, Mark Rivenbark, Patrick York, Case Histories—Drilling and Recompletion Applications Using Solid Expandable Tubular Technology, Copyright 2002, pp. 1-13, Society of Petroleum Engineers.
Chris Carstens, Mike Breaux, Kate Blasingame, Solid Expandable Tublar Technology: The Value of Planned Installation vs. Contingency, pp. 1-10.
Case History—Eemskanaal—2, Groningen, Feb. 2002, Enventure Global Technology.
Case History—Graham Ranch No. 1, Newark East Barnett Field, Feb. 2002, Enventure Global Technology.
Case History—K.K. Camel No. 1, Ridge Field, Lafayette Parish, Louisiana, Feb. 2002, Enventure Global Technology.
Case History—Mississippi Canyon 809, URSA TLP, OCS-G 5868, No. A-12, Mar. 2004, Enventure Global Technology.
Case History—Unocal Sequoia, Mississippi Canyon 941 Well No. 2, 2005, Enventure Global Technology.
Case History—Yibal 381, Oman, Feb. 2002, Enventure Global Technology.
Lance Cook, Same Internal Casing Diameter From Surface to TD—Drilling Deeper than Ever Before, pp. 1-2, Jul. 2002, Offshore Magazine.
Adrian Cottrill, Core Ideas Expanding Into the Mainstream, Jul. 26, 2002, pp. 26-27, Upstream Magazine.
Chan L. Daigle, Donald B. Campo, Carey J. Naquin, Rudy Cardenas, Lev M. Ring, Patrick L. York, Expandable Tubulars: Field Examples of Application in Well Construction and Remediation, Copyright 2000, pp. 1-14, Society of Petroleum Engineers.
Ali Daneshy, Management Report, Technology Strategy Breeds Value, May 2004.
Data Sheet—Enventure Cased-Hole Liner (CHL) System, Dec. 2002, pp. 1-2, Enventure Global Technology.
Data Sheet—Enventure Openhold Liner (OHL) System, Dec. 2002, pp. 1-2, Enventure Global Technology.
Data Sheet—Window Exit Applications OHL Window Exit Expansion, Jun. 2003, pp. 1-2, Enventure Global Technology.
Bill Dean, Lance Cook, David Brisco, Monodiameter Drilling Liner—From Concept to Reality, Copyright 2003, pp. 1-15, Society of Petroleum Engineers.
Karl Demong, Breakthroughs using Solid Expandable Tubulars to Construct Extended Reach Wells, Copyright, 2004, pp. 1-13, Society of Petroleum Engineers.
Karl Demong, Mark Swift, Mark Rivenbark, Carl Dismuke, Saudi Aramco, Casing Design in Complex Wells: The Use of Expandables and Multilateral Technology to Attack the Size Reduction Issue, pp. 1-11.
Karl Demong, Mark Rivenbark, Carl Dismuke, Expandable Tubulars Enable Multilaterals without Compromise on Hole Size, Casing Design in Complex Wells, Jun. 2003, PennWell Corporation.
Karl Demong, Mark Rivenbark, Khalid Syed Hussain, Planning the Well Construction Process for the use of Solid Expandable Casing, Copyright 2003, pp. 1-10, Society of Petroleum Engineers.
Laurence Demoulin, Tendance Technologie, Les tubes expansibles changent la face du forage petroller, Jul. 3, 2003, pp. 50-52, Issue No. 2878.
Kenneth Dupal, Donald B. Campo, Colley J. Andrews, R. Lance Cook, Lev M. Ring, Patrick L. York, Realization of the MonoDiameter Well: Evolution of a Game-Changing Technology, Copyright 2002, pp. 1-10, Issue No. 14312, Offshore Technology Conference.
Kenneth K. Dupal, Donald B. Campo, John E. Lofton, Don Weisinger, R. Lance Cook, Michael D. Bullock, Thomas P. Grant, Patrick L. York, Solid Expandable Tubular Technology—A Year of Case Histories in the Drilling Environment, Copyright 27, 2001, pp. 1-16, Issue No. 67770, Society of Petroleum Engineers.
Ken Dupal, Carey J. Naquin, Chan Daigle, Lance Cook, Pat York, Deep Offshore Technology, Well Design With Expandable Tubulars Reduces Costs and Increases Success in Deepwater Applications, 2000, pp. 2-16.
Gier Owe Egge, Production Enhancement Technology, Mar. 10, 2003, pp. 1-18.
EIS Expandable Isolation Sleeve, Feb. 2003.
Letter from Darin H. Duphorne of Baker Hughes to William Norvell of Beirne, Maynard & Parsons, L.L.P. dated Apr. 1, 2005.
SET Technology: The Facts, Copyright 2004, pp. 1-25.
Solid expandable tubulars are enabling technology, Drilling Contractor, Mar./Apr. 2001.
Enventure ready to rejuvenate the North Sea, Pipe & Tubular Services, Sep. 2004.
Carlos Escobar, Bill Dean, Brian, Race, Kevin Waddell, Increasing Solid Expandable Tubular Technology Reliability in a Myriad of Downhole Environments, Copyright 2003, Society of Petroleum Engineers.
Izhak Etsion, Improving Tribological Performance of Mechanical Seals by Laser Surface Texturing, Surface Technologies LTD.
Izhak Etsion, Gregory Halperin, A laser surface textured hydrostatic mechanical seal, Sealing Technology, Mar. 2003.
Expandable Casing Accesses Remote Reservoirs, Petroleum Engineer International, Apr. 1999.
Expandable Sand Screens, Weatherford Completion Systems, Copyright 2002, pp. 1-40.
Andrei Filippov, Robert Mack, Lance Cook, Patrick York, Lev Ring, Terry McCoy, Expandable Tubular Solutions, Copyright 1999, pp. 1-16, Issue 56500, Society of Petroleum Engineers.
First ever SET workshop held in Aberdeen, Roustabout, Oct. 2004.
Perry A. Fischer, Expandables and the dream of the monodiameter well: a status report, Jul. 2004, World Oil.
Rick Von Flatern, Oilfield Service trio target Jules Verne Territory, Aug. 17, 2001, OilOnline—The Original Online Source for the Oil Industry.
Rick Fontova, Solid Expandable Tubulars (SET) Provide Value to Operators Worldwide in a Variety of Applications, Apr. 2005, EP Journal of Technology, pp. 1-17.
Fraunhofer IWU—Research Area: Sheet Metal Forming—Superpositions of Vibrations, Copyright 2001.
William Furlow, casing expansion, test process fine tuned on ultra-deepwater well, Offshore, Dec. 2000, PennWell Corporation.
William Furlow, Expandable solid casing reduces telescope effect, Offshore, pp. 102, 140, Issue: Aug. 1998, PennWell Corporation.
William Furlow, Agbada well solid tubulars expanded bottom up, screens expanded top down, Offshore, Issue: Jan. 2002, PennWell Corporation.
Mike Gilmer, Brent Emerson, World's First Completion Set Inside Expandable Screens, High Tech Wells, Copyright 2003, pp. 1-7.
Thomas P. Grant, Michael D. Bullock, Deepwater Expandable Openhole Liner Case Histories: Learnings Through Field Applications, Offshore Technology Conference, Copyright 2002, pp. 1-6, Issue 14218.
Philip Guichelaar, Karalyn Folkert, Izhak Etsion, Steven Pride, Effect of Micro-Surface Texturing on Breakaway Torque and Blister Formation on Carbon-Graphite Faces in a Mechanical Seal, Journal of the Society of Tribologists and Lubrication Engineers, Aug. 2002, pp. 18-21.
Rune Gusevik, Randy Merritt, Reaching Deep Reservoir Targets Using Solid Expandable Tubulars, Society of Petroleum Engineers, Copyright 2002, pp. 1-8, Issue 77612.
Henry Haefke, Yvonne Gerbig, Gabriel Dumitru, Valerio Romano, Microtexturing of Functional Surfaces for Improving Their Tribological Performance, Proceedings of the International Tribology Conference, 2000, pp. 217-221, Nagasaki.
Completion Products, Halliburton, Copyright 1996.
Ian D. Harris, Tube Welding, www.tubenet.org, accessed Oct. 25, 2006.
Richard C. Haut, Qamar Sharif, Meeting Economic Challenges of Deepwater Drilling With Expandable—Tubular Technology, Deep Offshore Technology Conference, 1999.

Jennifer Pallanich Hull, MonoDiameter technology keeps hole diameter to TD, Offshore, Copyright 2002, pp. 1-2, Issue—Oct. 2002, PennWell Corporation.

Innovators Chart the Course, pp. 1-21, PennWell Custom Publishing, Tulsa/U.S.A.

Diane Langley, Case Study: Value in Drilling Derived From Application-Specific Technology.

G.R. Linsell, Trib-Gel A Chemical Cold Welding Agent, Trib Tech, Jan. 5, 2004, pp. 1-5.

Todd E. Lizotte, Scratching the surface, PT Design, pp. 41-44, Issue—Jun. 1999.

C. Lee Lohoefer, Ben Mathis, David Brisco, Kevin Waddell, Lev Ring, Patrick York, Expandable Liner Hanger Provides Cost-Effective Alternative Solution, Society of Petroleum Engineers, Copyright 2000, pp. 1-12, Issue 59151.

R.D. Mack, Terry McCoy, Lev Ring, How in situ expansion affects casing and tubing properties, World Oil magazine, pp. 69-71, Issue Jul. 1999, Gulf Publishing Company.

Robert Mack, Andrei Filippov, Larry Kendziora, Lev Ring, In-Situ Expansion of Casing and Tubing—Effect on Mechanical Properties and Resistance to Sulfide Stress Cracking, Corrosion 2000, Copyright 2000, pp. 1-13, Issue 00164.

Randy M. Merritt, Casing Remediation—Extending Well Life Through the Use of Solid Expandable Casing Systems, pp. 1-15.

Randy M. Merritt, William Buckler, Nick Steinsberger, Rune Gusevik, Well Remediation Using Expandable Cased-Hole Liners—Summary of Case Histories.

Randy M. Merritt, Rune Gusevik, William Buckler, Nick Steinsberger, Well remediation using expandable cased-hole liners, World Oil, Copyright 2002, pp. 56-65, Issue Jul. 2002, Gulf Publishing Company, U.S.A.

Expandable Tubular Energy, Mohawk Energy, Houston, TX/U.S.A.

Melvin J. Moore, Donald B. Campo, Joel Hockaday, Lev Ring, Expandable Liner Hangers: Case Histories, Copyright 2002, pp. 1-11, Issue 14313, Offshore Technology Conference.

Melvin J. Moore, Warren J. Winters, Edwin Zwald, David Brisco, Field Trial Proves Upgrades to Solid Expandable Tubulars, Offshore Technology Conference, Copyright 2002, pp. 1-11, Issue 14217.

Shell and Halliburton Agree to Form Company to Develop and Market Expandable Casing Technology, News Release—Joint Venture, Jun. 3, 1998, pp. 1-2.

Norlizah Mohn Nor, Edmund Huang, Chin Hon Voon, James Lau, Michael Ruggier, Transforming Conventional Wells to Bigbore Completions Using Solid Expandable Tubular Technology, Offshore Technology Conference, Copyright 2002, pp. 1-8, Issue 14315.

Michael Patin, Doug Keel, Craig Johnson, Virgil Newton, Overcoming Well Control Challenges with Solid Expandable Tubular Technology, Offshore Technology Conference, Copyright 2003, pp. 1-5, Issue 15152.

Pipeline Rehabilitation by Sliplining with Polyethylene Pipe, pp. 382-412.

Design and optimization of an ultrasonic die system for forming metal cans, Power Ultrasonics, Jul. 1, 2000.

Matt Ratliff, Changing Safety Paradigms in the Oil and Gas Industry, Society of Petroleum Engineers, Copyright 2004, pp. 1-6, Issue 90828.

Conoco and Tesco Unveil Revolutionary Drilling Rig, Rigzone News, Feb. 11, 2002.

Tesco Provides Casing Drilling Operations Update, Rigzone News, Oct. 16, 2001.

Mark Rivenbark, Expandable Tubular Technology—Drill Deeper, Farther, More Economically, Enventure Global Technology.

Mark Rivenbark, Karl Demong, Sami S. Mulhem, Glen Olivera, Solid Expandable Tubular Technology: The Value of Planned Installation vs. Contingency, Society for Petroleum Engineers, Copyright 2004, pp. 1-8, Issue 90821.

Mark Rivenbark, Karl Demong, Omar Al Faraj, Window Exit Sidetrack Enhancements Through the Use of Solid Expandable Casing, Society of Petroleum Engineers/International Association of Drilling Contractors, Copyright 2004, pp. 1-7, Issue 88030.

Eduardo Perez-Roca, Stacey Andrews, Doug Keel, Addressing Common Drilling Challenges Using Solid Expandable Tubular Technology, Society of Petroleum Engineers, Copyright 2003, pp. 1-9, Issue 80446.

Aviram Ronen, Izhak Etsion, Yuri Kligerman, Friction-Reducing Surface-Texturing in Reciprocating Automotive Components, Tribology Transactions, 2001, pp. 359-366, vol. 44.

G. Ryk, Y. Kligerman, I. Etsion, Experimental Investigation of Laser Surface Texturing for Reciprocating Automotive Components, Tribology Transactions, 2002, pp. 444-449, vol. 45.

Tom Sanders, Rune Gusevik, Ron Nida, James Griffith, Practices for Providing Zonal Isolation in Conjunction with Expandable Casing Jobs—Case Histories, pp. 1-5.

Tom Sanders, Tim Baseflug, Neal Keith, Three Diverse Applications on Three Continents for a Single Major Operator, Offshore Technology Conference, Copyright 2004, pp. 1-8, Issue 16667.

SET Technology: The Facts, Enventure Global Technology, Copyright 2004, pp. 1-25.

Gert Jan Siemers, Thompson Ukomah, Robert Mack, Greg Noel, John Donald, Development and Field Testing of Solid Expandable Corrosion Resistant Cased-hole Liners to Boost Gas Production in Corrosive Environments, Offshore Technology Conference, Copyright 2003, pp. 1-6, Issue 15149.

Slim Well: Stepping Stone to MonoDiameter, Enventure Global Technology, pp. 1-16, Issue Jun. 2003.

Maurice Smith, Pipe Dream Reality, New Technology Magazine, pp. 1-3, Issue Dec. 2003.

Solid Expandable Tubulars, Enventure Global Technology, pp. 1-16, Issue Mar. 2002.

Steven W. Sparling, Greg Noel, Expanding Oil Field Tubulars Through a Window Demonstrates Value and Provides New Well Construction Option, Offshore Technology Conference, Copyright 2004, pp. 1-9, Issue 16664.

Mike Sumrow, Shell drills world's first MonDiameter well in South Texas, Oil & Gas Journal, Copyright 2002, Issue Oct. 21, 2002, PennWell Corporation.

Nicolas Touboul, Lee Womble, John Kotrla, Neal Keith, New Technologies Combine to Reduce Drilling Costs in Ultradeepwater Applications, Society of Petroleum Engineers, Copyright 2004, pp. 1-10, Issue 90830.

Letter from Tod T. Tumey of Turney L.L.P. to Andrei Filippov of Mohawk Energy regarding analyzation of patents 6892819, 6695012, 6640903, 6631769, 6631759, 5348095, May 6, 2006.

Donald L. Turcotte, gerald Schubert, Geodynamics Applications of Continuum Physics to Geological Problems, Copyright 1982, John Wiley & Sons, Inc., Canada.

Roger Van Noort, Mark Rivenbark, Mike Jones, Using Solid Expandable Tubulars for Openhole Water Shutoff, Society of Petroleum Engineers, Copyright 2002, pp. 1-6, Issue 78495.

Roger Van Noort, Majid Shandoodi, Mike Jones, Water Production Reduced Using Solid Expandable Tubular Technology to "Clad" in Fractured Carbonite Formation, Offshore Technology Conference, Copyright 2003, pp. 1-9, Issue 15153.

Rick Von Flatern, From exotic to routine—the offshore quick-step, Offshore Engineer, pp. 77-83, Issue Apr. 2004.

Rick Von Flatern, Oilfield service trio target Jules Verne territory, Offshore Engineer, pp. 1-4, Issue Aug. 2001.

Kevin Waddell, Advances in Single-diameter Well Technology: The Next Step to Cost-Effective Optimization, Society of Petroleum Engineers, Copyright 2004, pp. 1-10, Issue 90818.

Kevin Waddell, Rutmer Schuurmans, Installation of Solid Expandable Tubular Systems Through Milled Casing Windows, Society of Petroleum Engineers, Copyright 2004, pp. 1-10, Issue 87208.

Peggy Williams, Straightening the Drilling Curve, Drilling Technology, Issue Jan. 2003.

Threadlockers, Oilfield Catalog Jet-Lok Product Application Descriptions, www.jetlube.com, accessed Aug. 8, 2003.

Low Temperature Bonding of Dissimillar and Hard-to-Bond Materials and Metals-Including, Materials Resources International, www.materialsresources.com, Accessed Jan. 5, 2004.

3d Surface Texture Parameters, www.michmet.com, accessed Jan. 22, 2004.

Glavanic Protection, Metallurgical Bonds, Custom Fabrication—Spur Industries, www.spurind.com, accessed Jan. 5, 2004.
Examination Report dated Sep. 4, 2006 on Australian patent application No. 2001/278196.
Examination Report dated Oct. 4, 2006 on Australian patent application No. 2002/237757.
Examination Report dated Apr. 21, 2005 on Australian patent application No. 2001/278196.
Examination Report dated Apr. 28, 2005 on Australian patent application No. 2002/237757.
Examination Report dated Apr. 13, 2005 on Australian patent application No. 2002/240366.
Examination Report dated Jan. 19, 2006 on Australian patent application No. 2003/257878.
Examination Report dated Jan. 30, 2006 on Australian patent application No. 2003/257878.
Examination Report dated Jan. 19, 2006 on Australian patent application No. 2003/257881.
Examination Report dated Jan. 30, 2006 on Australian patent application No. 2003/257881.
Examination Report dated Jun. 14, 2006 on Australian patent application No. 2004/202805.
Examination Report dated Jun. 14, 2006 on Australian patent application No. 2004/202809.
Examination Report dated Jun. 14, 2006 on Australian patent application No. 2004/202812.
Examination Report dated Jun. 14, 2006 on Australian patent application No. 2004/202813.
Examination Report dated Jun. 14, 2006 on Australian patent application No. 2004/202815.
Examination Report dated Nov. 15, 2006 on Canadian patent application No. 2298139.
Examination Report dated Feb. 7, 2007 on Canadian patent application No. 2383231.
Examination Report dated Jan. 24, 2007 on Canadian patent application No. 2419806.
Examination Report dated Jan. 30, 2007 on Canadian patent application No. 2432030.
Examiniation Report dated Jan. 24, 2007 on Canadian patent application No. 2438807.
Examination Report dated Jan. 30, 2007 on Canadian patent application No. 2517524.
Examination Report dated Mar. 1, 2007 on Chinese PCT national patent application No. 02827985.9.
Examination Report dated Apr. 24, 2006 on European patent application No. 03728326.4.
Examination Report dated Jun. 28, 2006 on European patent application No. 03752486.5.
Search Report dated Nov. 14, 2005 on European application No. 03071281.2.
Search Report dated Nov. 7, 2005 on European application No. 03701281.
Search Report dated May 3, 2006 on European application No. 03723674.2.
Search Report dated Mar. 7, 2006 on European application No. 03728326.
Search Report dated Apr. 24, 2006 on European application No. 03728326.4.
Search Report dated Feb. 8, 2006 on European application No. 03752486.5.
Search Report dated Feb. 24, 2006 on European application No. 03759400.
Search Report dated Mar. 24, 2006 on European application No. 03759400.9.
Search Report dated Mar. 14, 2006 on European application No. 03793078.
Search Report dated Jun. 16, 2006 on European application No. 03793078.1.
Search Report dated Feb. 9, 2005 on European application No. 02806451.7.
Search Report dated Nov. 7, 2005 on European application No. 03701281.
Search Report dated Nov. 22, 2005 on European application No. 03723674.2.
Examination Report dated Oct. 31, 2003 on British patent application No. 0219757.2.
Examination Report dated Nov. 25, 2003 on British patent application No. 0013661.4.
Examination Report dated Apr. 4, 2003 on British patent application No. 0208367.3.
Examination Report dated Nov. 4, 2003 on British patent application No. 0208367.3.
Examination Report dated Nov. 17, 2003 on British patent application No. 0208367.3.
Examination Report dated Jan. 30, 2004 on British patent application No. 0208367.3.
Examination Report dated Apr. 10, 2003 on British patent application No. 0212443.6.
Examination Report dated Feb. 9, 2004 on British patent application No. 0216409.3.
Examination Report dated Nov. 28, 2003 on British patent application No. 0300085.8.
Examination Report dated Dec. 1, 2003 on British patent application No. 030086.6.
Examination Report dated Sep. 10, 2004 on British patent application No. 0306046.4.
Examination Report dated Jul. 15, 2004 on British patent application No. 0314846.7.
Examination Report dated May 25, 2004 on British patent application No. 0320747.9.
Examination Report dated Jan. 31, 2006 on British patent application No. 03701281.2.
Examination Report dated Feb. 6, 2006 on British patent application No. 03723674.2.
Examination Report dated Oct. 29, 2004 on British patent application No. 0400018.8.
Examination Report dated Nov. 4, 2005 on British patent application No. 0400019.6.
Examination Report dated Oct. 29, 2004 on British patent application No. 0400019.6.
Examination Report dated Sep. 2, 2005 on British patent application No. 0400019.6.
Examination Report dated May 20, 2004 on British patent application No. 0404796.5.
Examination Report dated Jun. 28, 2004 on British patent application No. 0406257.6.
Examination Report dated Sep. 2, 2005 on British patent application No. 0406257.6.
Examination Report dated Feb. 21, 2006 on British patent application No. 0406257.6.
Examination Report dated Mar. 3, 2006 on British patent application No. 0406257.6.
Examination Report dated May 20, 2004 on British patent application No. 0406258.4.
Examination Report dated Jul. 12, 2004 on British patent application No. 0408672.4.
Examination Report dated Feb. 13, 2006 on British patent application No. 0412876.5.
Examination Report dated Dec. 8, 2004 on British patent application No. 0422419.2.
Examination Report dated Nov. 8, 2005 on British patent application No. 0422419.2.
Examination Report dated Dec. 15, 2005 on British patent application No. 0422893.8.
Examination Report dated Aug. 8, 2005 on British patent application No. 0422893.8.
Examination Report dated Nov. 24, 2005 on British patent application No. 0425948.7.
Examination Report dated Nov. 24, 2005 on British patent application No. 0425956.0.
Examination Report dated Feb. 9, 2005 on British patent application No. 0428141.5.
Examination Report dated Feb. 21, 2006 on British patent application No. 0428141.6.

Examination Report dated Apr. 5, 2006 on British patent application No. 0500275.3.
Examination Report dated Sep. 12, 2005 on British patent application No. 0500184.7.
Examination Report dated Sep. 6, 2005 on British patent application No. 0500600.2.
Examination Report dated Jan. 27, 2006 on British patent application No. 0501667.0.
Examination Report dated Nov. 15, 2005 on British patent application No. 0503250.3.
Examination Report dated Mar. 2, 2006 on British patent application No. 0503250.3.
Examination Report dated Sep. 22, 2005 on British patent application No. 0503470.7.
Examination Report dated Sep. 21, 2005 on British patent application No. 0506699.8.
Examination Report dated May 11, 2006 on British patent application No. 0506699.8.
Examination Report dated Jan. 17, 2006 on British patent application No. 0507979.3.
Examination Report dated Jun. 16, 2005 on British patent application No. 0507979.3.
Examiniation Report dated Sep. 29, 2005 on British patent application No. 0507980.1.
Examination Report dated Feb. 3, 2006 on British patent application No. 0509618.5.
Examination Report dated Feb. 14, 2006 on British patent application No. 0509620.1.
Examination Report dated Feb. 3, 2006 on British patent application No. 0509627.6.
Examination Report dated Feb. 3, 2006 on British patent application No. 0509629.2.
Examination Report dated Sep. 27, 2005 on British patent application No. 0509629.2.
Examination Report dated Feb. 3, 2006 on British patent application No. 0509630.0.
Examination Report dated Feb. 14, 2006 on British patent application No. 0509631.8.
Examination Report dated Nov. 9, 2005 on British patent application No. 0517448.7.
Examination Report dated Oct. 27, 2005 on British patent application No. 0518025.2.
Examination Report dated Nov. 29, 2005 on British patent application No. 0518039.3.
Examination Report dated Oct. 28, 2005 on British patent application No. 0518252.2.
Examination Report dated Nov. 9, 2005 on British patent application No. 0518799.2.
Examination Report dated Dec. 16, 2005 on British patent application No. 0518893.3.
Examination Report dated Mar. 8, 2006 on British patent application No. 0519989.8.
Examination Report dated Dec. 22, 2005 on British patent application No. 0521024.0.
Examination Report dated Dec. 13, 2005 on British patent application No. 0522050.4.
Examination Report dated Mar. 20, 2006 on British patent application No. 0602877.3.
Examination Report dated Aug. 28, 2002 on British patent application No. 0004285.3.
Examination Report dated Mar. 28, 2003 on British patent application No. 0004285.3.
Search and Examination Report dated Mar. 7, 2006 on British patent application No. 0522155.1.
Search and Examination Report dated Feb. 3, 2006 on British patent application No. 0525768.8.
Search and Examination Report dated Feb. 3, 2006 on British patent application No. 0525770.4.
Search and Examination Report dated Feb. 2, 2006 on British patent application No. 0525772.0.
Search and Examination Report dated Feb. 2, 2006 on British patent application No. 0525774.6.
Search and Examination Report dated Jun. 3, 2003 on British patent application No. 0004282.0.
Search and Examination Report dated Jul. 1, 2003 on British patent application No. 0225505.7.
Search and Examination Report dated Jun. 2, 2003 on British patent application No. 0308290.6.
Search and Examination Report dated Jun. 2, 2003 on British patent application No. 0308293.0.
Search and Examination Report dated Jul. 14, 2003 on British patent application No. 0308293.0.
Search and Examination Report dated Jun. 2, 2003 on British patent application No. 0308294.8.
Search and Examination Report dated Jul. 14, 2003 on British patent application No. 0308294.8.
Search and Examination Report dated Jun. 2, 2003 on British patent application No. 0308295.5.
Search and Examination Report dated Jul. 14, 2003 on British patent application No. 0308295.5.
Search and Examination Report dated Jun. 2, 2003 on British patent application No. 0308296.3.
Search and Examination Report dated Jul. 14, 2003 on British patent application No. 0308296.3.
Search and Examination Report dated Jun. 2, 2003 on British patent application No. 0308297.1.
Search and Examination Report dated Jul. 1, 2003 on British patent application No. 0308297.1.
Search and Examination Report dated Jun. 2, 2003 on British patent application No. 0308299.7.
Search and Examination Report dated Jun. 2, 2003 on British patent application No. 0308302.9.
Search and Examination Report dated Jun. 2, 2003 on British patent application No. 0308303.7.
Search and Examination Report dated Jul. 14, 2003 on British patent application No. 0308303.7.
Search and Examination Report dated Jun. 24, 2003 on British patent application No. 0310090.6.
Search and Examination Report dated Jun. 24, 2003 on British patent application No. 0310099.7.
Search and Examination Report dated Jun. 24, 2003 on British patent application No. 0310101.1.
Search and Examination Report dated Jun. 24, 2003 on British patent application No. 0310104.5.
Search and Examination Report dated Jun. 24, 2003 on British patent application No. 0310118.5.
Search and Examination Report dated Jun. 12, 2003 on British patent application No. 0310757.0.
Search and Examination Report dated Jun. 12, 2003 on British patent application No. 0310759.6.
Search and Examination Report dated Jun. 12, 2003 on British patent application No. 0310770.3.
Search and Examination Report dated Jun. 12, 2003 on British patent application No. 0310772.9.
Search and Examination Report dated Jun. 21, 2003 on British patent application No. 0310785.1.
Search and Examination Report dated Jun. 12, 2003 on British patent application No. 0310795.0.
Search and Examination Report dated Jun. 12, 2003 on British patent application No. 0310797.6.
Search and Examination Report dated Jun. 12, 2003 on British patent application No. 0310799.2.
Search and Examination Report dated Jun. 12, 2003 on British patent application No. 0310801.6.
Search and Examination Report dated Jun. 12, 2003 on British patent application No. 0310833.9.
Search and Examination Report dated Jun. 12, 2003 on British patent application No. 0310836.2.
Examination Report dated Aug. 7, 2003 on British patent application No. 0310836.2.
Search and Examination Report dated Sep. 3, 2003 on British patent application No. 0313406.1.
Search and Examination Report dated Aug. 14, 2003 on British patent application No. 0316883.8.

Search and Examination Report dated Nov. 25, 2003 on British patent application No. 0316883.8.
Search and Examination Report dated Aug. 14, 2003 on British patent application No. 0316886.1.
Search and Examination Report dated Nov. 25, 2003 on British patent application No. 0316886.1.
Search and Examination Report dated Aug. 14, 2003 on British patent application No. 0316887.9.
Search and Examination Report dated Nov. 25, 2003 on British patent application No. 0316887.9.
Search and Examination Report dated Sep. 3, 2003 on British patent application No. 0318545.1.
Search and Examination Report dated Sep. 3, 2003 on British patent application No. 0318547.4.
Search and Examination Report dated Sep. 3, 2003 on British patent application No. 0318547.7.
Search and Examination Report dated Sep. 3, 2003 on British patent application No. 0318549.3.
Search and Examination Report dated Sep. 3, 2003 on British patent application No. 0318550.1.
Search and Examination Report dated Dec. 16, 2003 on British patent application No. 0320579.6.
Search and Examination Report dated Dec. 17, 2003 on British patent application No. 0320580.4.
Search and Examination Report dated Dec. 19, 2003 on British patent application No. 0323891.2.
Search and Examination Report dated Nov. 4, 2003 on British patent application No. 0324172.6.
Search and Examination Report dated Nov. 4, 2003 on British patent application No. 0324172.6.
Search and Examination Report dated Nov. 4, 2003 on British patent application No. 0324174.2.
Search and Examination Report dated Nov. 18, 2003 on British patent application No. 0325071.9.
Examination Report dated Feb. 2, 2004 on British patent application No. 0325071.9.
Search and Examination Report dated Dec. 3, 2003 on British patent application No. 0325072.7.
Examination Report dated Feb. 5, 2004 on British patent application No. 0325072.7.
Examination Report dated Apr. 13, 2004 on British patent application No. 0325072.7.
Search and Examination Report dated Jun. 9, 2004 on British patent application No. 0403891.5.
Search and Examination Report dated Jun. 9, 2004 on British patent application No. 0403893.1.
Search and Examination Report dated Jun. 9, 2004 on British patent application No. 0403894.9.
Search and Examination Report dated Jun. 9, 2004 on British patent application No. 0403894.9.
Search and Examination Report dated Jun. 9, 2004 on British patent application No. 0403897.2.
Search and Examination Report dated Jun. 10, 2004 on British patent application No. 0403920.2.
Search and Examination Report dated Jun. 10, 2004 on British patent application No. 0403921.0.
Search and Examination Report dated Jun. 10, 2004 on British patent application No. 0403926.9.
Search and Examination Report dated Apr. 21, 2004 on British patent application No. 0404826.0.
Search and Examination Report dated Apr. 21, 2004 on British patent application No. 0404828.6.
Search and Examination Report dated Apr. 21, 2004 on British patent application No. 0404830.2.
Examination Report dated Aug. 17, 2004 on British patent application No. 0404830.2.
Search and Examination Report dated Apr. 21, 2004 on British patent application No. 0404832.8.
Search and Examination Report dated Apr. 21, 2004 on British patent application No. 0404833.6.
Search and Examination Report dated Aug. 19, 2004 on British patent application No. 0404833.6.
Search and Examination Report dated May 17, 2004 on British patent application No. 0404837.7.
Examination Report dated Jul. 12, 2004 on British patent application No. 0404837.7.
Search and Examination Report dated May 14, 2004 on British patent application No. 0404839.3.
Search and Examination Report dated May 14, 2004 on British patent application No. 0404842.7.
Search and Examination Report dated May 14, 2004 on British patent application No. 0404845.0.
Search and Examination Report dated May 17, 2004 on British patent application No. 0404849.2.
Search and Examination Report dated Jun. 30, 2004 on British patent application No. 0411698.4.
Search and Examination Report dated Jul. 14, 2004 on British patent application No. 0411892.3.
Search and Examination Report dated Jul. 15, 2004 on British patent application No. 0411893.1.
Search and Examination Report dated Jul. 14, 2004 on British patent application No. 0411893.3.
Search and Examination Report dated Jun. 30, 2004 on British patent application No. 0411894.9.
Search and Examination Report dated Jul. 22, 2004 on British patent application No. 0412190.1.
Search and Examination Report dated Jul. 22, 2004 on British patent application No. 0412191.9.
Search and Examination Report dated Jul. 22, 2004 on British patent application No. 0412192.7.
Search and Examination Report dated Sep. 27, 2005 on British patent application No. 0412876.5.
Search and Examination Report dated Aug. 11, 2004 on British patent application No. 0416834.0.
Search and Examination Report dated Nov. 16, 2004 on British patent application No. 0416834.0.
Search and Examination Report dated Aug. 25, 2004 on British patent application No. 0417810.9.
Search and Examination Report dated Aug. 25, 2004 on British patent application No. 0417811.7.
Search and Examination Report dated Aug. 25, 2004 on British patent application No. 0418005.5.
Search and Examination Report dated Sep. 10, 2004 on British patent application No. 0418425.5.
Search and Examination Report dated Sep. 10, 2004 on British patent application No. 0418426.3.
Search and Examination Report dated Sep. 10, 2004 on British patent application No. 0418427.1.
Search and Examination Report dated Sep. 10, 2004 on British patent application No. 0418429.7.
Search and Examination Report dated Sep. 10, 2004 on British patent application No. 0418429.7.
Search and Examination Report dated Sep. 10, 2004 on British patent application No. 0418430.5.
Search and Examination Report dated Sep. 10, 2004 on British patent application No. 0418431.3.
Search and Examination Report dated Sep. 10, 2004 on British patent application No. 0418432.1.
Search and Examination Report dated Sep. 10, 2004 on British patent application No. 0418433.9.
Search and Examination Report dated Sep. 10, 2004 on British patent application No. 0418439.6.
Search and Examination Report dated Sep. 10, 2004 on British patent application No. 0418442.0.
Search and Examination Report dated Nov. 24, 2004 on British patent application No. 0422893.8.
Search and Examination Report dated Nov. 12, 2004 on British patent application No. 0423416.7.
Search and Examination Report dated Nov. 12, 2004 on British patent application No. 0423417.5.
Search and Examination Report dated Nov. 12, 2004 on British patent application No. 0423418.3.
Search and Examination Report dated Apr. 14, 2005 on British patent application No. 0425948.7.

Search and Examination Report dated Apr. 14, 2005 on British patent application No. 0425951.1.
Search and Examination Report dated Apr. 14, 2005 on British patent application No. 0425956.0.
Search and Examination Report dated Jan. 12, 2005 on British patent application No. 0426155.8.
Search and Examination Report dated Jan. 12, 2005 on British patent application No. 0426156.6.
Search and Examination Report dated Jan. 12, 2005 on British patent application No. 0426157.4.
Search and Examination Report dated Feb. 15, 2005 on British patent application No. 0500600.2.
Search and Examination Report dated Mar. 21, 2005 on British patent application No. 0503470.7.
Search and Examination Report dated Jul. 22, 2005 on British patent application No. 0505039.8.
Search and Examination Report dated May 20, 2005 on British patent application No. 0506697.2.
Search and Examination Report dated Jun. 26, 2006 on British patent application No. 0506699.8.
Search and Examination Report dated Sep. 20, 2005 on British patent application No. 0506700.4.
Search and Examination Report dated Jun. 26, 2006 on British patent application No. 0506702.0.
Search and Examination Report dated Jun. 19, 2006 on British patent application No. 0507980.1.
Search and Examination Report dated Sep. 27, 2005 on British patent application No. 0509618.5.
Search and Examination Report dated Sep. 27, 2005 on British patent application No. 0509620.1.
Search and Examination Report dated Sep. 27, 2005 on British patent application No. 0509626.8.
Search and Examination Report dated Sep. 27, 2005 on British patent application No. 0509627.6.
Search and Examination Report dated Sep. 27, 2005 on British patent application No. 0509529.2.
Search and Examination Report dated Sep. 27, 2005 on British patent application No. 0509630.0.
Search and Examination Report dated Sep. 27, 2005 on British patent application No. 0509631.8.
Search and Examination Report dated Jul. 26, 2005 on British patent application No. 0512396.3.
Search and Examination Report dated Jul. 27, 2005 on British patent application No. 0512398.9.
Search and Examination Report dated Nov. 7, 2005 on British patent application No. 0516429.8.
Search and Examination Report dated Nov. 8, 2005 on British patent application No. 0516430.6.
Search and Examination Report dated Nov. 8, 2005 on British patent application No. 0516431.4.
Search and Examination Report dated Apr. 3, 2006 on British patent application No. 0521931.6.
Search and Examination Report dated Aug. 8, 2006 on British patent application No. 0522052.0.
Search and Examination Report dated Jan. 5, 2006 on British patent application No. 0522892.9.
Search and Examination Report dated Jan. 12, 2006 on British patent application No. 0523075.0.
Search and Examination Report dated Dec. 14, 2005 on British patent application No. 0523076.8.
Search and Examination Report dated Dec. 13, 2005 on British patent application No. 0523078.4.
Search and Examination Report dated Jan. 12, 2006 on British patent application No. 0523132.9.
Search and Examination Report dated Dec. 19, 2005 on British patent application No. 0524692.1.
Search and Examination Report dated Jan. 26, 2006 on British patent application No. 0525663.1.
Search and Examination Report dated Sep. 25, 2006 on British patent application No. 0602877.3.
Search and Examination Report dated Jul. 19, 2006 on British patent application No. 0609173.0.
Search and Examination Report dated Nov. 2, 2006 on British patent application No. 0613405.0.
Search and Examination Report dated Nov. 2, 2006 on British patent application No. 0613406.8.
Search Report dated Mar. 9, 2005 on British patent application No. 0415835.8.
Search Report dated Mar. 10, 2005 on British patent application No. 0415835.8.
Search Report dated Dec. 2, 2004 on British patent application No. 0415835.8.
Search Report dated Mar. 7, 2006 on British patent application No. 0519989.8.
Search Report dated Jul. 13, 2000 on British patent application No. 0003251.6.
Search Report dated Jan. 15, 2001 on British patent application No. 0004282.0.
Search Report dated Jul. 31, 2001 on British patent application No. 0004282.0.
Search Report dated Jul. 14, 2000 on British patent application No. 0004285.3.
Search Report dated Jan. 17, 2001 on British patent application No. 0004285.3.
Search Report dated Aug. 28, 2002 on British patent application No. 0004285.3.
Search Report dated Jul. 24, 2000 on British patent application No. 0005399.1.
Search Report dated Feb. 15, 2001 on British patent application No. 0005399.1.
Search Report dated Oct. 23, 2000 on British patent application No. 0013661.4.
Search Report dated Apr. 18, 2001 on British patent application No. 0013661.4.
Search Report dated Feb. 20, 2003 on British patent application No. 0013661.4.
Search Report dated Nov. 26, 2002 on British patent application No. 0219757.2.
Search Report dated Jan. 21, 2003 on British patent application No. 0219757.2.
Search Report dated Dec. 6, 2002 on British patent application No. 0220872.6.
Search Report dated Mar. 13, 2003 on British patent application No. 0220872.6.
Examination Report dated Oct. 29, 2004 on British patent application No. 0220872.6.
Search Report dated Mar. 6, 2003 on British patent application No. 0225505.7.
Examination Report dated Oct. 27, 2004 on British patent application No. 0225505.7.
Search Report dated Apr. 24, 2006 on British patent application No. 0507980.1.
Search Report dated Mar. 27, 2000 on British patent application No. 9926449.1.
Search Report dated Mar. 30, 2000 on British patent application No. 9926449.1.
Search Report dated Jul. 4, 2001 on British patent application No. 9926449.1.
Search Report dated Sep. 5, 2001 on British patent application No. 9926449.1.
Search Report dated Feb. 28, 2000 on British patent application No. 9926450.9.
Search Report dated May 15, 2000 on British patent application No. 9926450.9.
Search Report dated Nov. 22, 2002 on British patent application No. 9926450.9.
Search Report dated Jun. 27, 2000 on British patent application No. 9930398.4.
Examination Report dated Feb. 15, 2007 on Norwegian patent application No. 1999 5991.
Examination Report dated Sep. 20, 2006 on Norwegian patent application No. 2000 2876.
Examination Report dated Jan. 24, 2007 on Norwegian patent application No. 2002 0070.

Search Report dated Aug. 20, 2002 on Norwegian patent application 1999 5593.
Search Report dated May 13, 2006 on Norwegian patent application No. 2002 1613.
Search Report dated May 29, 2006 on Norwegian patent application No. 2002 3885.
Combined Search Report and Written Opinion dated Apr. 17, 2006 on PCT/US05/28869.
International Preliminary Examination Report dated Sep. 4, 2003 on PCT/US01/28960.
International Preliminary Examination Report dated Aug. 6, 2004 on PCT/US02/24399.
International Preliminary Examination Report dated Jun. 1, 2005 on PCT/US02/25608.
International Preliminary Examination Report dated Jul. 7, 2004 on PCT/US02/25727.
International Preliminary Examination Report dated Apr. 14, 2004 on PCT/US02/36157.
International Preliminary Examination Report dated Jan. 4, 2005 on PCT/US02/36267.
International Preliminary Examination Report dated Feb. 18, 2005 on PCT/US02/39418.
International Preliminary Examination Report dated Nov. 8, 2005 on PCT/US02/39425.
International Preliminary Examination Report dated Dec. 9, 2004 on PCT/US03/04837.
International Preliminary Examination Report dated May 10, 2005 on PCT/US03/06544.
International Preliminary Examination Report dated Jul. 7, 2004 on PCT/US03/10144.
International Preliminary Examination Report dated Aug. 15, 2005 on PCT/US03/11765.
International Preliminary Examination Report dated Sep. 16, 2004 on PCT/US03/11765.
International Preliminary Examination Report dated Dec. 10, 2004 on PCT/US03/11765.
International Preliminary Examination Report dated Jul. 18, 2005 on PCT/US03/11765.
International Preliminary Examination Report dated Mar. 2, 2005 on PCT/US03/13787.
International Preliminary Examination Report dated Apr. 7, 2005 on PCT/US03/13787.
International Preliminary Examination Report dated May 12, 2005 on PCT/US03/14153.
International Preliminary Examination Report dated Nov. 14, 2005 on PCT/US03/15020.
International Preliminary Examination Report dated May 9, 2005 on PCT/US03/15020.
International Preliminary Examination Report dated Sep. 30, 2004 on PCT/US03/20870.
International Preliminary Examination Report dated May 25, 2005 on PCT/US03/25667.
International Preliminary Examination Report dated Aug. 30, 2005 on PCT/US03/25675.
International Preliminary Examination Report dated Aug. 17, 2004 on PCT/US03/25676.
International Preliminary Examination Report dated Aug. 17, 2004 on PCT/US03/25677.
International Preliminary Examination Report dated Dec. 20, 2004 on PCT/US03/25742.
International Preliminary Examination Report dated Dec. 8, 2004 on PCT/US03/29460.
International Preliminary Examination Report dated May 23, 2005 on PCT/US03/29858.
International Preliminary Examination Report dated Aug. 16, 2004 on PCT/US03/29859.
International Preliminary Examination Report dated May 23, 2005 on PCT/US03/38550.
International Preliminary Report on Patentability, Application PCT/US04/00631, Mar. 2, 2006.
International Preliminary Report on Patentability, Application PCT/US04/11973, Dec. 27, 2006.
International Preliminary Report on Patentability, Application PCT/US04/02122, May 13, 2005.
International Preliminary Report on Patentability, Application PCT/US04/04740, Jun. 27, 2006.
Internaitonal Preliminary Report on Patentability, Application PCT/US04/04740, Apr. 27, 2005.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Mar. 17, 2003.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/08170, Jan. 13, 2005.
International Preliminary Report on Patentability, Application PCT/US04/08170, Sep. 29, 2005.
International Preliminary Report on Patentability, Application PCT/US04/08171, Sep. 13, 2005.
International Preliminary Report on Patentability, Application PCT/US04/10317, Jun. 23, 2006.
International Preliminary Report on Patentability, Application PCT/US04/11177, Jun. 9, 2005.
International Preliminary Report on Patentability, Application PCT/US04/28423, Jul. 13, 2005.
International Preliminary Report on Patentability, Application PCT/US04/28423, Jun. 19, 2006.
International Preliminary Report on Patentability, Application PCT/US04/28438, Sep. 20, 2005.
International Preliminary Report on Patentability, Application PCT/US04/28438, Sep. 20, 2005.
International Preliminary Report on Patentability, Application PCT/US04/28887, Sep. 27, 2006.
International Preliminary Report on Patentability, Application PCT/US04/28889, Aug. 1, 2006.
International Preliminary Report on Patentability, Application PCT/US05/28642, Jul. 14, 2006.
International Preliminary Report on Patentability, Application PCT/US05/28819, Feb. 12, 2007.
International Search Report, Application PCT/IL00/00245, Sep. 18, 2000.
International Search Report, Application PCT/US00/18635, Nov. 24, 2000.
International Search Report, Application PCT/US00/27645, Dec. 19, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, May 30, 2002.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.

International Search Report, Application PCT/US02/20256, Jan. 3, 2003.
International Search Report, Application PCT/US02/20477, Oct. 31, 2003.
International Search Report, Application PCT/US02/20477, Apr. 6, 2004.
International Search Report, Application PCT/US02/24399, Feb. 20, 2004.
International Search Report, Application PCT/US02/24399, Feb. 27, 2004.
International Search Report, Application PCT/US02/24399, Aug. 6, 2004.
International Search Report, Application PCT/US02/25608, May 24, 2004.
International Search Report, Application PCT/US02/25727, Feb. 19, 2004.
Examination Report, Application PCT/US02/25727, Jul. 7, 2004.
International Search Report, Application PCT/US02/29856, Dec. 16, 2002.
International Search Report, Application PCT/US02/36157, Sep. 29, 2003.
International Search Report, Application PCT/US02/36267, May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144, Oct. 31, 2003.
International Search Report, Application PCT/US03/11765, Nov. 13, 2003.
International Search Report, Application PCT/US03/13787, May 28, 2004.
International Search Report, Application PCT/US03/14153, May 28, 2004.
International Search Report, Application PCT/US03/15020, Nov. 14, 2005.
International Search Report, Application PCT/US03/15020, Jul. 30, 2003.
International Search Report, Application PCT/US03/18530, Jun. 24, 2004.
International Search Report, Application PCT/US03/19993, May 24, 2004.
International Search Report, Application PCT/US03/20694, Nov. 12, 2003.
International Search Report, Application PCT/US03/20870, May 24, 2004.
International Search Report, Application PCT/US03/20870, Sep. 30, 2004.
International Search Report, Application PCT/US03/24779, Mar. 3, 2004.
International Search Report, Application PCT/US03/25667, Feb. 26, 2004.
International Search Report, Application PCT/US03/25675, May 25, 2004.
Internaitonal Search Report, Application PCT/US03/25676, May 17, 2004.
International Search Report, Application PCT/US03/25677, May 21, 2004.
International Search Report, Application PCT/US03/25707, Jun. 23, 2004.
International Search Report, Application PCT/US03/25715, Apr. 9, 2004.
International Search Report, Application PCT/US03/25716, Jan. 16, 2005.
International Search Report, Application PCT/US03/25742, May 27, 2004.
International Search Report, Application PCT/US03/29460, May 25, 2004.
International Search Report, Application PCT/US03/29858, Jun. 30, 2004.
International Search Report, Application PCT/US03/29859, May 21, 2004.
International Search Report, Application PCT/US03/38550, Jun. 15, 2004.
International Search Report, Application PCT/US04/00631, Mar. 28, 2005.
International Search Report, Application PCT/US04/10317, May 25, 2006.
International Search Report, Application PCT/US04/28831, Dec. 19, 2005.
International Search Report, Application PCT/US04/28889, Nov. 14, 2005.
International Search Report, Application PCT/US05/28669, Apr. 17, 2006.
International Search Report and Written Opinion, Application PCT/US04/26345, Oct. 5, 2006.
International Search Report and Written Opinion, Application PCT/US05/28446, Oct. 27, 2006.
International Search Report and Written Opinion, Application PCT/US06/02449, Oct. 24, 2006.
International Search Report and Written Opinion, Application PCT/US04/10762, Sep. 1, 2005.
International Search Report and Written Opinion, Application PCT/US04/00631, Mar. 28, 2005.
International Search Report and Written Opinion, Application PCT/US04/02122, Feb. 24, 2005.
International Search Report and Written Opinion, Application PCT/US04/04740, Jan. 19, 2005.
International Search Report and Written Opinion, Application PCT/US04/06246, Jan. 26, 2005.
International Search Report and Written Opinion, Application PCT/US04/07711, Nov. 28, 2006.
International Search Report and Written Opinion, Application PCT/US04/08030, Jan. 6, 2005.
International Search Report and Written Opinion, Application PCT/US04/08073, Mar. 4, 2005.
International Search Report and Written Opinion, Application PCT/US04/08170, Jan. 13, 2005.
International Search Report and Written Opinion, Application PCT/US04/08171, Feb. 16, 2005.
International Search Report and Written Opinion, Application PCT/US04/11177, Feb. 14, 2005.
International Search Report and Written Opinion, Application PCT/US04/11973, Sep. 27, 2005.
International Search Report and Written Opinion, Application PCT/US04/28423, Jul. 13, 2005.
International Search Report an Written Opinion, Application PCT/US04/28438, Mar. 14, 2005.
International Search Report and Written Opinion, Application PCT/US05/28473, Sep. 1, 2006.
International Search Report and Written Opinion, Application PCT/US05/28642, Jul. 14, 2006.
International Search Report and Written Opinion, Application PCT/US05/28819, Aug. 3, 2006.
International Search Report and Written Opinion, Application PCT/US06/04809, Aug. 29, 2006.
International Search Report and Written Opinion, Application PCT/US06/09886, Dec. 4, 2006.
Written Opinion, Application PCT/US01/19014, Dec. 10, 2002.
Written Opinion, Application PCT/US01/23815, Jul. 25, 2002.
Written Opinion, Application PCT/US01/28960, Dec. 2, 2002.
Written Opinion, Application PCT/US01/30256, Nov. 11, 2002.
Written Opinion, Application PCT/US01/30256,Nov. 27, 2002.
Written Opinion, Application PCT/US02/00093, Apr. 21, 2003.
Written Opinion, Application PCT/US02/00677, Apr. 17, 2003.
Written Opinion, Application PCT/US02/04353, Apr. 11, 2003.
Written Opinion, Application PCT/US02/20256, May 9, 2003.
Written Opinion, Application PCT/US02/24399, Apr. 28, 2004.
Written Opinion, Application PCT/US02/25608, Sep. 13, 2004.

Written Opinion, Application PCT/US02/25608, Feb. 2, 2005.
Written Opinion, Application PCT/US02/25727, May 17, 2004.
Written Opinion, Application PCT/US02/39418, Jun. 9, 2004.
Written Opinion, Application PCT/US02/39425, Nov. 22, 2004.
Written Opinion, Application PCT/US02/39425, Apr. 11, 2005.
Written Opinion, Application PCT/US03/06544, Feb. 18, 2005.
Written Opinion, Application PCT/US03/11765, May 11, 2004.
Written Opinion, Application PCT/US03/13787, Nov. 9, 2004.
Written Opinion, Application PCT/US03/14153, Sep. 9, 2004.
Written Opinion, Application PCT/US03/14153, Nov. 9, 2004.
Written Opinion, Application PCT/US03/18530, Sep. 13, 2004.
Written Opinion, Application PCT/US03/19993, Oct. 15, 2004.
Written Opinion, Application PCT/US03/25675, May 9, 2005.
Written Opinion, Application PCT/US03/29858, Jan. 21, 2005.
Written Opinion, Application PCT/US03/38550, Dec. 10, 2004.
Written Opinion, Application PCT/US04/08171, May 5, 2005.
Written Opinion, Application PCT/US04/29025, Jan. 4, 2007.

* cited by examiner

APPARATUS AND METHOD FOR RADIALLY EXPANDING AND PLASTICALLY DEFORMING A TUBULAR MEMBER

CROSS REFERENCE TO RELATED APPLICATIONS

The present application claims the benefit of the filing date of U.S. provisional patent application Ser. No. 60/450,504, filed on Feb. 26, 2003, the disclosure of which is incorporated herein by reference.

This application is related to the following applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. Pat. No. 6,823,937, which was filed as U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903, which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. Pat. No. 6,712,154, which was filed as U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. Pat. No. 7,048,067, which was filed as U.S. patent application Ser. No. 10/111,982, filed on Apr. 30, 2002, which claims priority from provisional patent application Ser. No. 60/162,671, filed on Nov. 11, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. Pat. No. 6,695,012, which was filed as U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000 (now abandoned), which claims priority from provisional patent application Ser. No. 60/159,033, filed on Oct. 12, 1999, (20) U.S. Pat. No. 7,270,188, which was filed as U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001. (24) U.S. Pat. No. 7,258,168, which was filed as U.S. patent application Ser. No. 10/311,412, filed on Dec. 12, 2002, which claims priority from provisional patent application Ser. No. 60/221,443, filed on Jul. 28, 2000, (25) U.S. Pat. No. 7,100,684, which was filed as U.S. patent application Ser. No. 10/322,947, filed on Dec. 18, 2002, which claims priority from provisional patent application Ser. No. 60/221,645, filed on Jul. 28, 2000, (26) U.S. Pat. No. 6,976,541, which was filed as U.S. patent application Ser. No. 10/351,160, filed on Jan. 22, 2003, which claims priority from provisional patent application Ser. No. 60/233,638, filed on Sep. 18, 2000, (27) U.S. Pat. No. 7,172,024, which was filed as U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. Pat. No. 7,185,710, which was filed as U.S. patent application Ser. No. 10/465,835, filed on Jun. 13, 2003, which claims priority from provisional patent application Ser. No. 60/262,434, filed on Jan. 17, 2001, (30) U.S. Pat. No. 7,100,685, which was filed as U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 17, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. Pat. No. 6,631,760, which was filed as U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. Pat. No. 6,892,819, which was filed as U.S. patent application Ser. No. 09/962,469, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (40) U.S. Pat. No. 7,240,728, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (41) U.S. Pat. No. 6,739,392, which was filed as U.S. patent application Ser. No. 09/962,471, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (42) U.S. Pat. No. 6,725,919, which was filed as U.S. patent application Ser. No. 09/962,467, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. Pat. No. 6,640,903, which was filed as U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. Pat. No. 6,634,431, which was filed as U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. Pat. No. 6,745,845, which was filed as U.S. utility patent application Ser. No. 10/516,467, filed on Dec. 10, 2001, which is a continuation application of U.S. Pat. No. 6,634,431, which was filed as U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. Pat. No. 6,705,395, which was filed as U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. Pat. No. 6,631,759, which was filed as U.S. patent application Ser. No. 10/074,244, filed on 2/12102, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. Pat. No. 6,631,769, which was filed as U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. Pat. No. 7,063,142, which was filed as U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. Pat. No. 6,684,947, which was filed as U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. Pat. No. 6,966,370, which was filed as U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. Pat. No. 7,044,221, which was filed as U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. Pat. No. 7,011,161, which was filed as U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. Pat. No. 7,040,396, which was filed as U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. Pat. No. 7,048,062, which was filed as U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. Pat. No. 6,857,473, which was filed as U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. Pat. No. 7,086,475, which was filed as U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 17, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec.

10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718 (now abandoned), filed on Dec. 30, 2002, which is a divisional U.S. patent application Ser. No. 09/679,906, filed on Oct. 5, 2000 (now abandoned), which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002. (70) U.S. Pat. No. 7,077,213, which was filed as U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. Pat. No. 7,036,582, which was filed as U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. Pat. No. 7,044,218, which was filed as U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. Pat. No. 7,159,665, which was filed as U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. Pat. No. 7,108,061, which was filed as U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application PCT/US03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. Pat. No. 7,108,072, which was filed as U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. Pat. No. 7,174,964, which was filed as U.S. patent application Ser. No. 10/624,842, filed on Jul. 22, 2003, which is a divisional of U.S. Pat. No. 6,823,937, which was filed as U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. Pat. No. 6,640,903, which was filed as U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. Pat. No. 6,968,618, which was filed as U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120)

U.S. Pat. No. 7,121,352, which was filed as U.S. patent application Ser. No. 10/619,285, filed on Jul. 14, 2003, which is a continuation-in-part of U.S. Pat. No. 6,634,431, which was filed as U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, and (121) U.S. Pat. No. 7,055,608, which was filed as U.S. utility patent application Ser. No. 10/418,688, which was filed on Apr. 18, 2003, as a division of U.S. Pat. No. 6,640,903, which was filed as U.S. utility patent application Ser. No. 09/523,468, filed on Mar. 10, 2000, which claims priority from provisional application 60/124,042, filed on Mar. 11, 1999, the disclosures of which are incorporated herein by reference.

BACKGROUND OF THE INVENTION

This invention relates generally to oil and gas exploration, and in particular to forming and repairing wellbore casings to facilitate oil and gas exploration.

SUMMARY OF THE INVENTION

According to one aspect of the present invention, an apparatus for radially expanding and plastically deforming an expandable tubular member is provided that includes a tubular support member defining an internal passage and one or more radial passages and comprising internal splines; a tubular expansion cone coupled to the tubular support member comprising an external expansion surface; one or more rupture discs coupled to and positioned within corresponding radial passages of the tubular support member; a tubular stinger defining an internal passage coupled to and positioned within the tubular support member; an expandable tubular member coupled to the expansion surface of the tubular expansion cone comprising a first portion and a second portion, wherein the inside diameter of the first portion is less than the inside diameter of the second portion; a shoe defining one or more internal passages coupled to the second portion of the expandable tubular member; a tubular member coupled to the shoe defining an internal passage comprising a plug seat, one or more upper radial flow ports positioned above the plug seat, and one or more lower radial flow ports positioned below the plug seat, and comprising an external flange for sealingly engaging the interior surface of the expandable tubular member and external splines for engaging the internal splines of the tubular support member, wherein an end of the tubular member receives an end of the tubular stinger and is also received within and sealingly engages and end of the tubular support member; and a tubular sliding sleeve valve received within and sealingly engaging the internal passage of the tubular member defining an internal passage and one or more radial passages and comprising a collet for releasably engaging an end of the tubular stinger.

According to another aspect of the present invention, a system for radially expanding and plastically deforming a tubular member within a preexisting structure is provided that includes means for radially expanding and plastically deforming the tubular member within the preexisting structure; and means for injecting a hardenable fluidic sealing into an annulus between the tubular member and the preexisting structure.

According to another aspect of the present invention, a method of radially expanding and plastically deforming a tubular member within a preexisting structure is provided that includes radially expanding and plastically deforming the tubular member within the preexisting structure; and injecting a hardenable fluidic sealing into an annulus between the tubular member and the preexisting structure. In an exemplary embodiment, injecting a hardenable fluidic sealing into an annulus between the tubular member and the preexisting structure comprises: injecting a hardenable fluidic sealing into an annulus between the tubular member and the preexisting structure before radially expanding and plastically deforming the tubular member within the preexisting structure.

According to another aspect of the present invention, an apparatus for radially expanding and plastically deforming an expandable tubular member is provided that includes a support member; an expansion device coupled to the support member comprising an external expansion surface; one or more pressure sensors coupled to the support member; an expandable tubular member coupled to the expansion surface of the expansion device comprising a first portion and a second portion, wherein the inside diameter of the first portion is less than the inside diameter of the second portion; and a movable valve coupled to the support member for controlling the flow of fluidic materials through the interior of the expandable tubular member.

According to another aspect of the present invention, an apparatus for radially expanding and plastically deforming an expandable tubular member is provided that includes a support member defining one or more radial passages; an expansion device coupled to the support member comprising an external expansion surface; one or more frangible valve elements coupled to and positioned within corresponding radial passages of the support member; an expandable tubular member coupled to the expansion surface of the expansion device comprising a first portion and a second portion, wherein the inside diameter of the first portion is less than the inside diameter of the second portion; a tubular member defining an internal passage having a plug seat and one or more radial passages movably coupled to the support member and coupled to the second portion of the expandable tubular member and sealing engaging an interior surface of another portion of the second portion of the expandable tubular member; and a movable valve defining one or more radial passages releasably coupled to the support member and positioned within the internal passage of the tubular member.

According to another aspect of the present invention, a method of radially expanding and plastically deforming a tubular member within a preexisting structure is provided that includes injecting fluidic material into the tubular member; sensing the operating pressure of the injected fluidic material; and if the sensed operating pressure of the injected fluidic material exceeds a predetermined value, then radially expanding and plastically deforming the tubular member within the preexisting structure.

According to another aspect of the present invention, a method of radially expanding and plastically deforming a tubular member within a preexisting structure is provided that includes sensing the operating pressure within the tubular member; and if the sensed operating pressure within the tubular member exceeds a predetermined valve, then radially expanding and plastically deforming the tubular member within the preexisting structure.

According to another aspect of the present invention, a method of radially expanding and plastically deforming a tubular member within a preexisting structure is provided that includes controlling the flow of fluidic materials within the tubular member using one or more movable valve elements; sensing an operating pressure of the fluidic materials within the tubular member; and if the sensed operating pressure within the tubular member exceeds a predetermined valve, then radially expanding and plastically deforming the tubular member within the preexisting structure using an expansion device.

According to another aspect of the present invention, a method of radially expanding and plastically deforming a tubular member within a preexisting structure is provided that includes supporting the tubular member within the preexisting structure using a support member; controlling the flow of fluidic materials within the tubular member using one or more movable valve elements that are coupled to an end of the tubular member; sensing an operating pressure of the fluidic materials within the tubular member; and if the sensed operating pressure within the tubular member exceeds a predetermined valve, then radially expanding and plastically deforming the tubular member within the preexisting structure using an expansion device; wherein during the radial expansion and plastic deformation of the tubular member using the expansion device, the expansion device is displaced away from the valve elements; and wherein one or more of the valve elements are releasably coupled to the support member.

DETAILED DESCRIPTION OF THE ILLUSTRATIVE EMBODIMENTS

Figure 1:
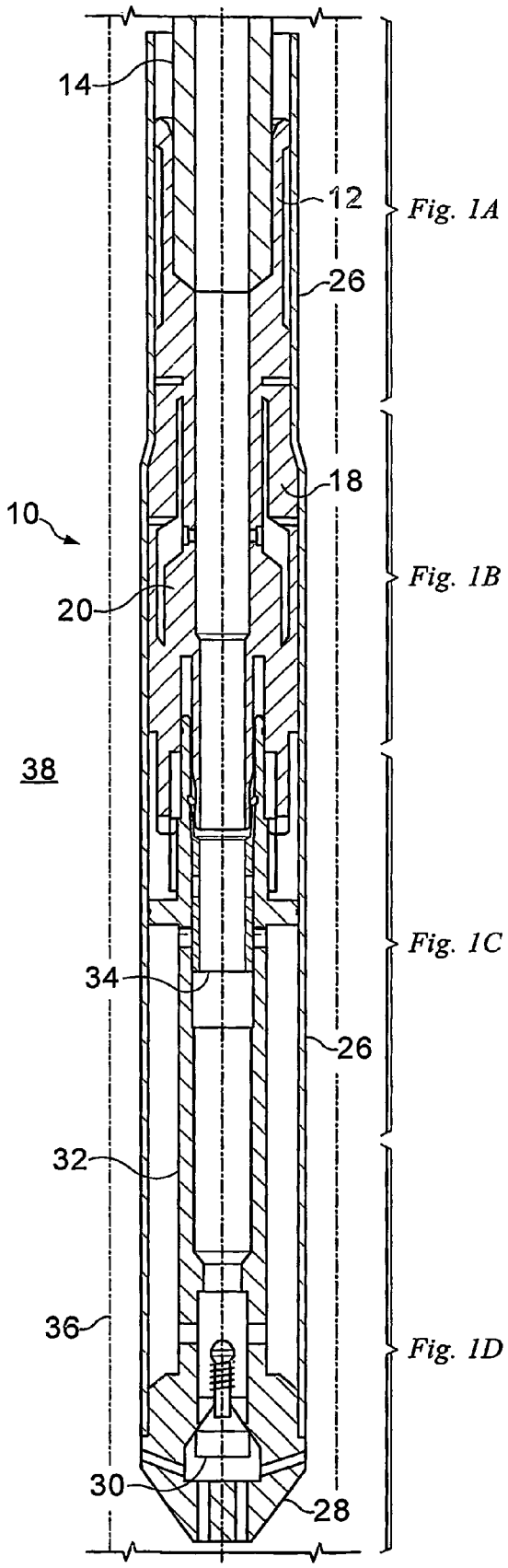
FIGS. 1, 1*a*, 1*b*, 1*c*, and 1*d* are fragmentary cross-sectional illustrations of an embodiment of an apparatus for radially expanding and plastically deforming a tubular member during the placement of the apparatus within a wellbore.
Figure 1A:
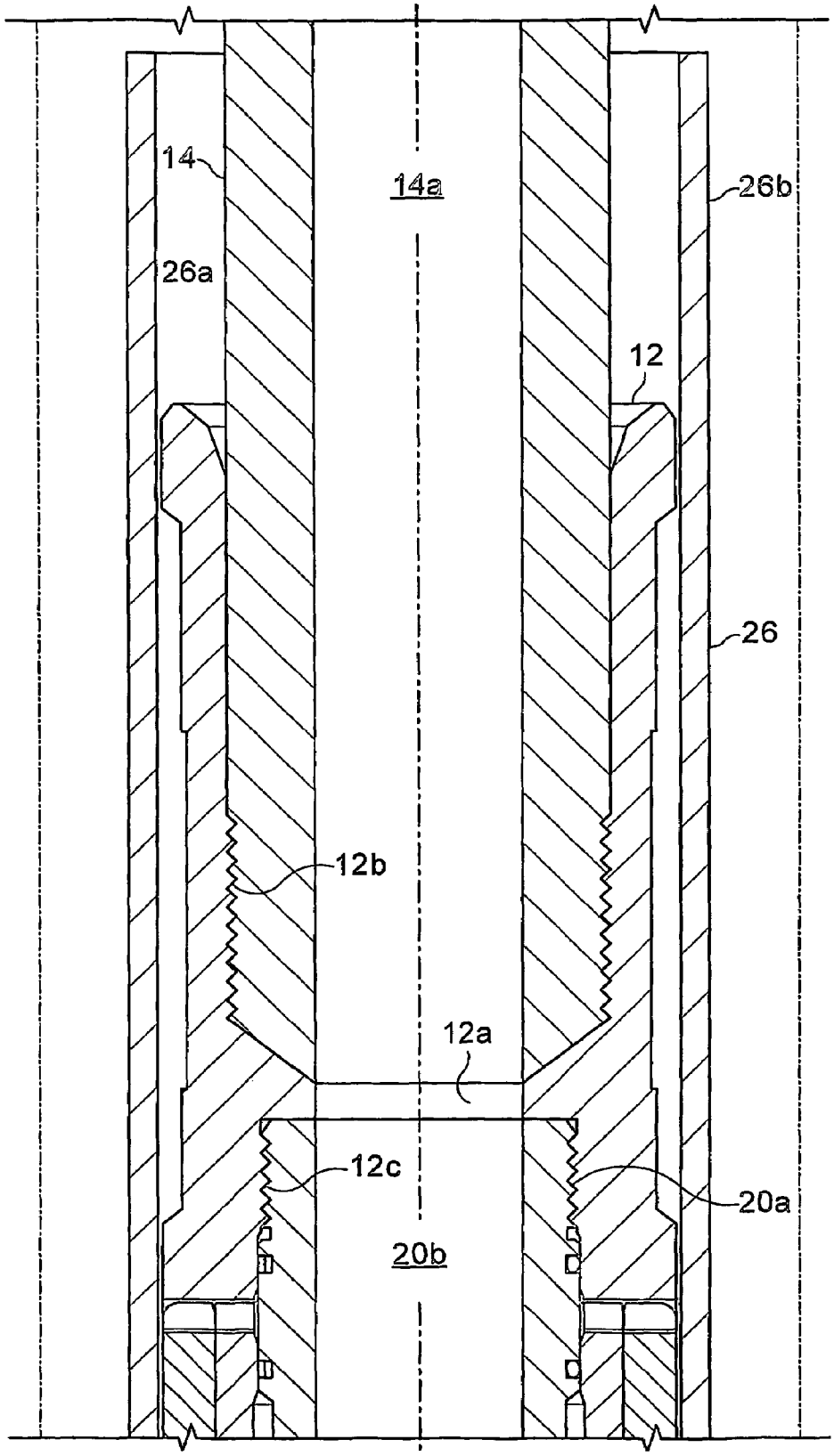
Figure 1B:
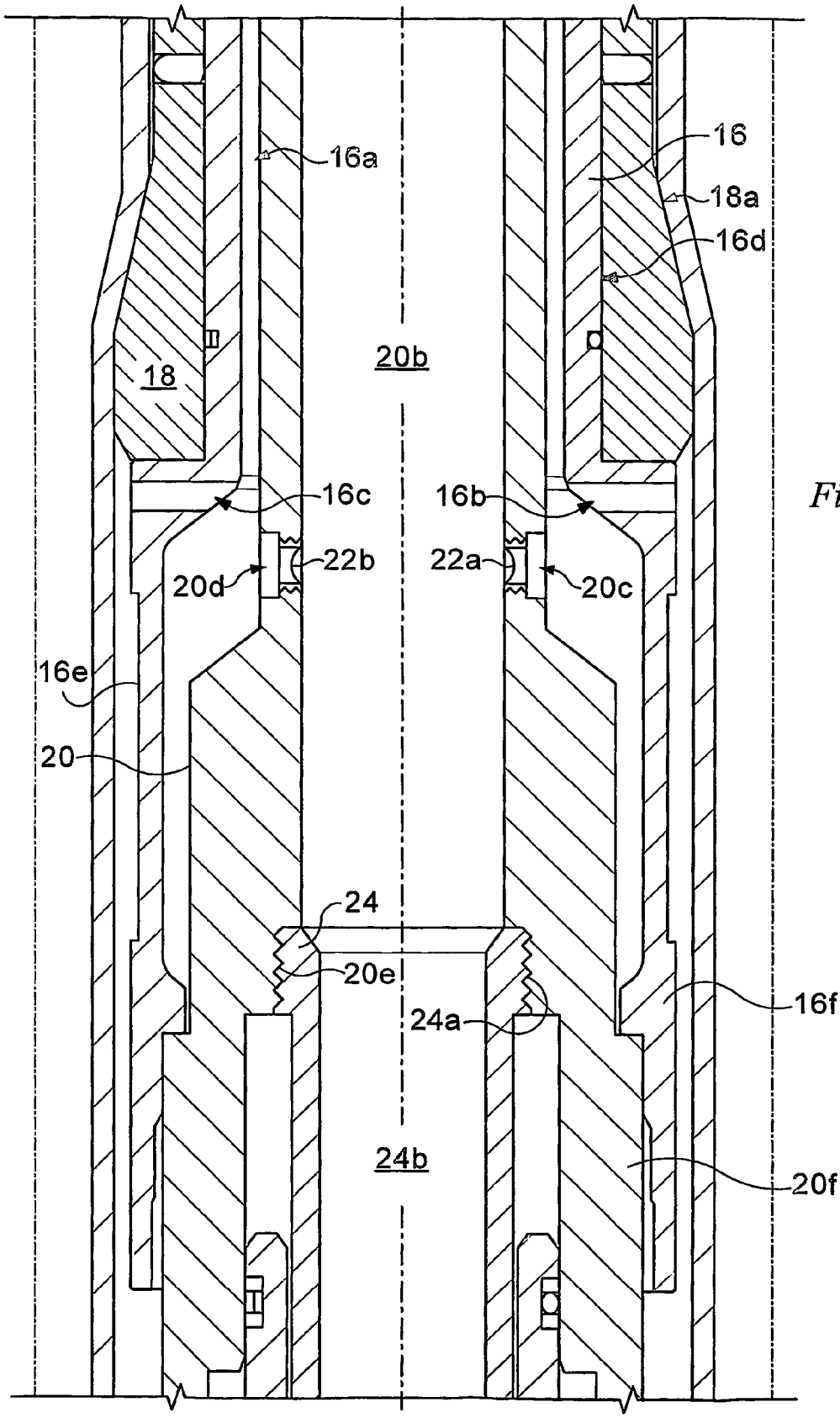
Figure 1C:
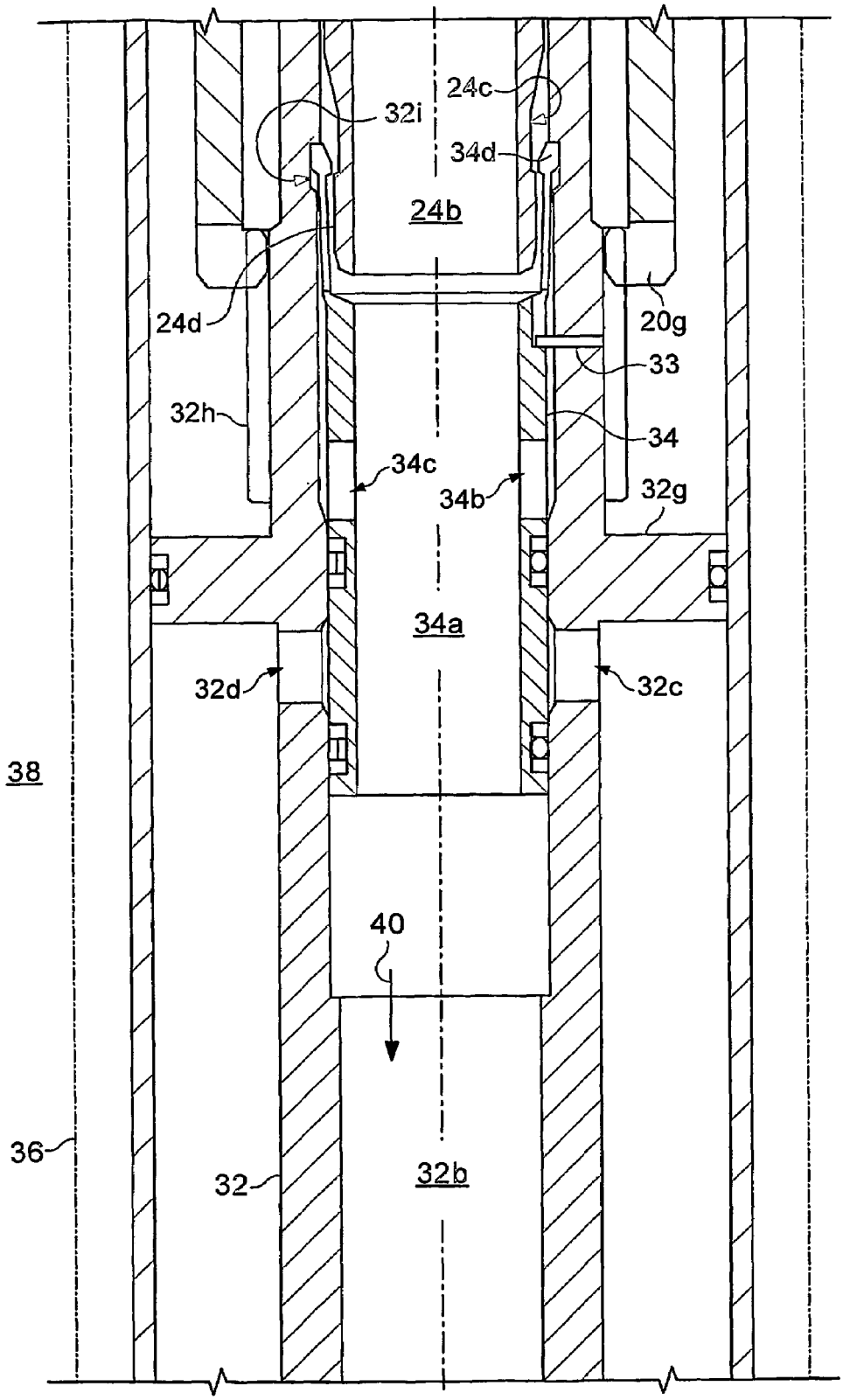
Figure 1D:
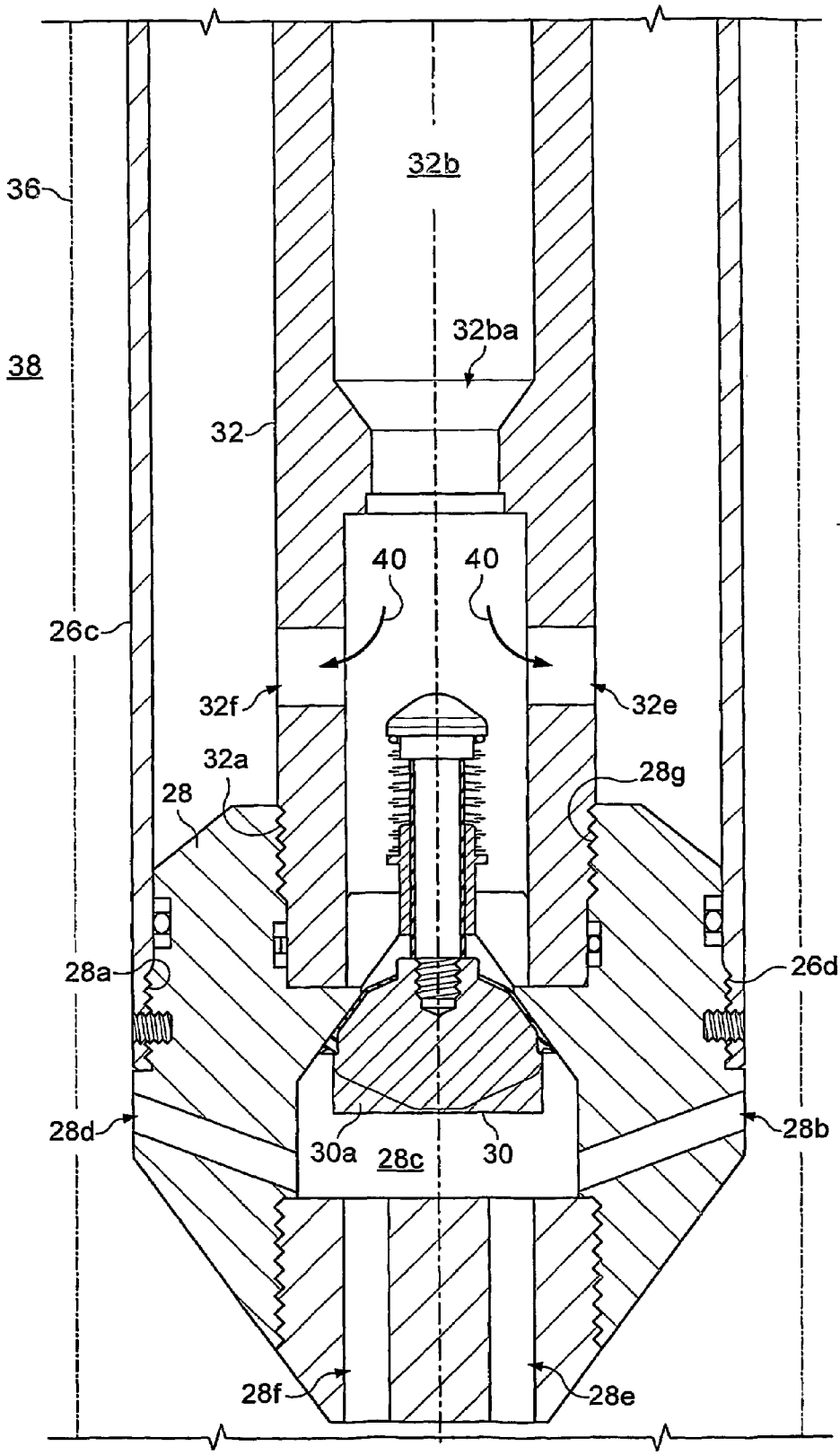
Figure 2:
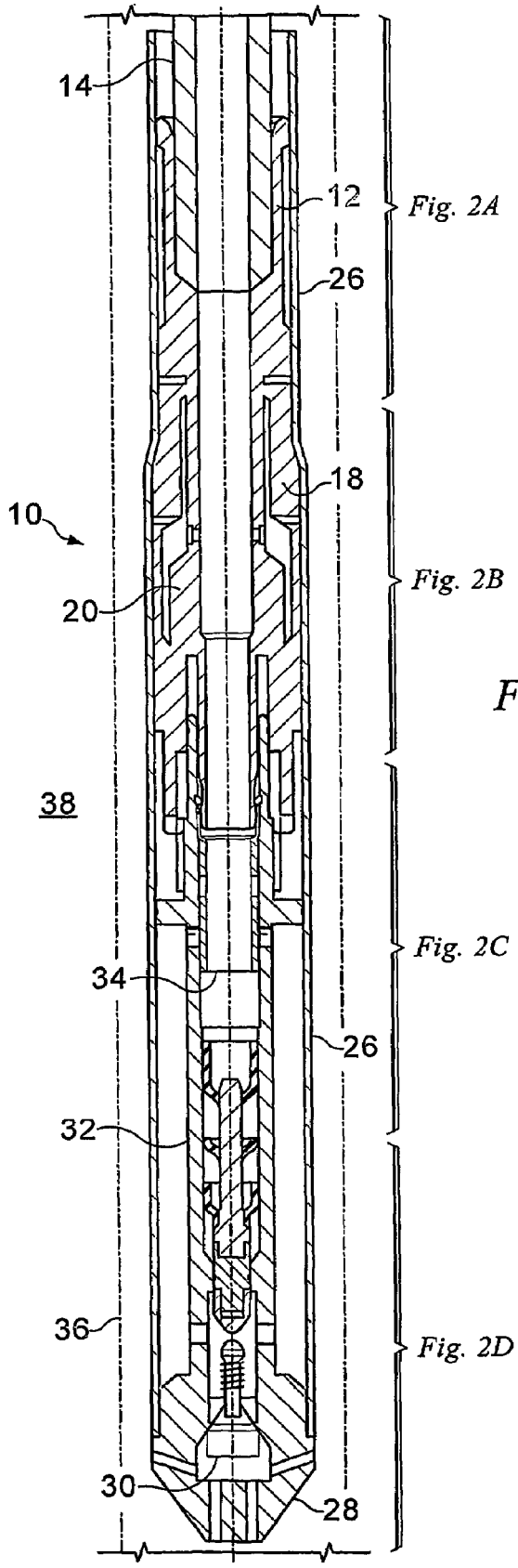
FIGS. 2, 2*a*, 2*b*, 2*c*, and 2*d* are fragmentary cross-sectional illustrations of the apparatus of FIGS. 1, 1*a*, 1*b*, 1*c*, and 1*d* during the radial expansion and plastic deformation of the tubular member.
Figure 2A:
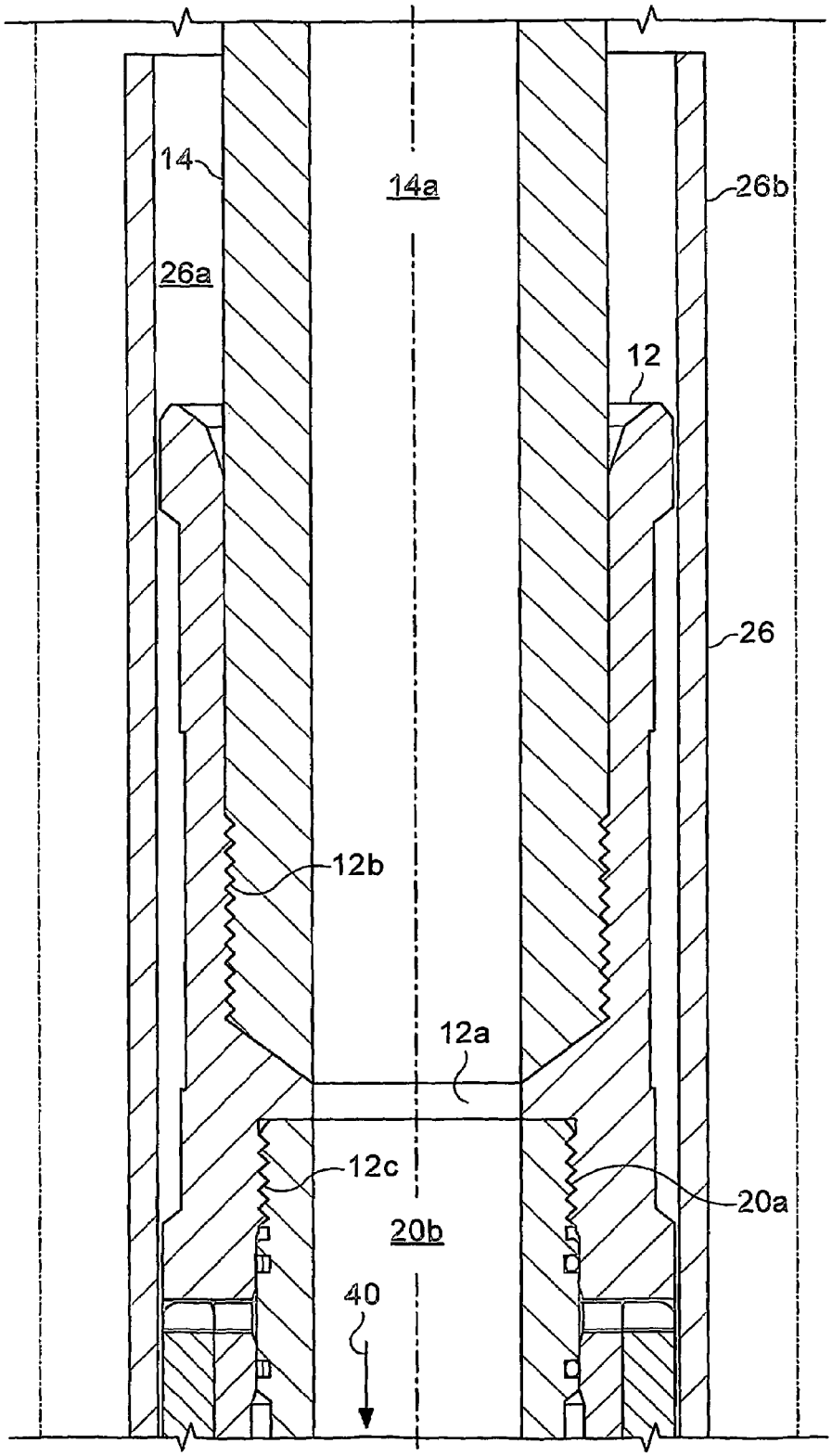
Figure 2B:
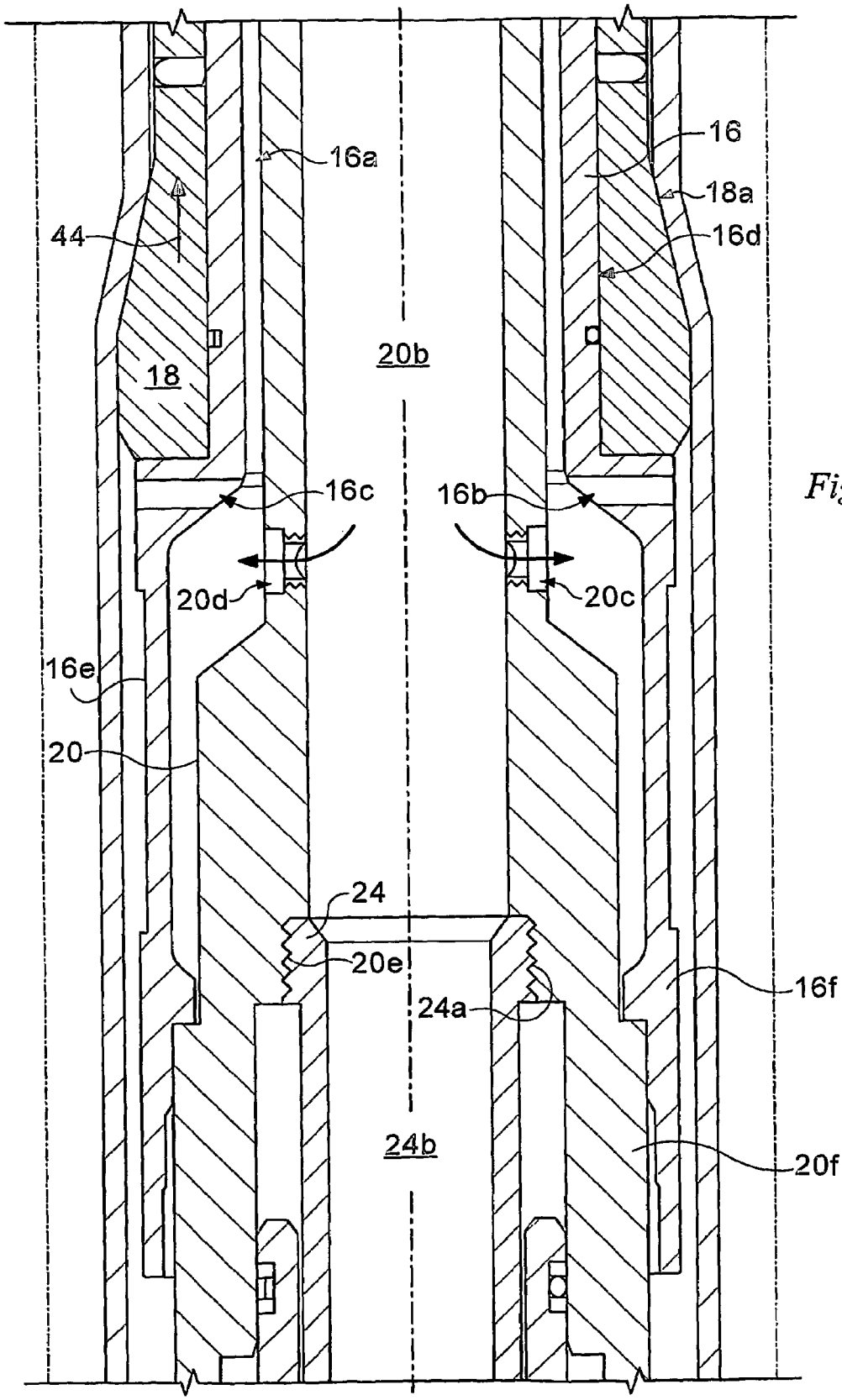
Figure 2C:
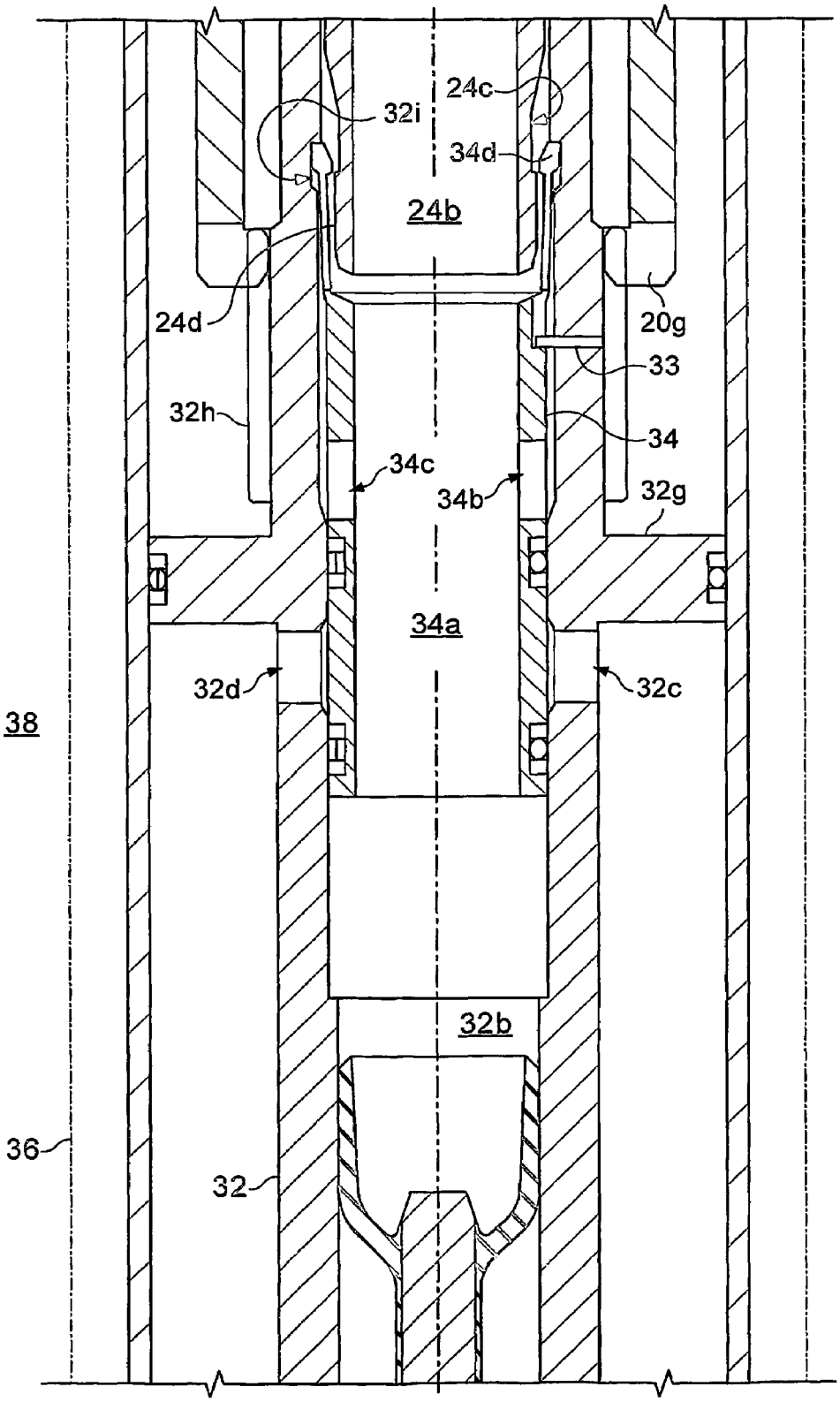
Figure 2D:
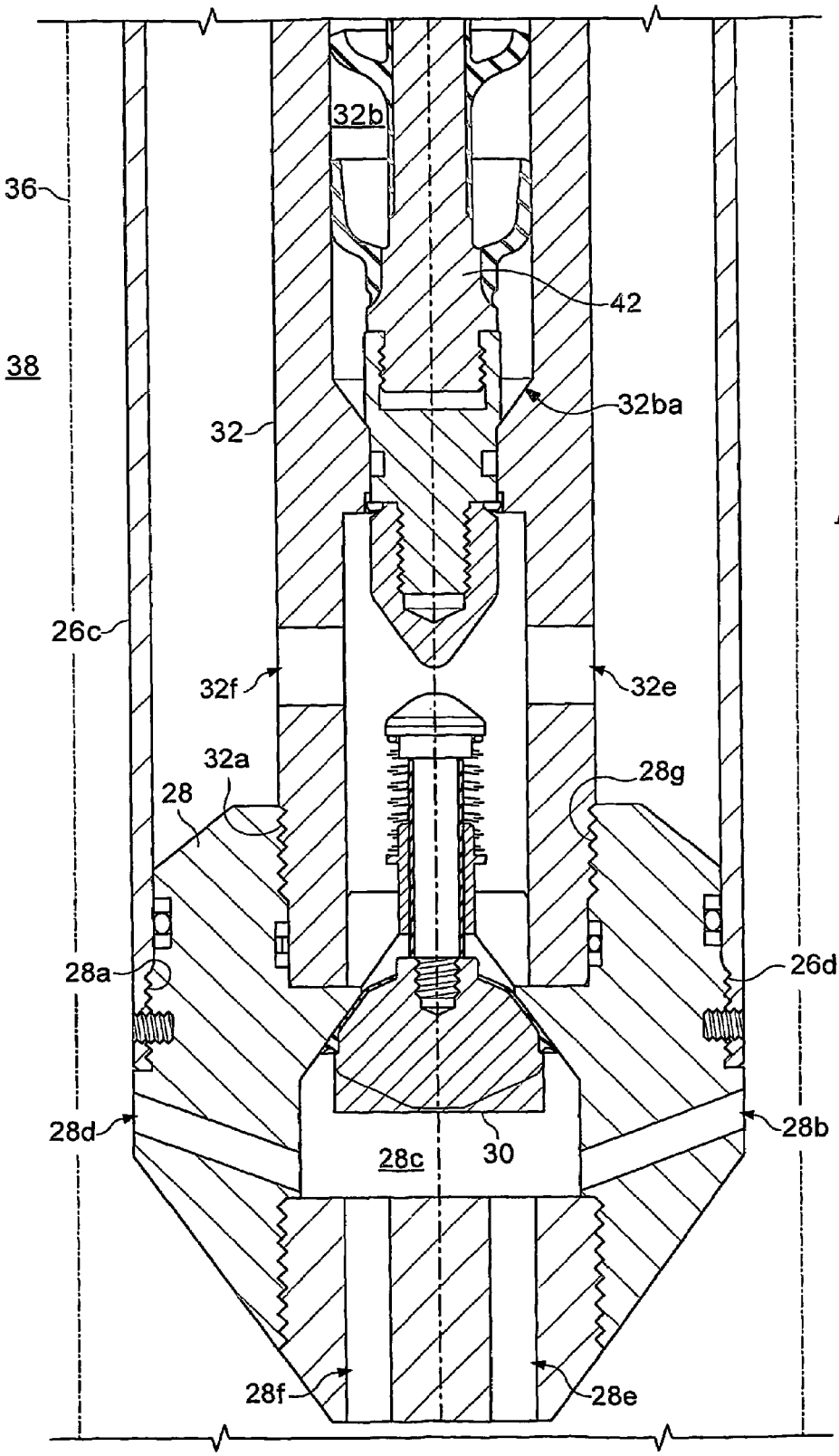
Figure 3:
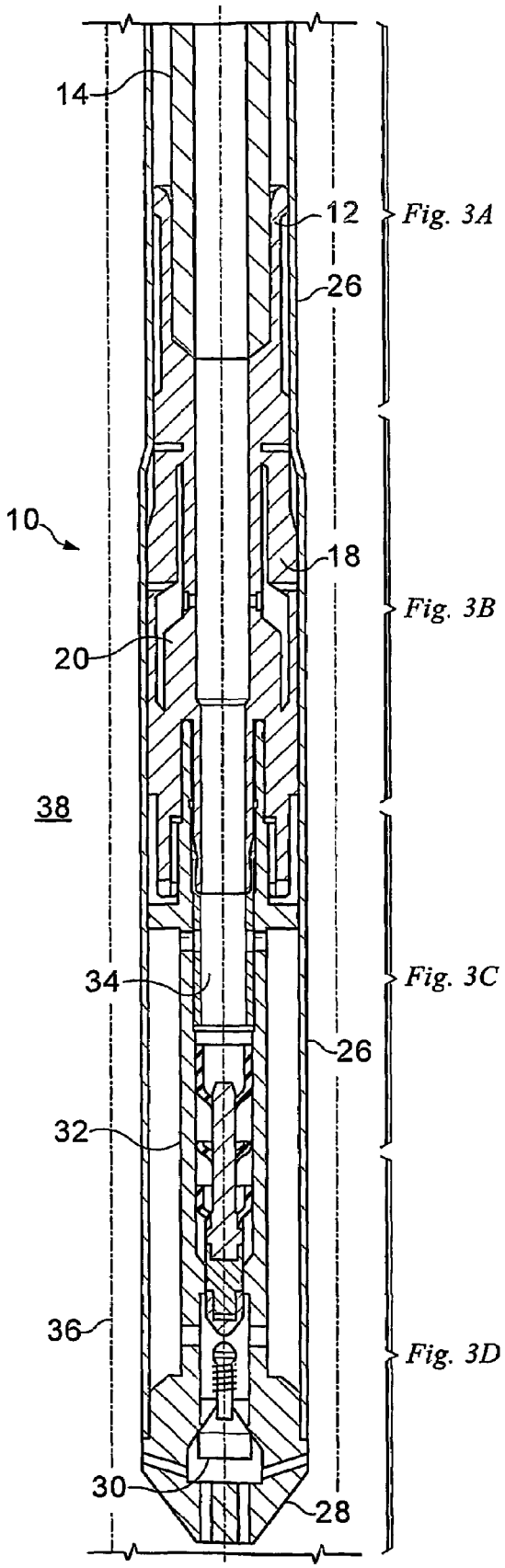
FIGS. 3, 3*a*, 3*b*, 3*c*, and 3*d* are fragmentary cross-sectional illustrations of the apparatus of FIGS. 1, 1*a*, 1*b*, 1*c*, and 1*d* during the injection of a hardenable fluidic sealing material into an annulus between the exterior of the apparatus and the wellbore.
Figure 3A:
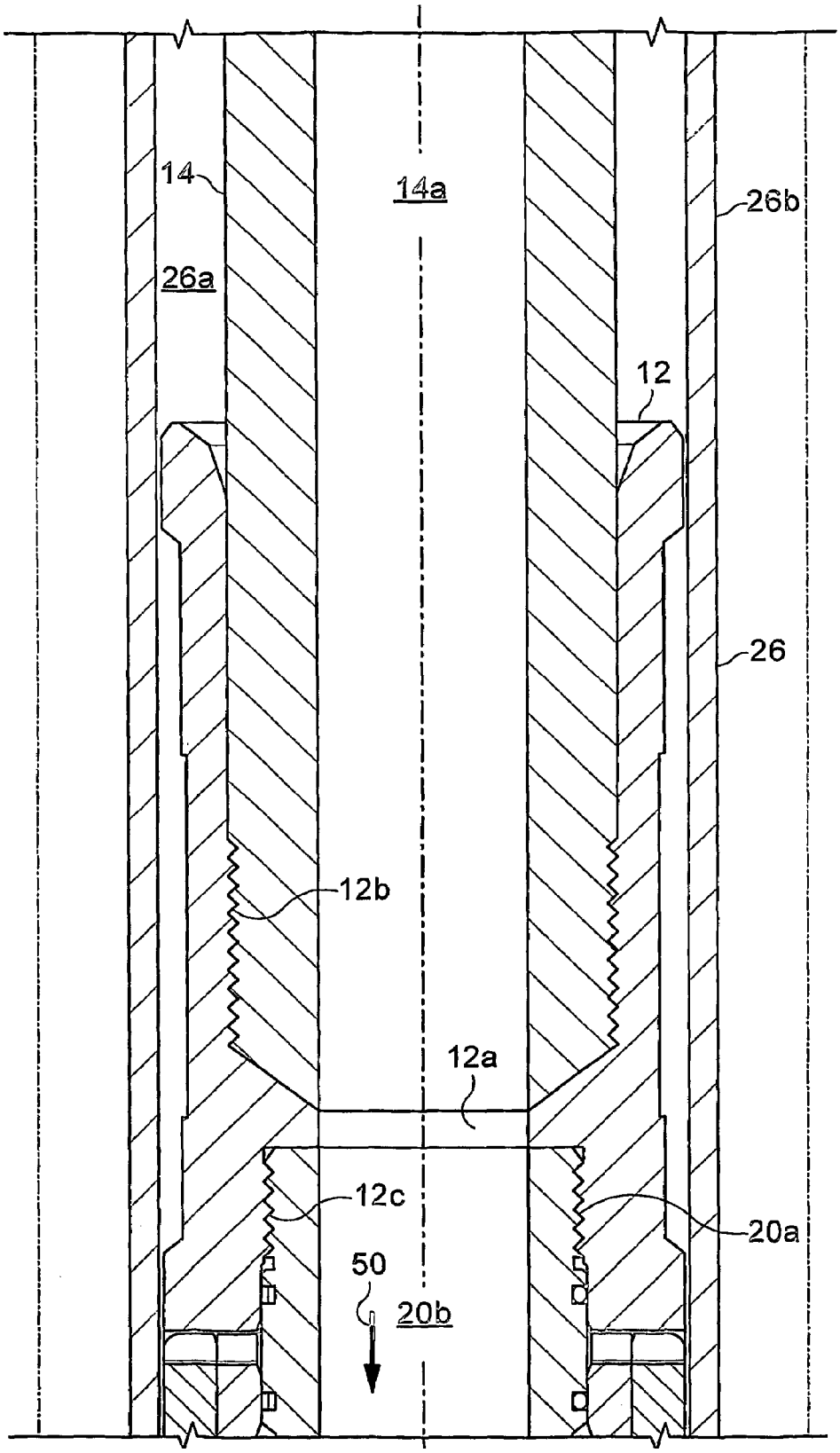
Figure 3B:
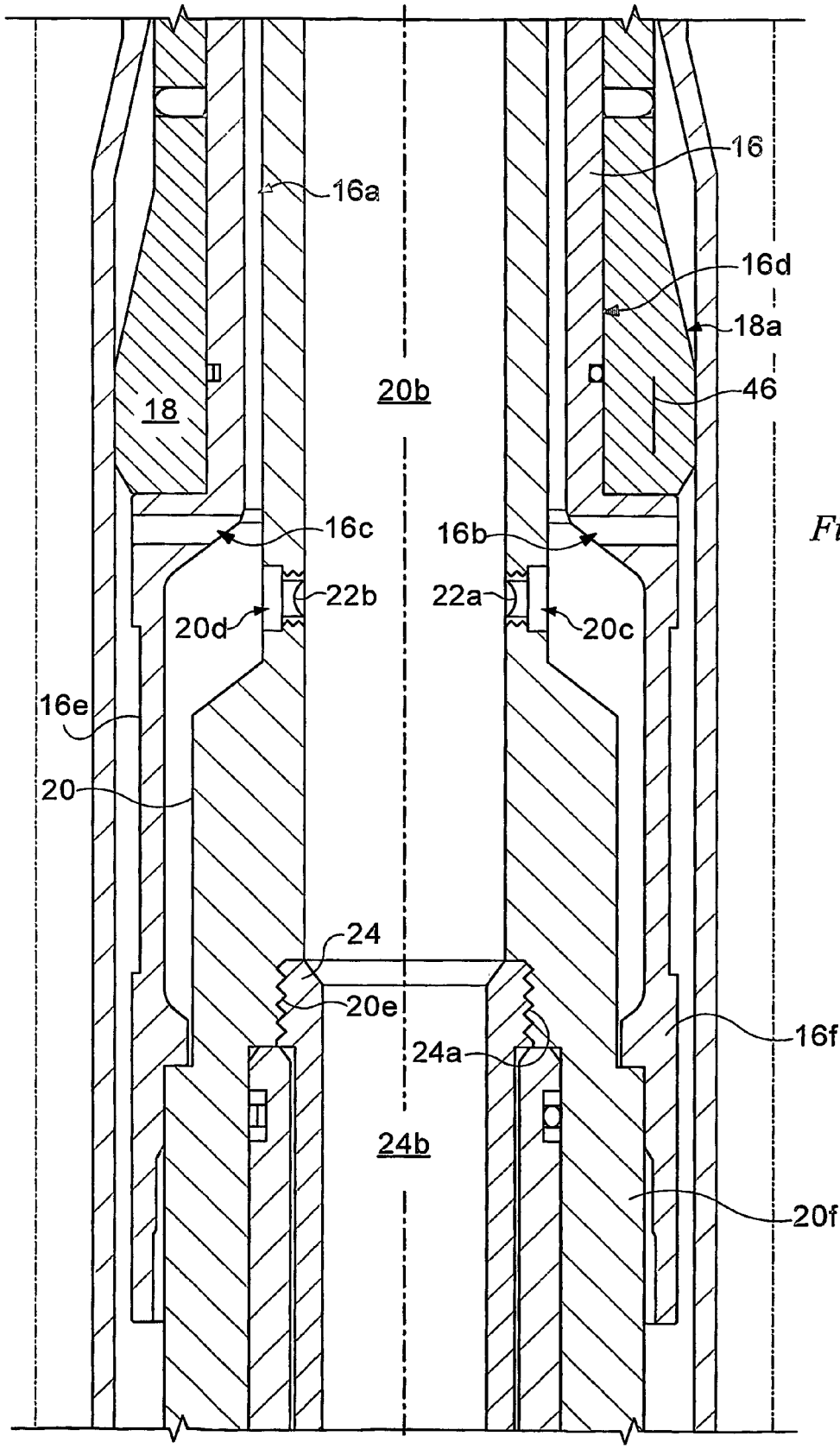
Figure 3C:
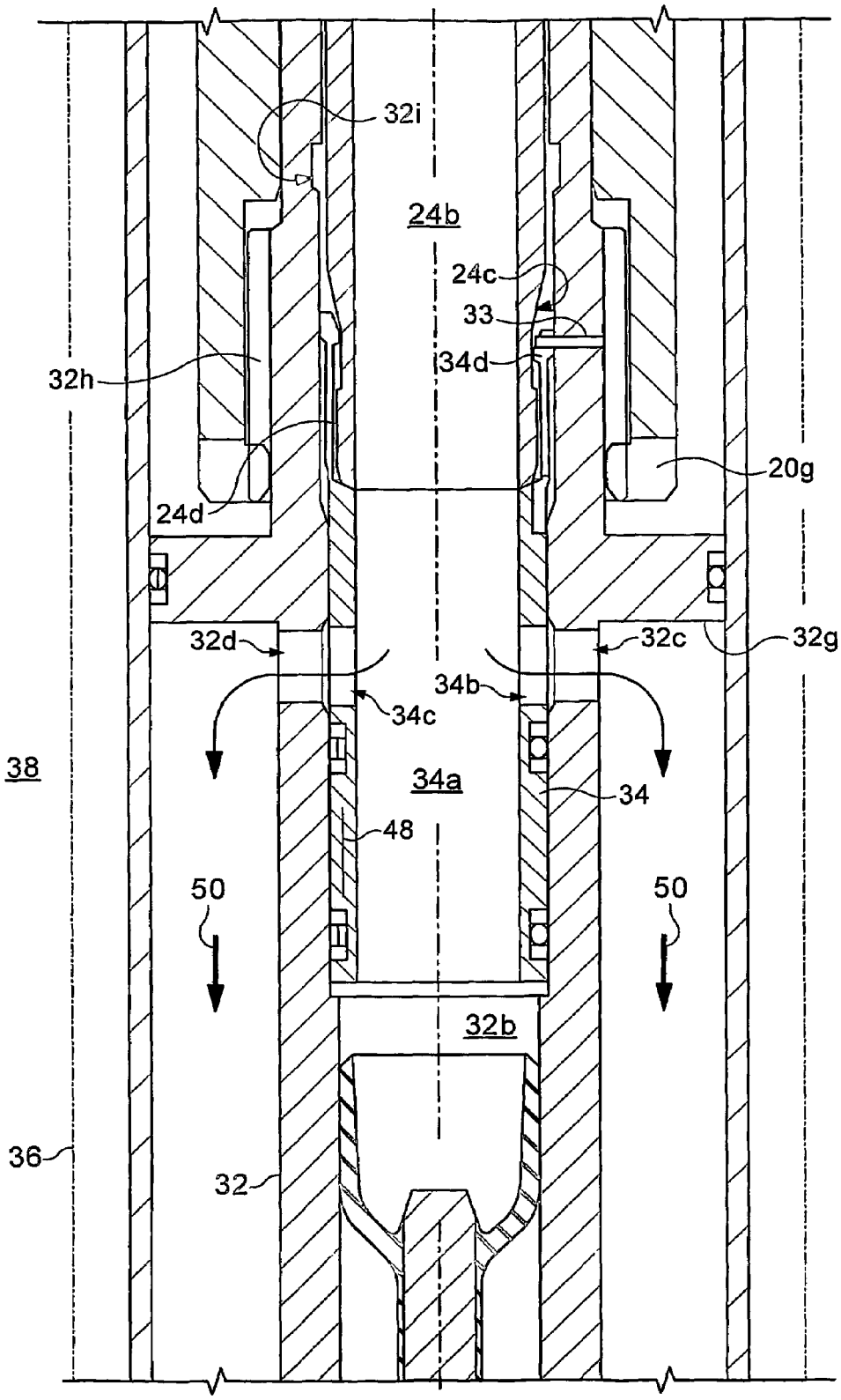
Figure 3D:
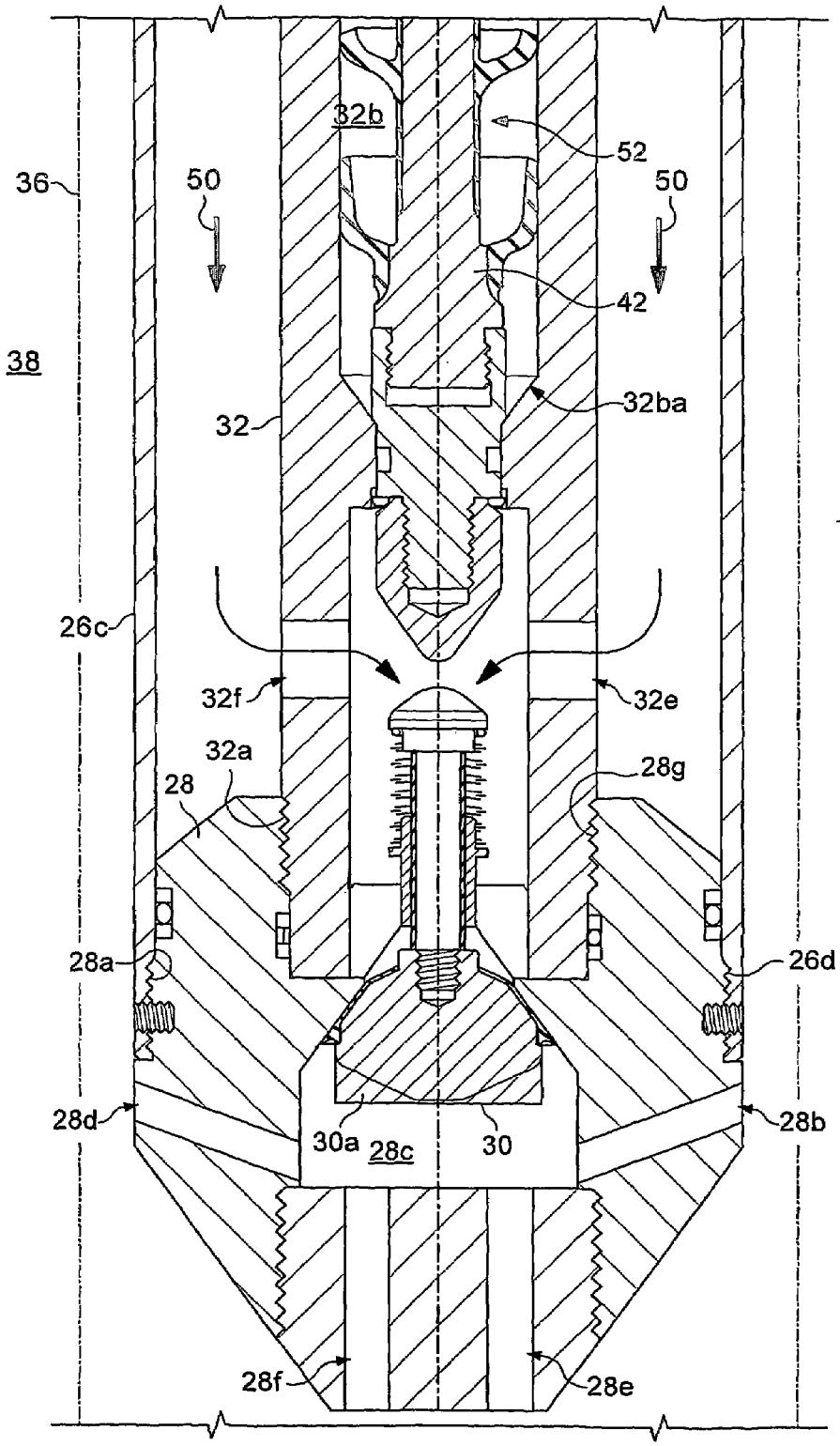
Figure 4:
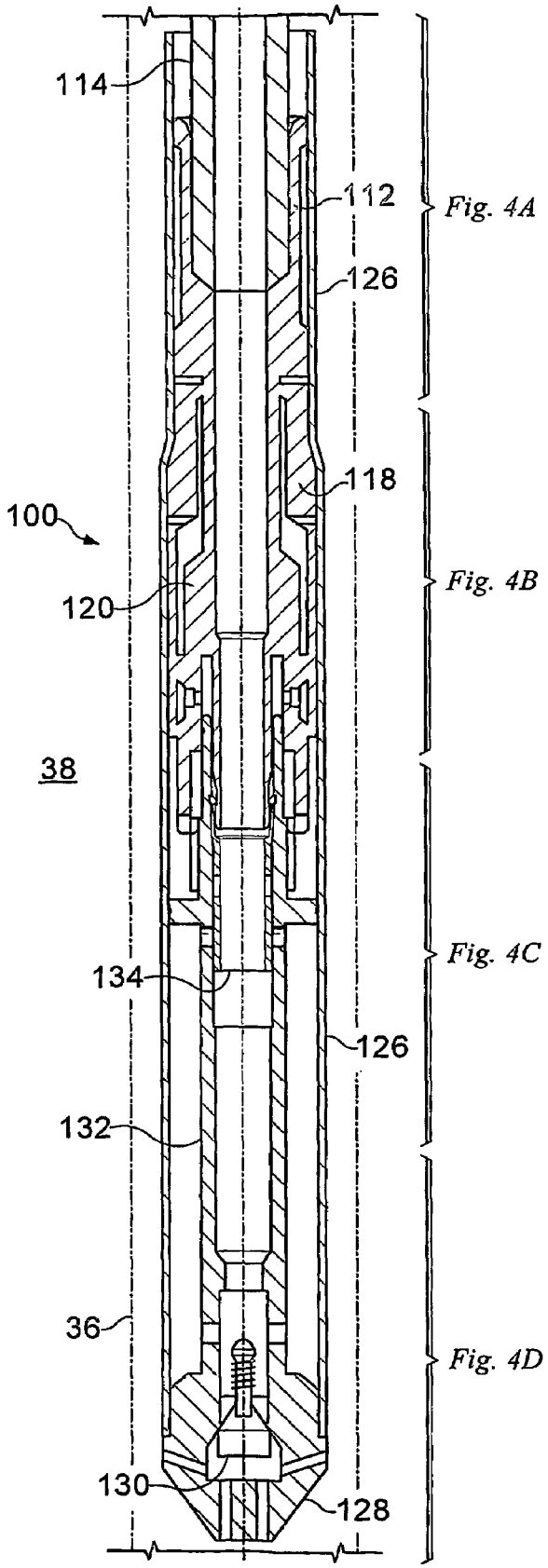
FIGS. 4, 4*a*, 4*b*, 4*c*, and 4*d* are fragmentary cross-sectional illustrations of an embodiment of an apparatus for radially expanding and plastically deforming a tubular member during the placement of the apparatus within a wellbore.
Figure 4A:
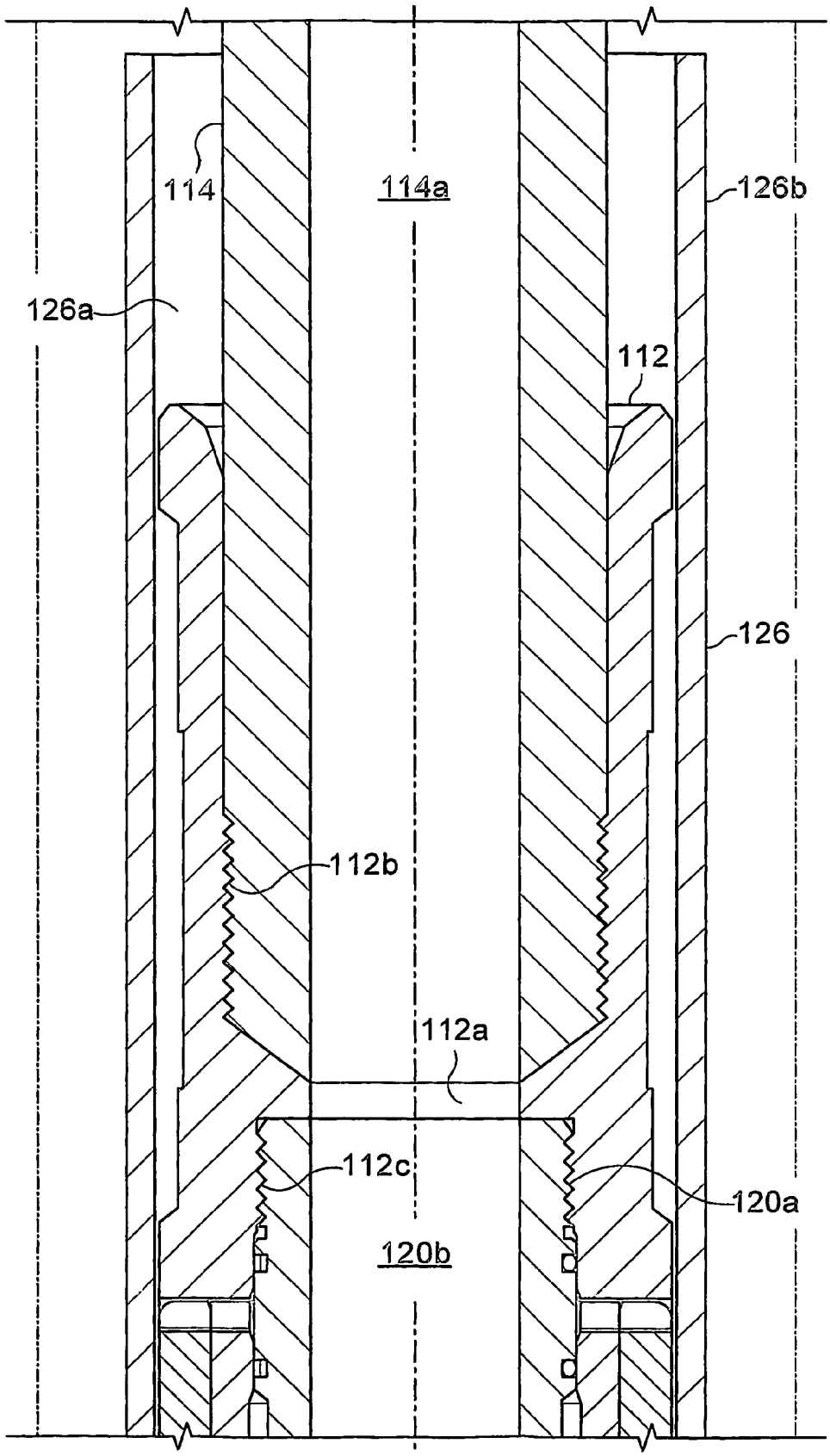
Figure 4B:
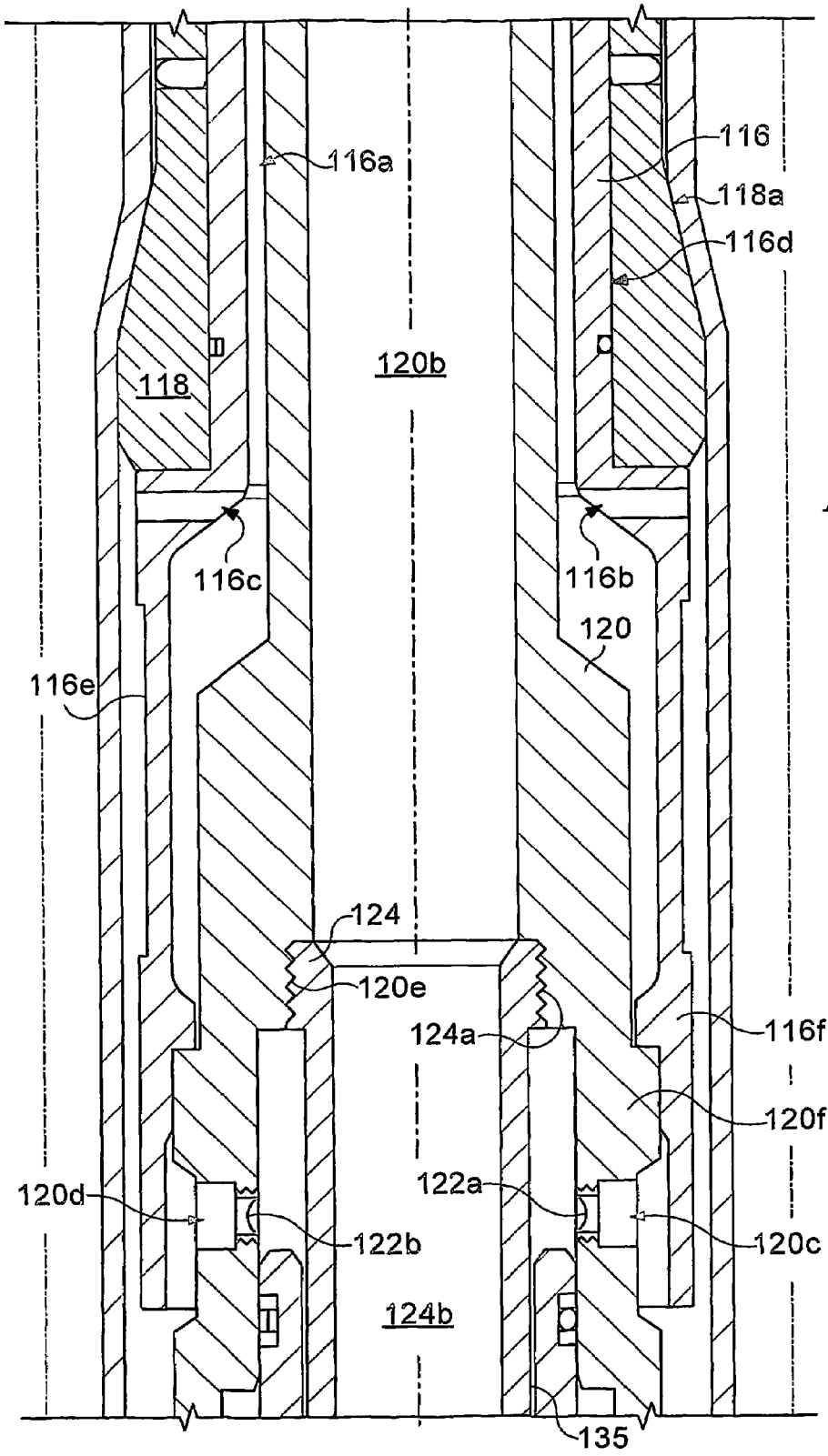
Figure 4C:
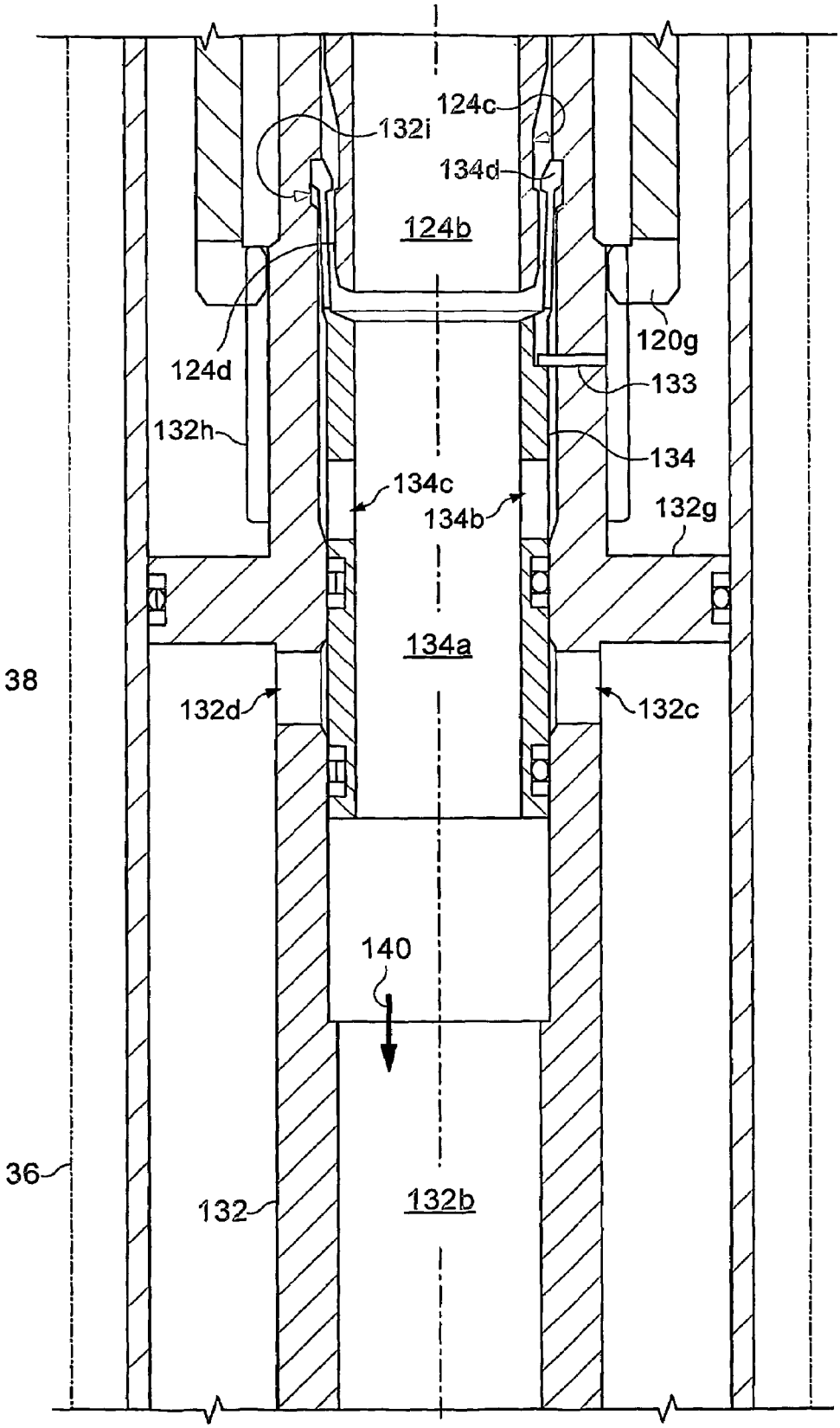
Figure 4D:
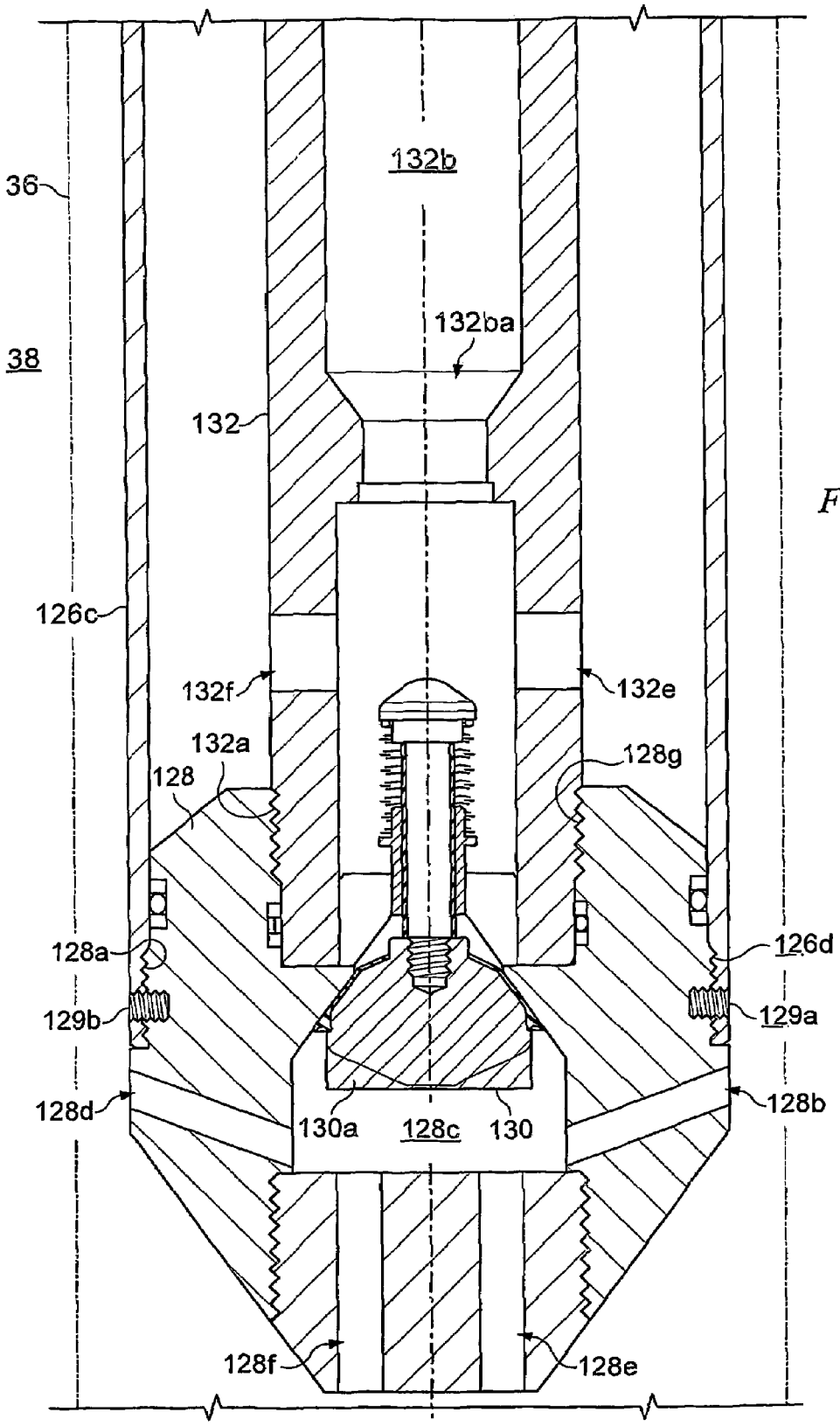
Figure 5:
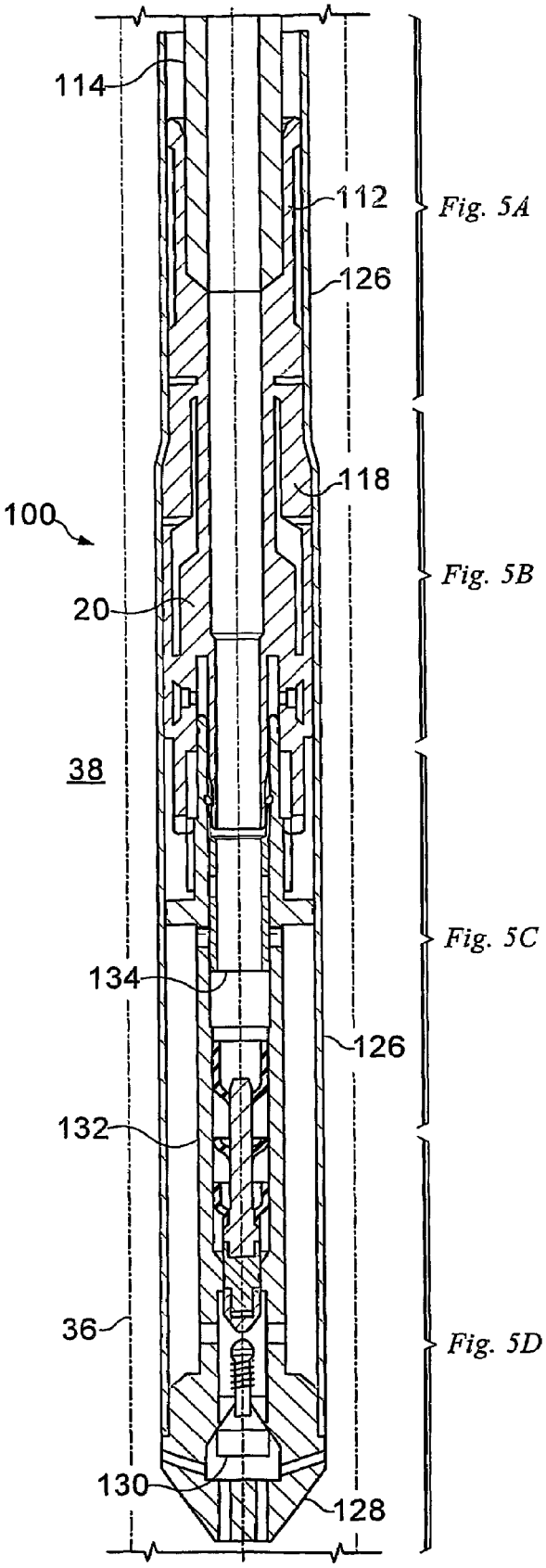
FIGS. 5, 5*a*, 5*b*, 5*c*, and 5*d* are fragmentary cross-sectional illustrations of the apparatus of FIGS. 4, 4*a*, 4*b*, 4*c*, and 4*d* during the radial expansion and plastic deformation of the tubular member.
Figure 5A:
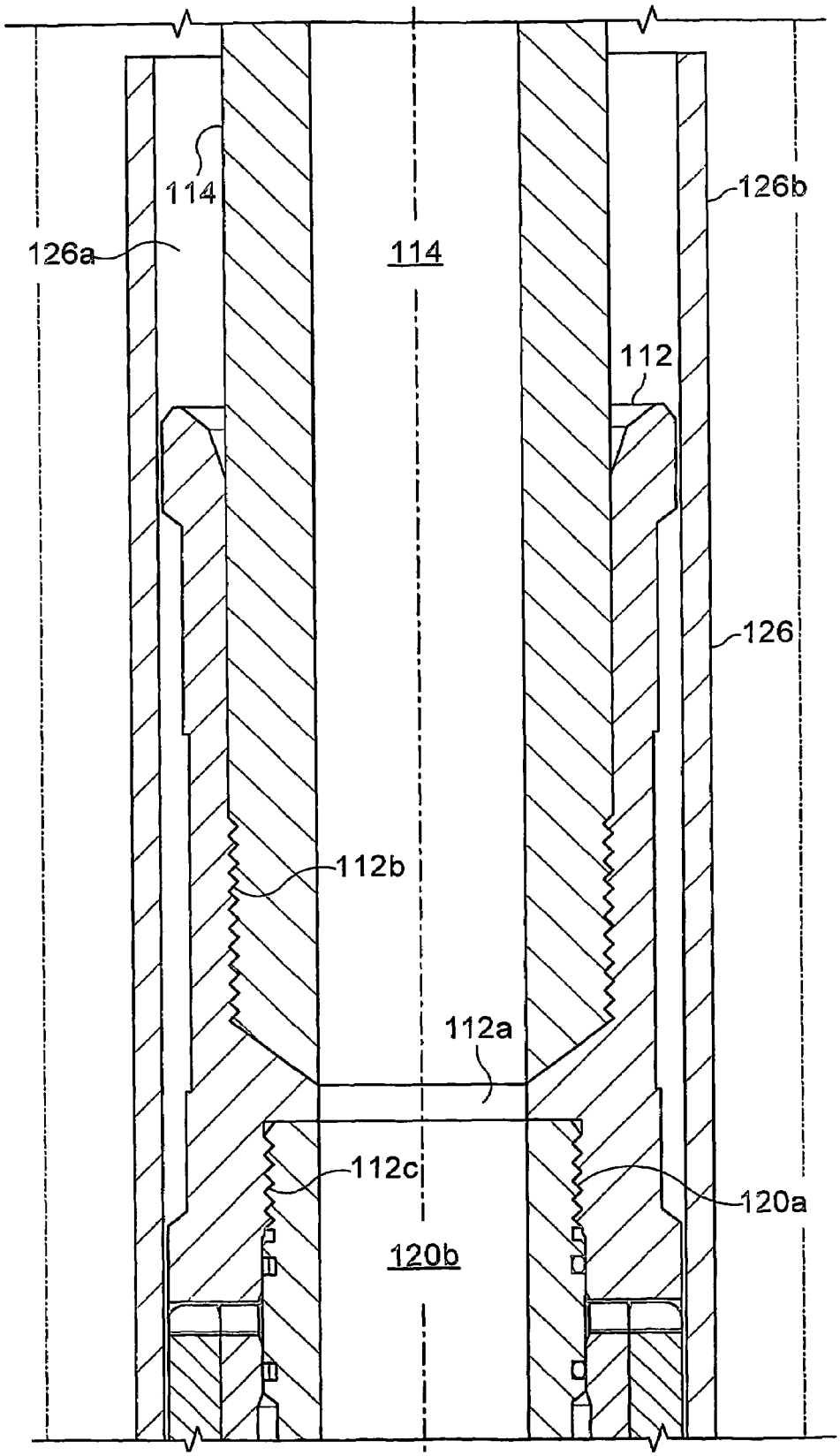
Figure 5B:
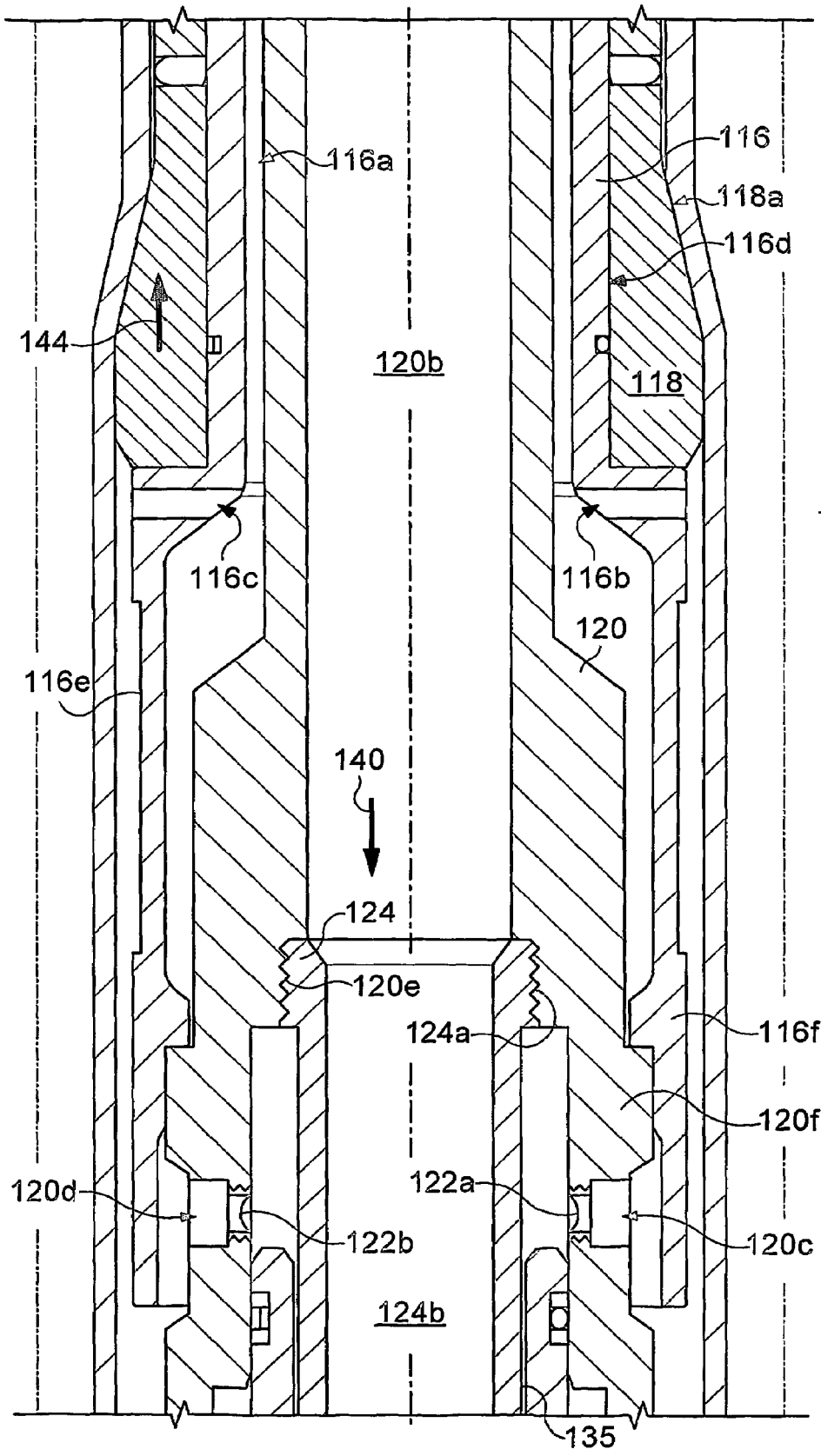
Figure 5C:
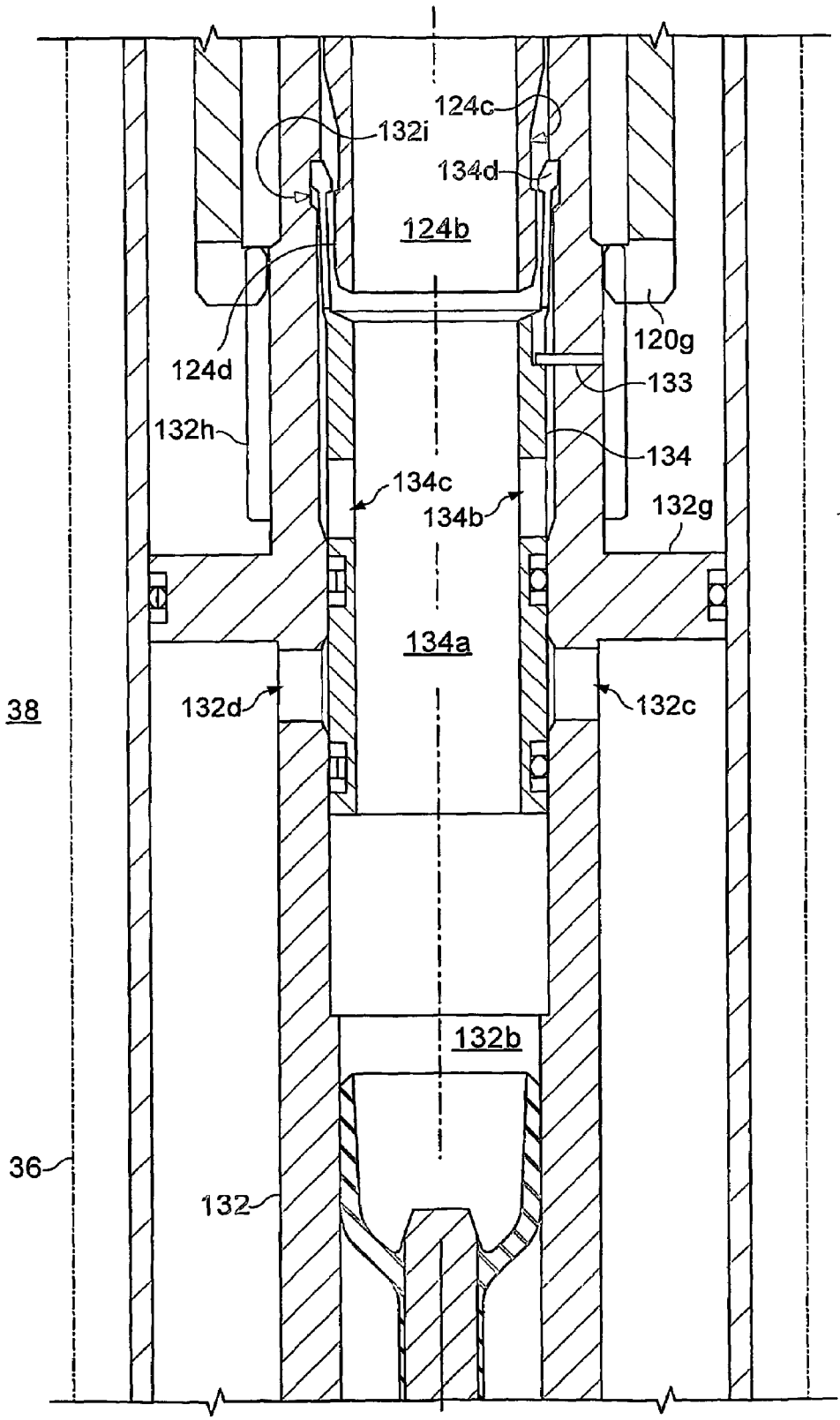
Figure 5D:
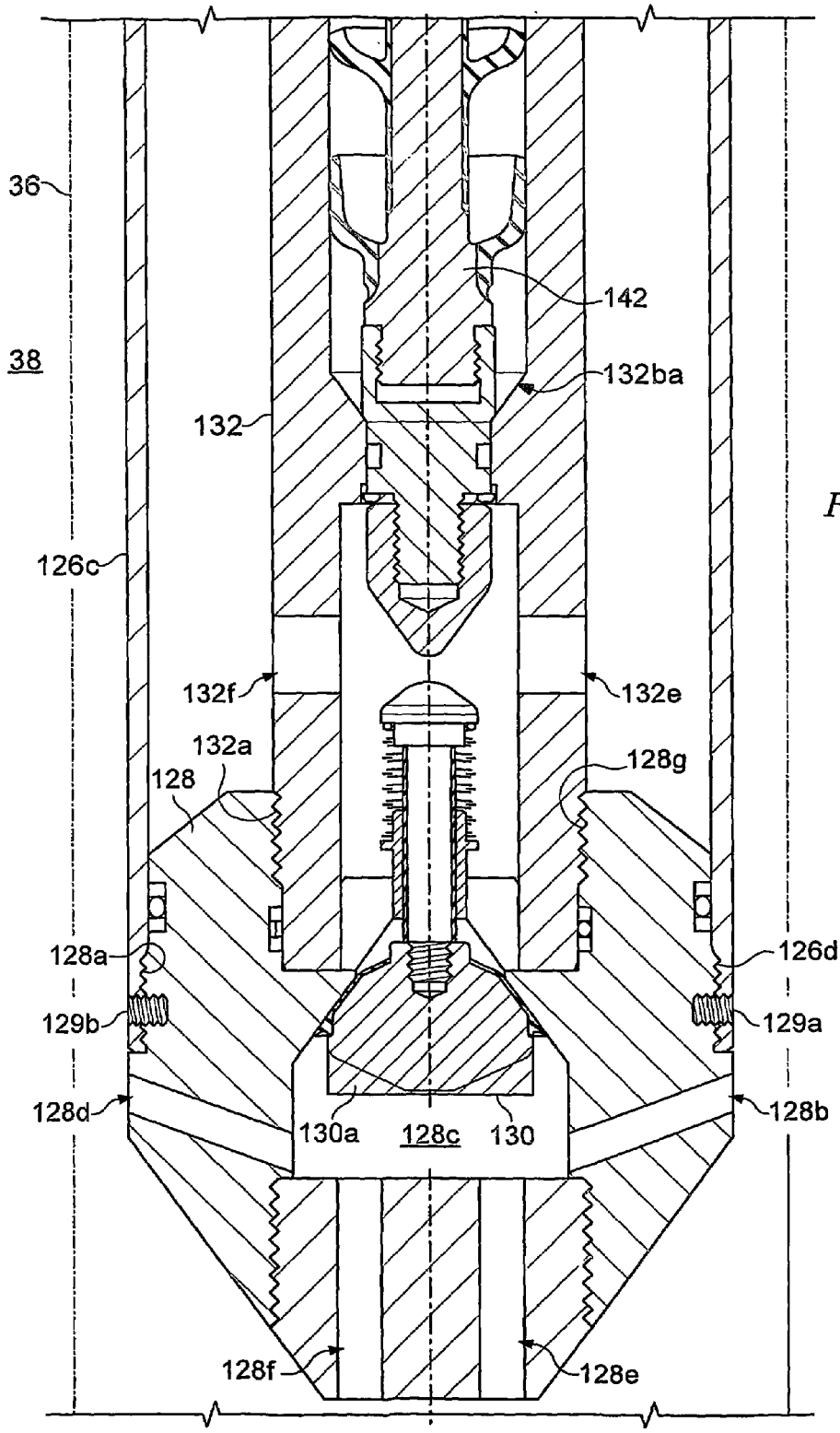
Figure 6:
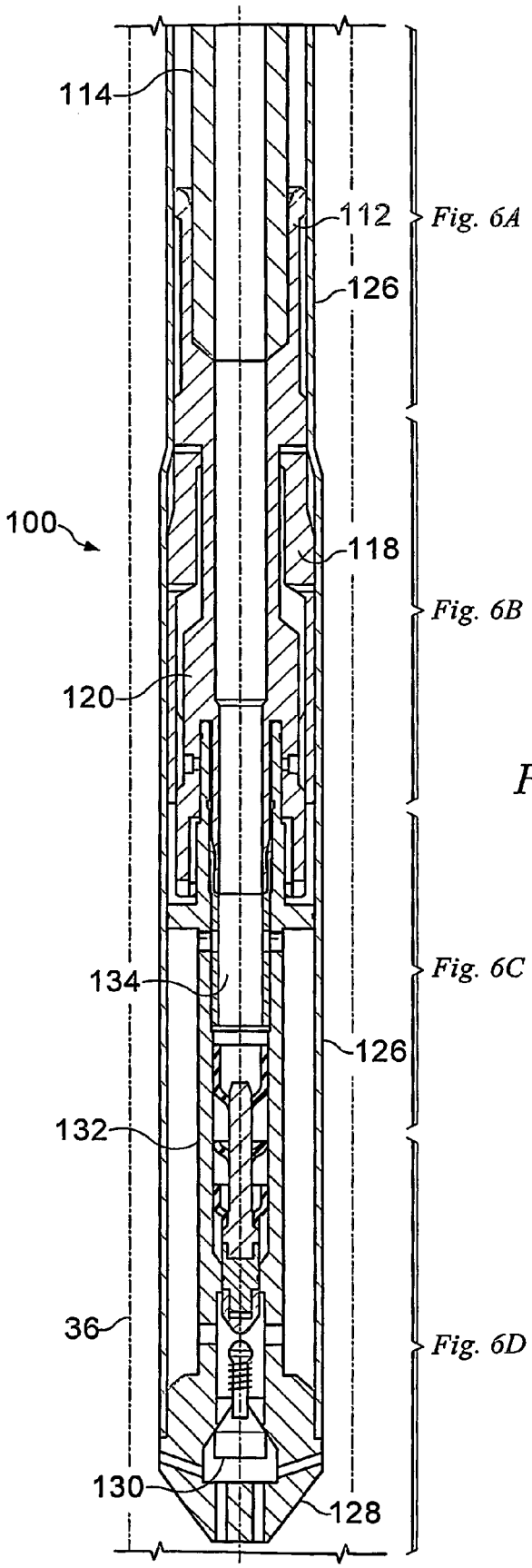
FIGS. 6, 6*a*, 6*b*, 6*c*, and 6*d* are fragmentary cross-sectional illustrations of the apparatus of FIGS. 4, 4*a*, 4*b*, 4*c*, and 4*d* during the injection of a hardenable fluidic sealing material into an annulus between the exterior of the apparatus and the wellbore.
Figure 6A:
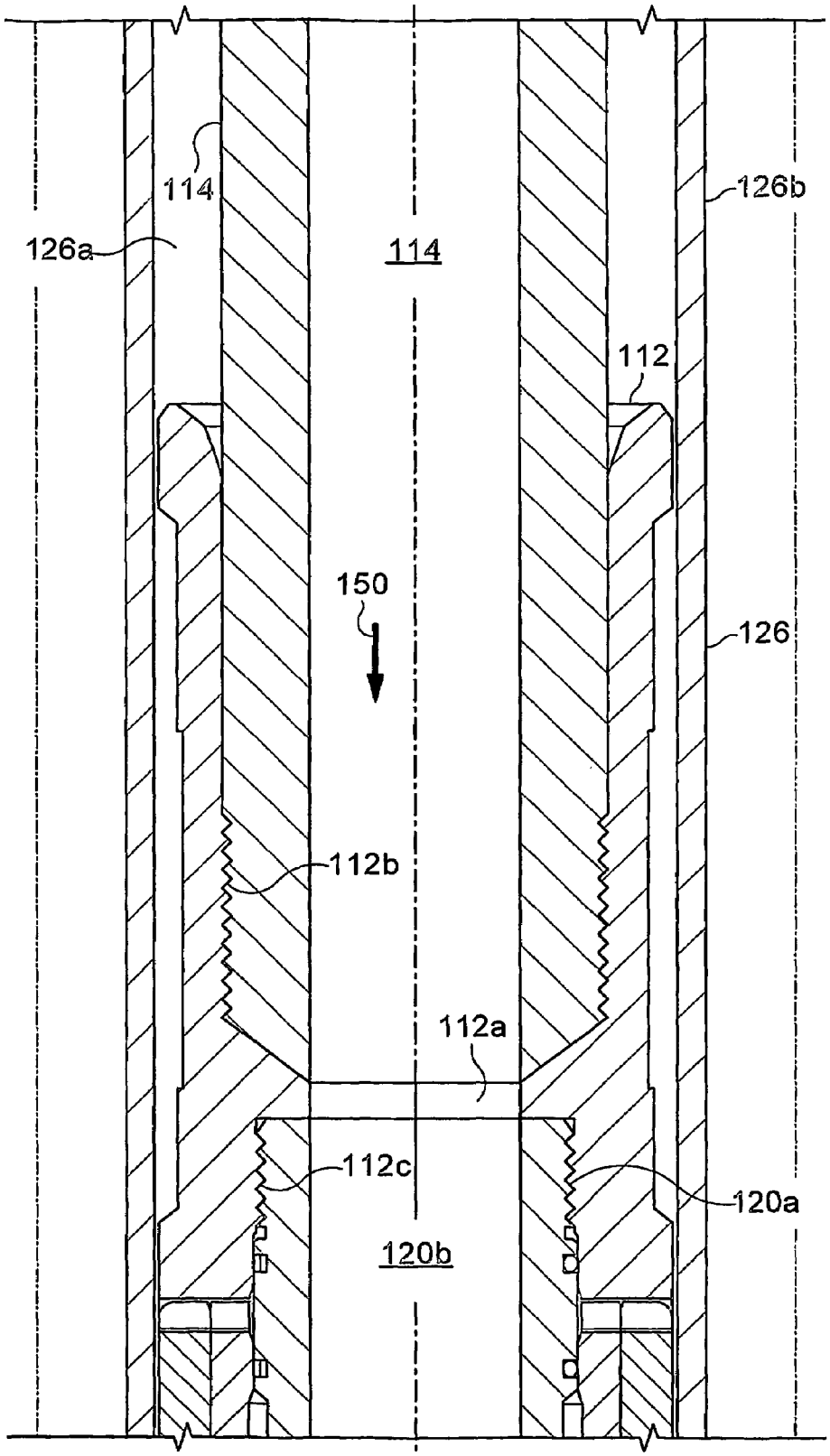
Figure 6B:
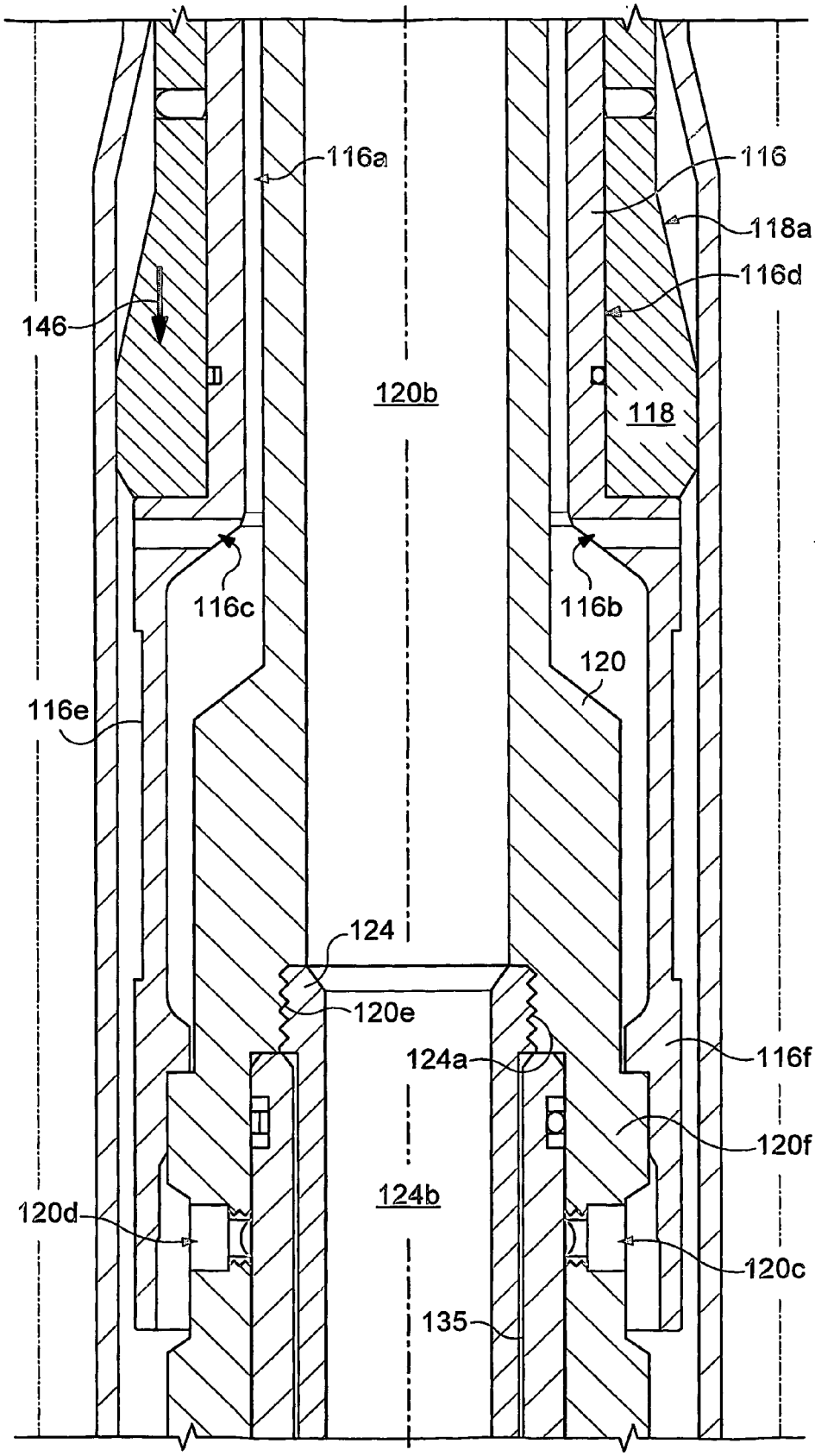
Figure 6C:
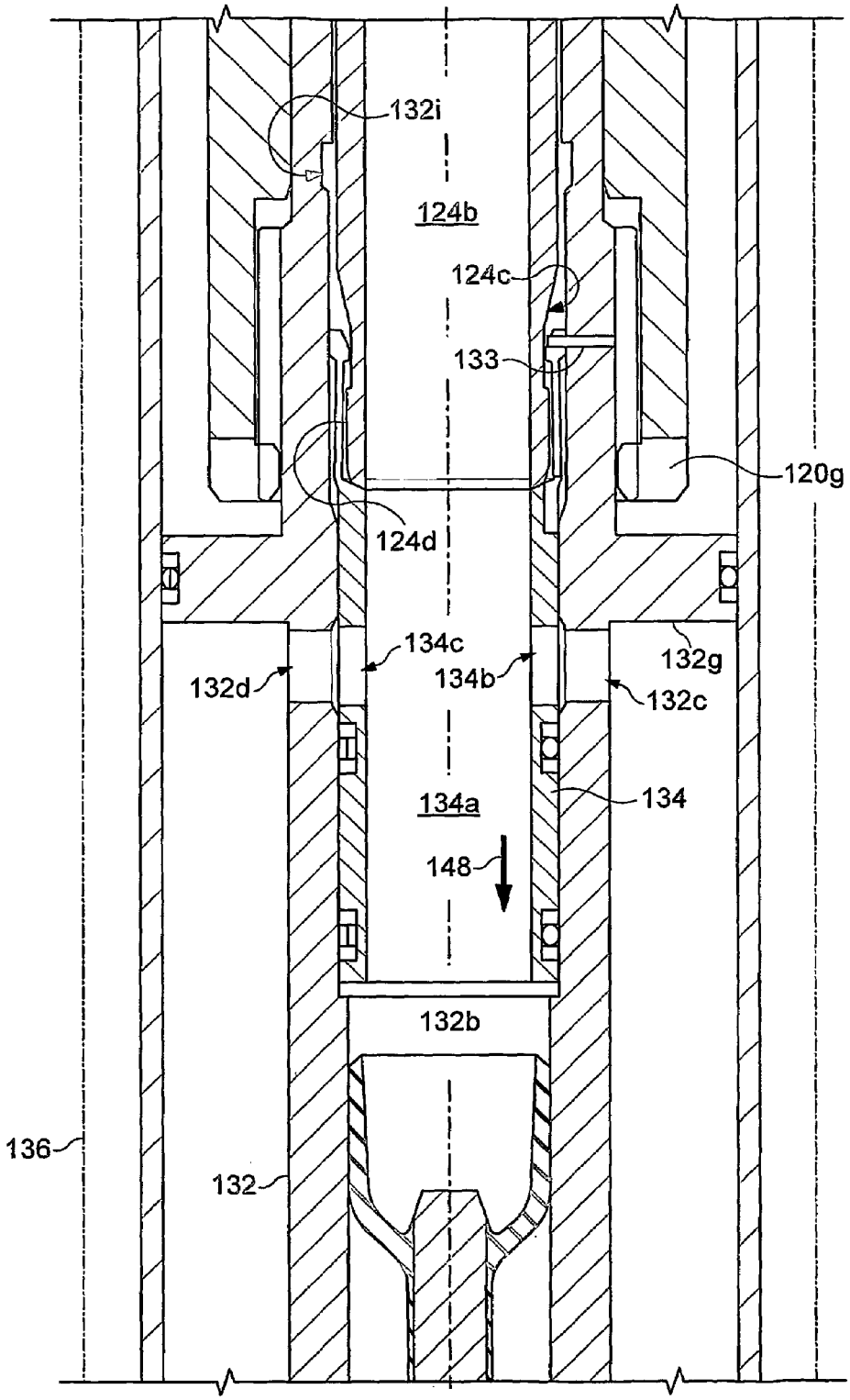
Figure 6D:
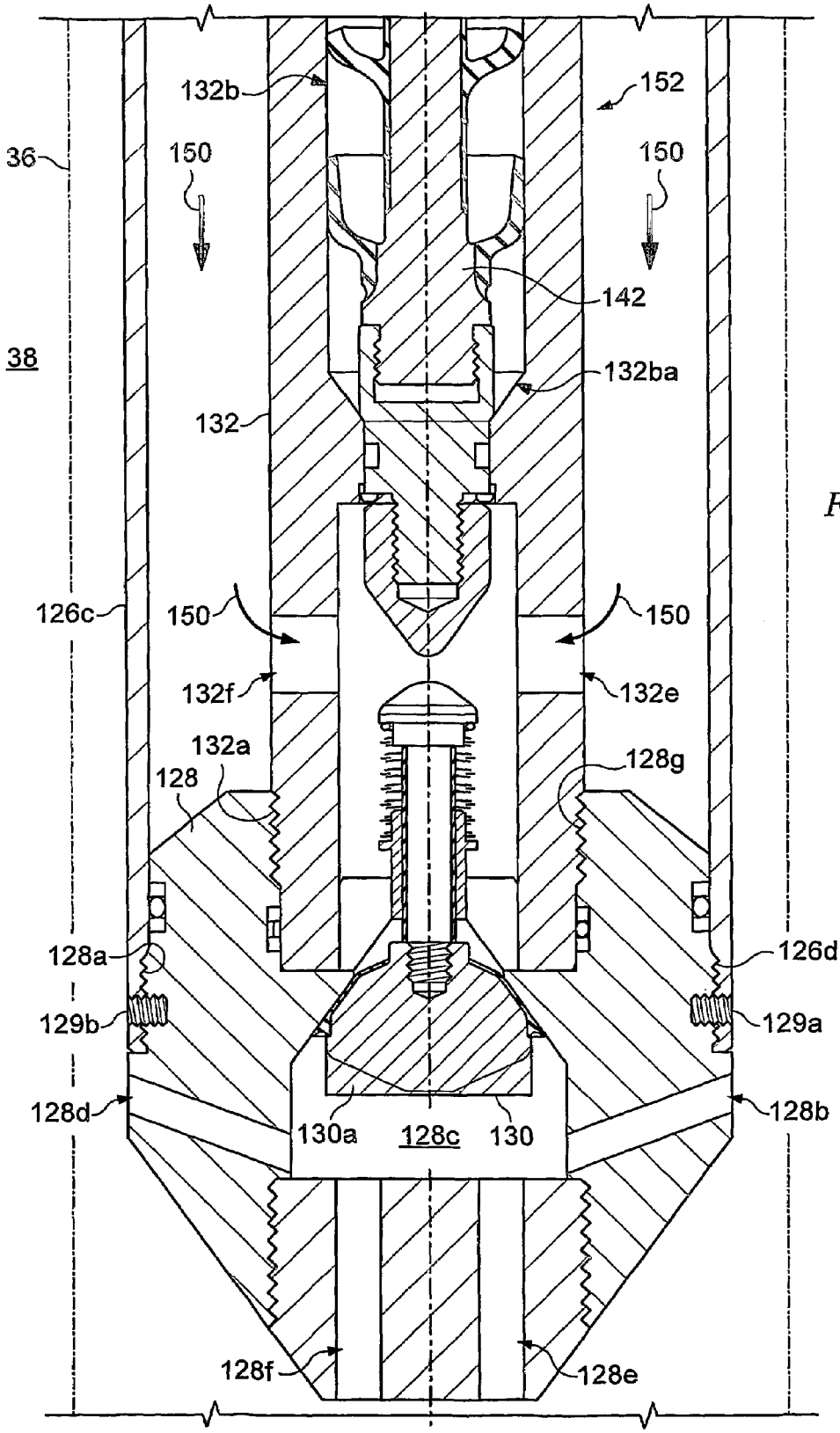

Referring to FIGS. 1, 1*a*, 1*b*, 1*c*, and 1*d*, an exemplary embodiment of an apparatus 10 for radially expanding and plastically deforming a tubular member includes a tubular support 12 that defines a internal passage 12*a* and includes a threaded connection 12*b* at one end and a threaded connection 12*c* at another end. In an exemplary embodiment, during operation of the apparatus 10, a threaded end of a conventional tubular support member 14 that defines a passage 14*a* may be coupled to the threaded connection 12*b* of the tubular support member 12.

An end of a tubular support 16 that defines an internal passage 16*a* and radial passages, 16*b* and 16*c*, and includes an external annular recess 16*d*, an external flange 16*e*, and an internal flange 16*f* is coupled to the other end of the tubular support 12. A tubular expansion cone 18 that includes a tapered external expansion surface 18*a* is received within and is coupled to the external annular recess 16*d* of the tubular support 16 and an end of the tubular expansion cone abuts an end face of the external sleeve 16*e* of the tubular support.

A threaded connection 20*a* of an end of a tubular support 20 that defines an internal passage 20*b* and radial passages, 20*c* and 20*d*, and includes a threaded connection 20*e*, an external flange 20*f*, and internal splines 20*g* at another end is coupled to the threaded connection 12*c* of the other end of the tubular support 12. In an exemplary embodiment, the external flange 20*f* of the tubular support 20 abuts the internal flange 16*f* of the tubular support 16. Rupture discs, 22*a* and 22*b*, are received and mounted within the radial passages, 20*c* and 20*d*, respectively, of the tubular support 20.

A threaded connection 24*a* of an end of a tubular stinger 24 that defines an internal passage 24*b* and includes an external annular recess 24*c* and an external flange 24*d* at another end is coupled to the threaded connection 20*e* of the tubular support 20. An expandable tubular member 26 that defines an internal passage 26*a* for receiving the tubular supports 12, 14, 16, and 20 mates with and is supported by the external expansion surface 18*a* of the tubular expansion cone 18 that includes an upper portion 26*b* having a smaller inside diameter and a lower portion 26*c* having a larger inside diameter and a threaded connection 26*d*.

A threaded connection 28*a* of a shoe 28 that defines internal passages, 28*b*, 28*c*, 28*d*, 28*e*, and 28*f*, and includes another threaded connection 28*g* is coupled to the threaded connection 26*d* of the lower portion 26*c* of the expandable tubular member 26. A conventional one-way poppet valve 30 is movably coupled to the shoe 28 and includes a valve element 30*a* for controllably sealing an opening of the internal passage 28*c* of the shoe. In an exemplary embodiment, the one-way poppet valve 30 only permits fluidic materials to be exhausted from the apparatus 10.

A threaded connection 32*a* at an end of a tubular body 32 that defines an internal passage 32*b*, having a plug valve seat 32*ba*, upper flow ports, 32*c* and 32*d*, and lower flow ports, 32*e* and 32*f*, and includes an external flange 32*g* for sealingly engaging the interior surface of the expandable tubular member 26, external splines 32*h* for mating with and engaging the internal splines 20*g* of the tubular support 20, and an internal annular recess 32*i* is coupled to the threaded connection 28*g* of the shoe 28. Another end of the tubular body 32 is received within an annulus defined between the interior surface of the other end of the tubular support 20 and the exterior surface of the tubular stinger 24, and sealingly engages the interior surface of the tubular support 20.

A sliding sleeve valve 34 is movably received and supported within the internal passage 32*b* of the tubular body 32 that defines an internal passage 34*a* and radial passages, 34*b* and 34*c*, and includes collet fingers 34*d* at one end positioned within the annular recess 32*i* of the tubular body for releasably engaging the external flange 24*d* of the tubular stinger 24. The sliding sleeve valve 34 sealingly engages the internal surface of the internal passage 32*b* of the tubular body 32, and blocks the upper flow ports, 32*c* and 32*d*, of the tubular body. A valve guide pin 33 is coupled to the tubular body 32 for engaging the collet fingers 34*d* of the sliding sleeve valve 34 and thereby guiding and limiting the movement of the sliding sleeve valve.

During operation, as illustrated in FIGS. 1, 1*a*, 1*b*, 1*c*, and 1*d*, the apparatus 10 is positioned within a preexisting structure such as, for example, a wellbore 36 that traverses a subterranean formation 38. In an exemplary embodiment, during or after the positioning of the apparatus 10 within the wellbore 36, fluidic materials 40 may be circulated through and out of the apparatus into the wellbore 36 though the internal passages 14*a*, 12*a*, 20*b*, 24*b*, 34*a*, 32*b*, 28*b*, 28*c*, 28*d*, 28*e*, and 28*f*.

In an exemplary embodiment, as illustrated in FIGS. 2, 2*a*, 2*b*, 2*c*, and 2*d*, during operation of the apparatus 10, a conventional plug valve element 42 may then be injected into the apparatus through the passages 14*a*, 12*a*, 20*b*, 24*b*, 34*a*, and 32*b* until the plug valve element is seated in the plug seat 32*ba* of the internal passage of the tubular body 32. As a result, the flow of fluidic materials through the lower portion of the internal passage 32*b* of the tubular body 32 is blocked. Continued injection of fluidic materials 40 into the apparatus 10, following the seating of the plug valve element 42 in the plug seat 32*ba* of the internal passage of the tubular body 32, pressurizes the internal passage 20*b* of the tubular support and thereby causes the rupture discs, 22*a* and 22*b*, to be ruptured thereby opening the internal passages, 20*c* and 20*d*, of the tubular support 20. As a result, fluidic materials 40 are then conveyed through the internal passages, 20*c* and 20*d*, and radial passages, 16*c* and 16*d*, thereby pressurizing a region within the apparatus 10 below the tubular expansion cone 18. As a result, the tubular support 12, tubular support 14, tubular support 16, tubular expansion cone 18, tubular support 20, and tubular stinger 24 are displaced upwardly in the direction 44 relative to the expandable tubular member 26, shoe 28, tubular body 32, and sliding sleeve valve 34 thereby radially expanding and plastically deforming the expandable tubular member.

During the continued upward displacement of the tubular support 12, tubular support 14, tubular support 16, tubular expansion cone 18, tubular support 20, and tubular stinger 24 in the direction 44 relative to the expandable tubular member 26, shoe 28, tubular body 32, and sliding sleeve valve 34, the upward movement of the sliding sleeve valve is prevented by the operation of the valve guide pin 33. Consequently, at some point, the collet fingers 34*d* of the sliding sleeve valve 34 disengage from the external flange 24*d* of the tubular stinger 24.

In an exemplary embodiment, as illustrated in FIGS. 3, 3*a*, 3*b*, 3*c*, and 3*d*, during operation of the apparatus 10, before radially expanding and plastically deforming the expandable tubular member 26, the tubular support 12, tubular support 14, tubular support 16, tubular expansion cone 18, tubular support 20, and tubular stinger 24 are displaced downwardly in the direction 46 relative to the expandable tubular member 26, shoe 28, tubular body 32, and sliding sleeve valve 34 by, for example, setting the apparatus down onto the bottom of the wellbore 36. As a result, the other end of the tubular stinger 24 impacts and displaces the sliding sleeve valve 34 downwardly in the direction 48 thereby aligning the internal passages, 32*c* and 32*d*, of the tubular body 32, with the internal passages, 34*b* and 34*c*, of the sliding sleeve valve. A hardenable fluidic sealing material 50 may then be injected into the apparatus 10 through the internal passages 14*a*, 12*a*, 20*b*, 24*b*, and 34*a*, into and through the internal passages 32*c* and 32*d* and 34*b* and 34*c*, into and through an annulus 52 defined between the interior of the expandable tubular member 26 and the exterior of the tubular body 32, and then out of the apparatus through the internal passages 32*e* and 32*f* of the tubular body and the internal passages 28*b*, 28*c*, 28*d*, 28*e*, and 28*f* of the shoe 28 into the annulus between the exterior surface of the expandable tubular member and the interior surface of the wellbore 36. As a result, an annular body of a hardenable fluidic sealing material such as, for example, cement is formed within the annulus between the exterior surface of the expandable tubular member 26 and the interior surface of the wellbore 36. Before, during, or after the curing of the annular body of the hardenable fluidic sealing material, the apparatus may then be operated as described above with reference to FIG. 2 to radially expand and plastically deform the expandable tubular member 26.

Referring to FIGS. 4, 4*a*, 4*b*, 4*c*, and 4*d*, an exemplary embodiment of an apparatus 100 for radially expanding and plastically deforming a tubular member includes a tubular support 112 that defines a internal passage 112*a* and includes a threaded connection 112*b* at one end and a threaded connection 112*c* at another end. In an exemplary embodiment, during operation of the apparatus 100, a threaded end of a conventional tubular support member 114 that defines a passage 114*a* may be coupled to the threaded connection 112*b* of the tubular support member 112.

An end of a tubular support 116 that defines an internal passage 116*a* and radial passages, 116*b* and 116*c*, and includes an external annular recess 116*d*, an external flange 116*e*, and an internal flange 116*f* is coupled to the other end of the tubular support 112. A tubular expansion cone 118 that includes a tapered external expansion surface 118*a* is received within and is coupled to the external annular recess 116*d* of the tubular support 116 and an end of the tubular expansion cone abuts an end face of the external sleeve 116*e* of the tubular support.

A threaded connection 120*a* of an end of a tubular support 120 that defines an internal passage 120*b* and radial passages, 120*c* and 120*d*, and includes a threaded connection 120*e*, an external flange 120*f*, and internal splines 120*g* at another end is coupled to the threaded connection 112*c* of the other end of the tubular support 112. In an exemplary embodiment, the external flange 120*f* of the tubular support 120 abuts the internal flange 116*f* of the tubular support 116. Rupture discs, 122*a* and 122*b*, are received and mounted within the radial passages, 120*c* and 120*d*, respectively, of the tubular support 120.

A threaded connection 124*a* of an end of a tubular stinger 124 that defines an internal passage 124*b* and includes an external annular recess 124*c* and an external flange 124*d* at another end is coupled to the threaded connection 120*e* of the tubular support 120. An expandable tubular member 126 that defines an internal passage 126*a* for receiving the tubular supports 112, 114, 116, and 120 mates with and is supported by the external expansion surface 118*a* of the tubular expansion cone 118 that includes an upper portion 126*b* having a smaller inside diameter and a lower portion 126*c* having a larger inside diameter and a threaded connection 126*d*.

A threaded connection 128*a* of a shoe 128 that defines internal passages, 128*b*, 128*c*, 128*d*, 128*e*, and 128*f*, and includes another threaded connection 128*g* is coupled to the threaded connection 126*d* of the lower portion 126*c* of the expandable tubular member 126. Pins, 129*a* and 129*b*, coupled to the shoe 128 and the lower portion 126*c* of the expandable tubular member 126 prevent disengagement of the threaded connections, 126*d* and 128*a*, of the expandable tubular member and shoe. A conventional one-way poppet valve 130 is movably coupled to the shoe 128 and includes a valve element 130*a* for controllably sealing an opening of the internal passage 128*c* of the shoe. In an exemplary embodiment, the one-way poppet valve 130 only permits fluidic materials to be exhausted from the apparatus 100.

A threaded connection 132*a* at an end of a tubular body 132 that defines an internal passage 132*b*, having a plug valve seat 132*ba*, upper flow ports, 132*c* and 132*d*, and lower flow ports, 132*e* and 132*f*, and includes an external flange 132*g* for sealingly engaging the interior surface of the expandable tubular member 126, external splines 132*h* for mating with and engaging the internal splines 120*g* of the tubular support 120, and an internal annular recess 132*i* is coupled to the threaded connection 128*g* of the shoe 128. Another end of the tubular body 132 is received within an annulus defined between the interior surface of the other end of the tubular support 120 and the exterior surface of the tubular stinger 124, and sealingly engages the interior surface of the tubular support 120. An annular passage 133 is further defined between the interior surface of the other end of the tubular body 132 and the exterior surface of the tubular stinger 124.

A sliding sleeve valve 134 is movably received and supported within the internal passage 132*b* of the tubular body 132 that defines an internal passage 134*a* and radial passages, 134*b* and 134*c*, and includes collet fingers 134*d* at one end positioned within the annular recess 132*i* of the tubular body for releasably engaging the external flange 124*d* of the tubular stinger 124. The sliding sleeve valve 134 sealingly engages the internal surface of the internal passage 132*b* of the tubular body 132, and blocks the upper flow ports, 132*c* and 132*d*, of the tubular body. A valve guide pin 135 is coupled to the tubular body 132 for engaging the collet fingers 134*d* of the sliding sleeve valve 134 and thereby guiding and limiting the movement of the sliding sleeve valve.

During operation, as illustrated in FIGS. 4, 4*a*, 4*b*, 4*c*, and 4*d*, the apparatus 100 is positioned within a preexisting structure such as, for example, a wellbore 36 that traverses a subterranean formation 38. In an exemplary embodiment, during or after the positioning of the apparatus 100 within the wellbore 36, fluidic materials 140 may be circulated through and out of the apparatus into the wellbore 36 though the internal passages 114*a*, 112*a*, 120*b*, 124*b*, 134*a*, 132*b*, 128*b*, 128*c*, 128*d*, 128*e*, and 128*f*.

In an exemplary embodiment, as illustrated in FIGS. 5, 5*a*, 5*b*, 5*c*, and 5*d*, during operation of the apparatus 100, a conventional plug valve element 142 may then be injected into the apparatus through the passages 114*a*, 112*a*, 120*b*, 124*b*, 134*a*, and 132*b* until the plug valve element is seated in the plug seat 132*ba* of the internal passage of the tubular body 132. As a result, the flow of fluidic materials through the lower portion of the internal passage 132*b* of the tubular body 132 is blocked. Continued injection of fluidic materials 140 into the apparatus 100, following the seating of the plug valve element 142 in the plug seat 132*ba* of the internal passage of the tubular body 132, pressurizes the internal annular passage 135 and thereby causes the rupture discs, 122*a* and 122*b*, to be ruptured thereby opening the internal passages, 120*c* and 120*d*, of the tubular support 120. As a result, fluidic materials 140 are then conveyed through the internal passages, 120*c* and 120*d*, thereby pressurizing a region within the apparatus 100 below the tubular expansion cone 118. As a result, the tubular support 112, tubular support 114, tubular support 116, tubular expansion cone 118, tubular support 120, and tubular stinger 124 are displaced upwardly in the direction 144 relative to the expandable tubular member 126, shoe 128, tubular body 132, and sliding sleeve valve 134 thereby radially expanding and plastically deforming the expandable tubular member.

During the continued upward displacement of the tubular support 112, tubular support 114, tubular support 116, tubular expansion cone 118, tubular support 120, and tubular stinger 124 in the direction 144 relative to the expandable tubular member 126, shoe 128, tubular body 132, and sliding sleeve valve 134, the upward movement of the sliding sleeve valve is prevented by the operation of the valve guide pin 135. Consequently, at some point, the collet fingers 134*d* of the sliding sleeve valve 134 disengage from the external flange 124*d* of the tubular stinger 124.

In an exemplary embodiment, as illustrated in FIGS. 6, 6*a*, 6*b*, 6*c*, and 6*d*, during operation of the apparatus 100, before or after radially expanding and plastically deforming the expandable tubular member 126, the tubular support 112, tubular support 114, tubular support 116, tubular expansion cone 118, tubular support 120, and tubular stinger 124 are displaced downwardly in the direction 146 relative to the expandable tubular member 126, shoe 128, tubular body 132, and sliding sleeve valve 134 by, for example, setting the apparatus down onto the bottom of the wellbore 36. As a result, the end of the tubular body 132 that is received within the annulus defined between the interior surface of the other end of the tubular support 120 and the exterior surface of the tubular stinger 124 and that sealingly engages the interior surface of the tubular support 120 is displaced upwardly relative to the tubular support and tubular stinger thereby preventing fluidic materials from passing through the annular passage 133 into the radial passages, 120*c* and 120*d*, of the tubular support. Furthermore, as a result, the other end of the tubular stinger 124 impacts and displaces the sliding sleeve valve 134 downwardly in the direction 148 thereby aligning the internal passages, 132*c* and 132*d*, of the tubular body 132, with the internal passages, 134*b* and 134*c*, respectively, of the sliding sleeve valve. A hardenable fluidic sealing material 150 may then be injected into the apparatus 100 through the internal passages 114*a*, 112*a*, 120*b*, 124*b*, and 134*a*, into and through the internal passages 132*c* and 132*d* and 134*b* and 134*c*, into and through an annulus 152 defined between the interior of the expandable tubular member 126 and the exterior of the tubular body 132, and then out of the apparatus through the internal passages 132*e* and 132*f* of the tubular body and the internal passages 128*b*, 128*c*, 128*d*, 128*e*, and 128*f* of the shoe 128 into the annulus between the exterior surface of the expandable tubular member and the interior surface of the wellbore 36. As a result, an annular body of a hardenable fluidic sealing material such as, for example, cement is formed within the annulus between the exterior surface of the expandable tubular member 126 and the interior surface of the wellbore 36. Before, during, or after the curing of the annular body of the hardenable fluidic sealing material, the apparatus may then be operated as described above with reference to FIG. 5 to radially expand and plastically deform the expandable tubular member 126.

Referring to FIGS. 7, 7*a*, 7*b*, 7*c*, 7*d* and 7*e*, an exemplary embodiment of an apparatus 200 for radially expanding and plastically deforming a tubular member includes a tubular support 212 that defines a internal passage 212*a* and includes a threaded connection 212*b* at one end and a threaded connection 212*c* at another end. In an exemplary embodiment, during operation of the apparatus 200, a threaded end of a conventional tubular support member 214 that defines a passage 214*a* may be coupled to the threaded connection 212*b* of the tubular support member 212.

An end of a tubular support 216 that defines an internal passage 216*a* and radial passages, 216*b* and 216*c*, and includes an external annular recess 216*d*, an external flange 216*e*, and an internal flange 216*f* is coupled to the other end of the tubular support 212. A tubular expansion cone 218 that includes a tapered external expansion surface 218*a* is received within and is coupled to the external annular recess 216*d* of the tubular support 216 and an end of the tubular expansion cone abuts an end face of the external sleeve 216*e* of the tubular support.

A threaded connection 220*a* of an end of a tubular support 220 that defines an internal passage 220*b* and radial passages, 220*c* and 220*d*, and includes a threaded connection 220*e*, an external flange 220*f*, and internal splines 220*g* at another end is coupled to the threaded connection 212*c* of the other end of the tubular support 212. In an exemplary embodiment, the external flange 220*f* of the tubular support 220 abuts the internal flange 216*f* of the tubular support 216. Rupture discs, 222*a* and 222*b*, are received and mounted within the radial passages, 220*c* and 220*d*, respectively, of the tubular support 220.

A threaded connection 224*a* of an end of a tubular stinger 224 that defines an internal passage 224*b* and includes an external annular recess 224*c* and an external flange 224*d* at another end is coupled to the threaded connection 220*e* of the tubular support 220. An expandable tubular member 226 that defines an internal passage 226*a* for receiving the tubular supports 212, 214, 216, and 220 mates with and is supported by the external expansion surface 218*a* of the tubular expansion cone 218 that includes an upper portion 226*b* having a smaller inside diameter and a lower portion 226*c* having a larger inside diameter and a threaded connection 226*d*.

A threaded connection 228*a* of a shoe 228 that defines internal passages, 228*b*, 228*c*, and 228*d*, and includes a threaded connection 228*e* at one end and a threaded connection 228*f* at another end is coupled to the threaded connection 226*d* of the lower portion 226*c* of the expandable tubular member 226. Pins, 230*a* and 230*b*, coupled to the shoe 228 and the lower portion 226*c* of the expandable tubular member 226 prevent disengagement of the threaded connections, 226*d* and 228*a*, of the expandable tubular member and shoe. A threaded connection 232*a* of a shoe insert 232 that defines internal passages 232*b* and 232*c* is coupled to the threaded connection 228*f* of the shoe 228. In an exemplary embodiment, the shoe 228 and/or the shoe insert 232 are fabricated from composite materials in order to reduce the weight and cost of the components.

A conventional one-way poppet valve 234 is movably coupled to the shoe 228 and includes a valve element 234*a* for controllably sealing an opening of the internal passage 228*c* of the shoe. In an exemplary embodiment, the one-way poppet valve 234 only permits fluidic materials to be exhausted from the apparatus 200.

A threaded end 236*a* of a tubular plug seat 236 that defines an internal passage 236*b* having a plug seat 236*ba* and lower flow ports, 236*c* and 236*d*, is coupled to the threaded connection 228*e* of the shoe 228. In an exemplary embodiment, the tubular plug seat 236 is fabricated from aluminum in order to reduce weight and cost of the component. A tubular body 238 defines an internal passage 238*a*, lower flow ports, 238*b* and 238*c*, and upper flow ports, 238*d* and 238*e*, and includes an internal annular recess 238*f* at one end that mates with and receives the other end of the tubular plug seat 236, and an internal annular recess 238*g* and an external flange 238*h* for sealingly engaging the interior surface of the expandable tubular member 226 at another end. In an exemplary embodiment, the tubular body 238 is fabricated from a composite material in order to reduce weight and cost of the component.

Figure 7:
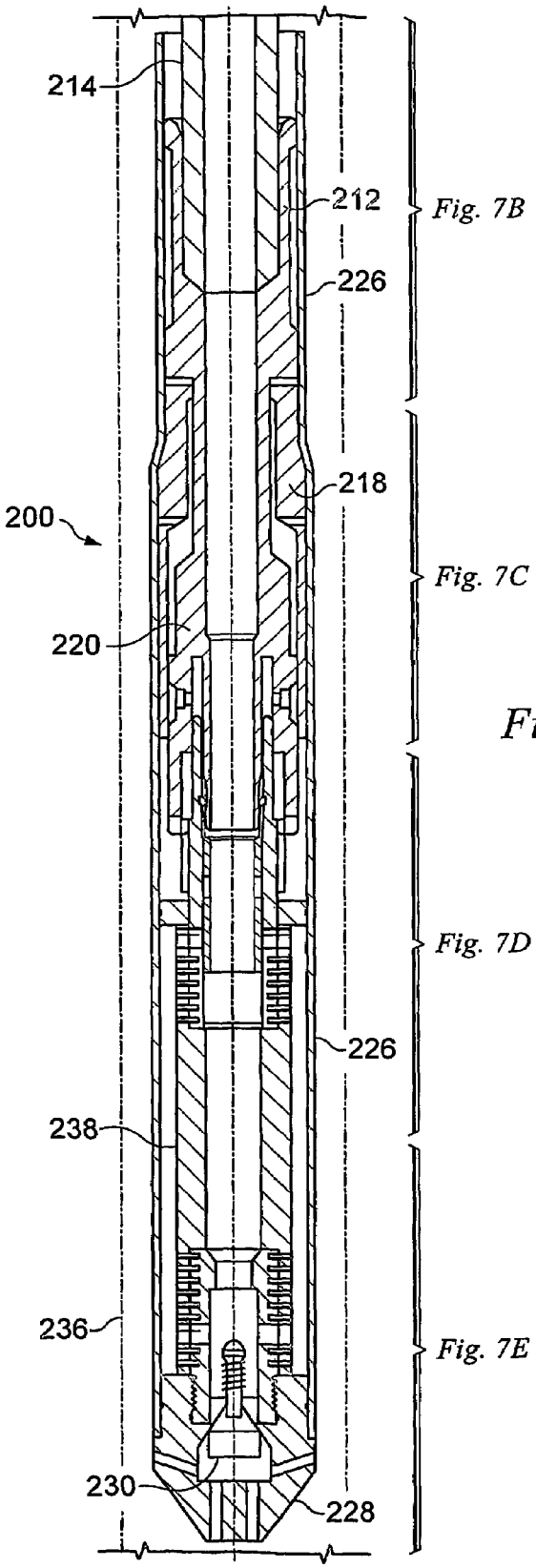
FIGS. 7, 7*a*, 7*b*, 7*c*, 7*d*, and 7*e* are fragmentary cross-sectional illustrations of an embodiment of an apparatus for radially expanding and plastically deforming a tubular member during the placement of the apparatus within a wellbore.
Figure 7A:
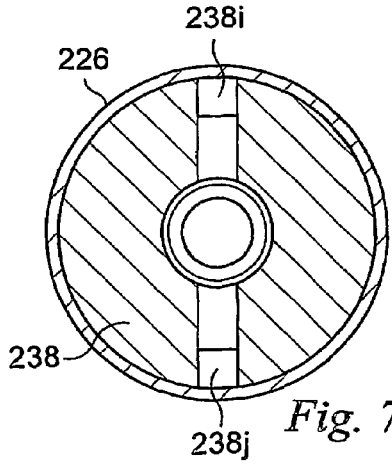
Figure 7B:
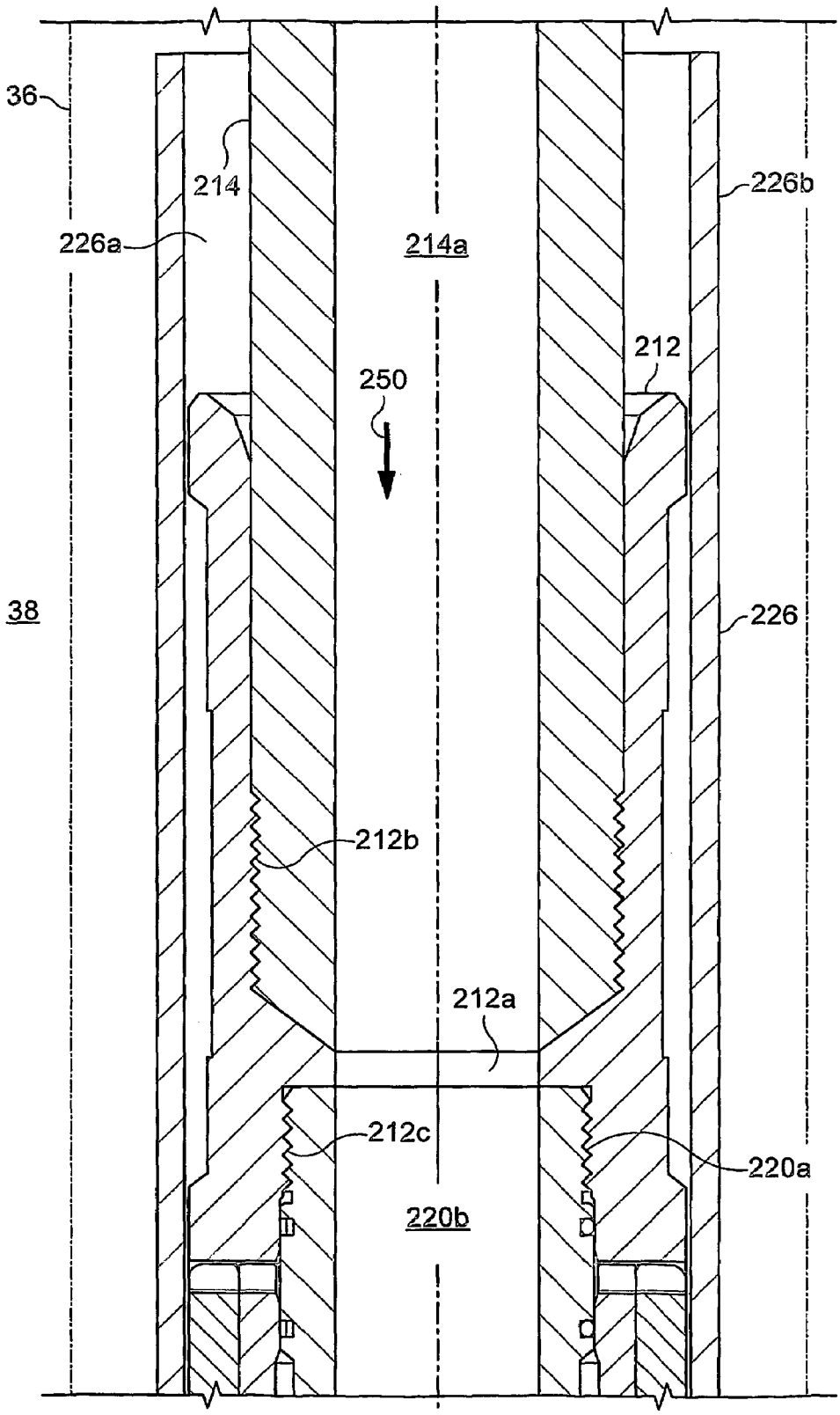
Figure 7C:
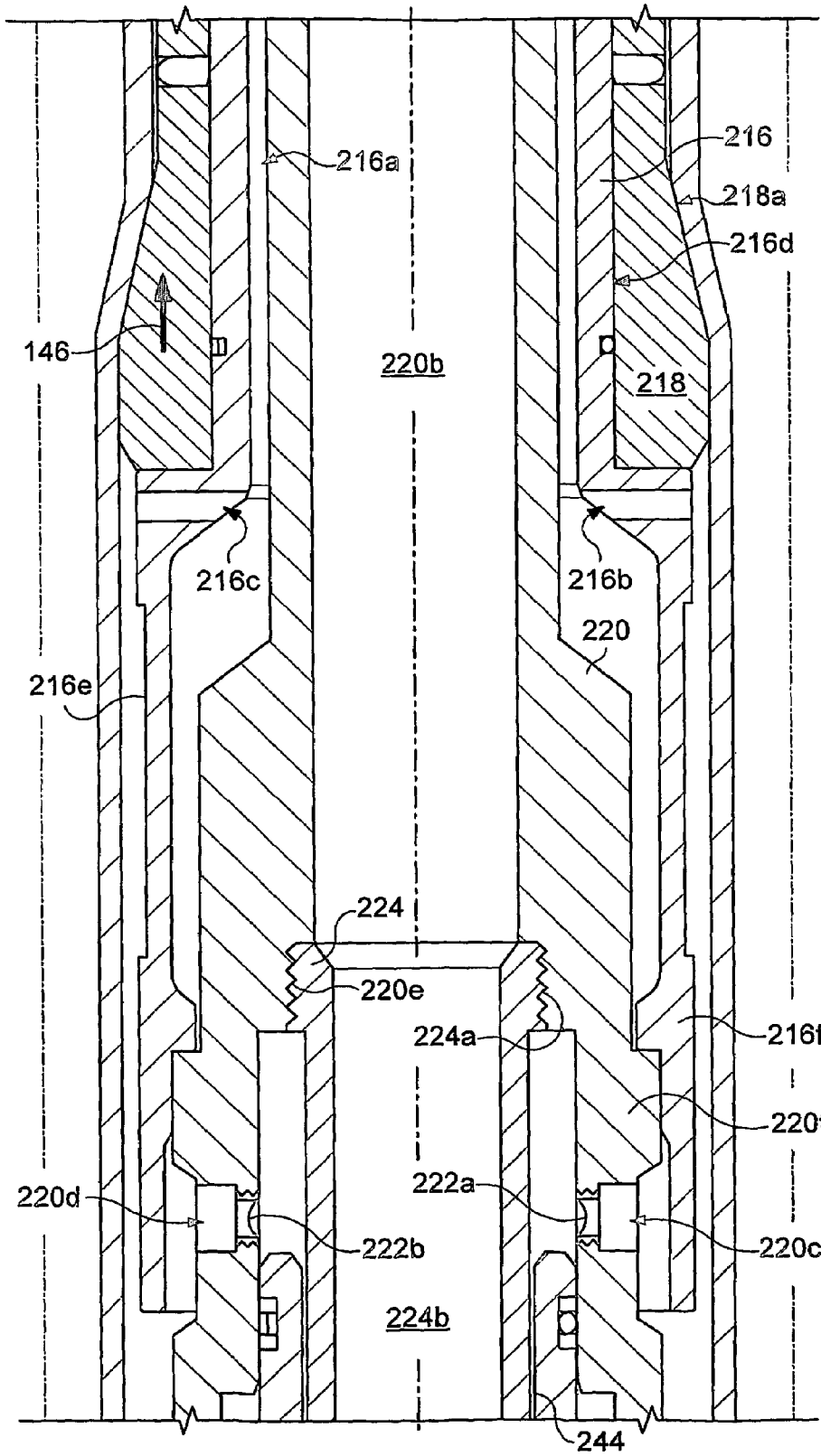
Figure 7D:
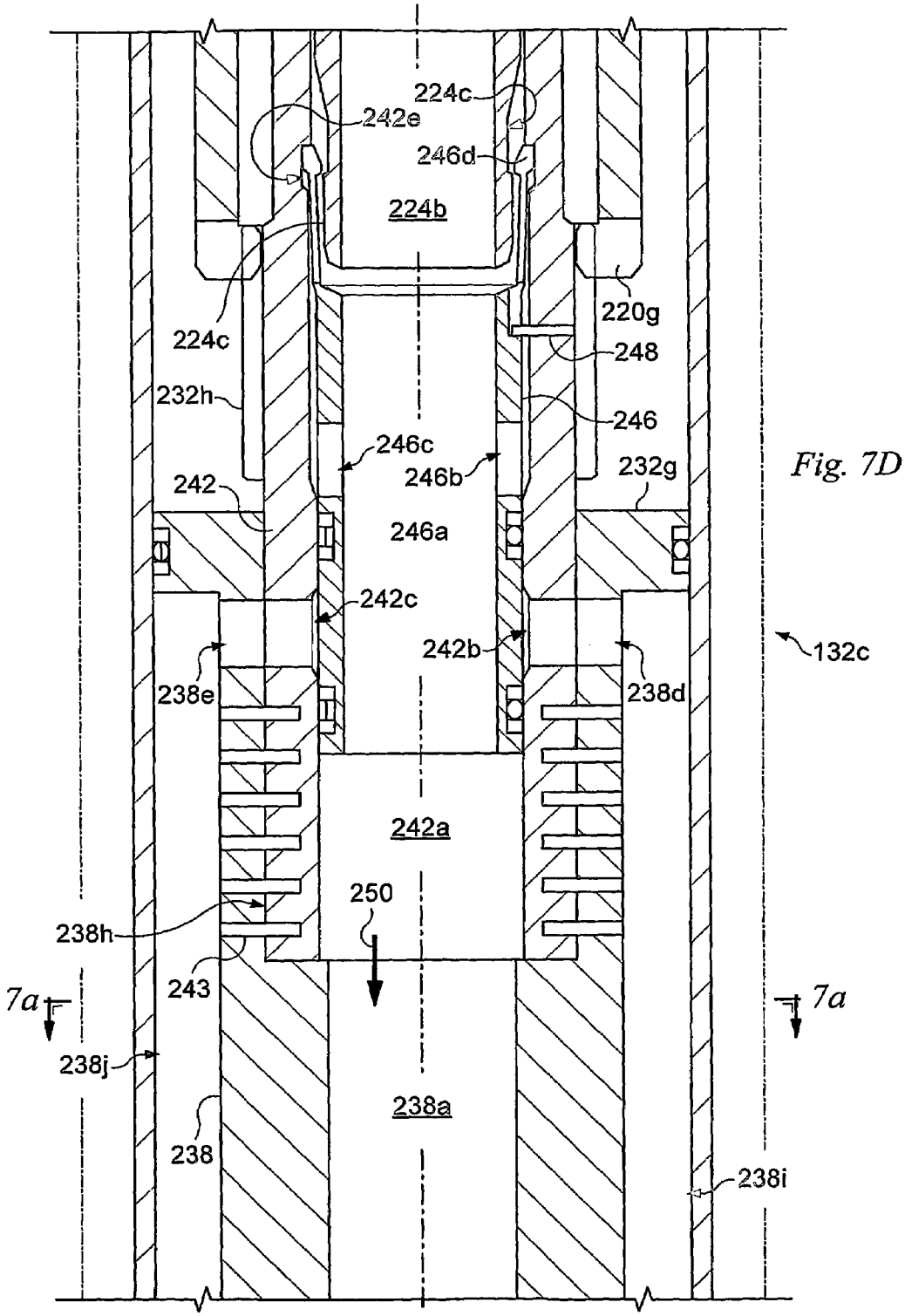
Figure 7E:
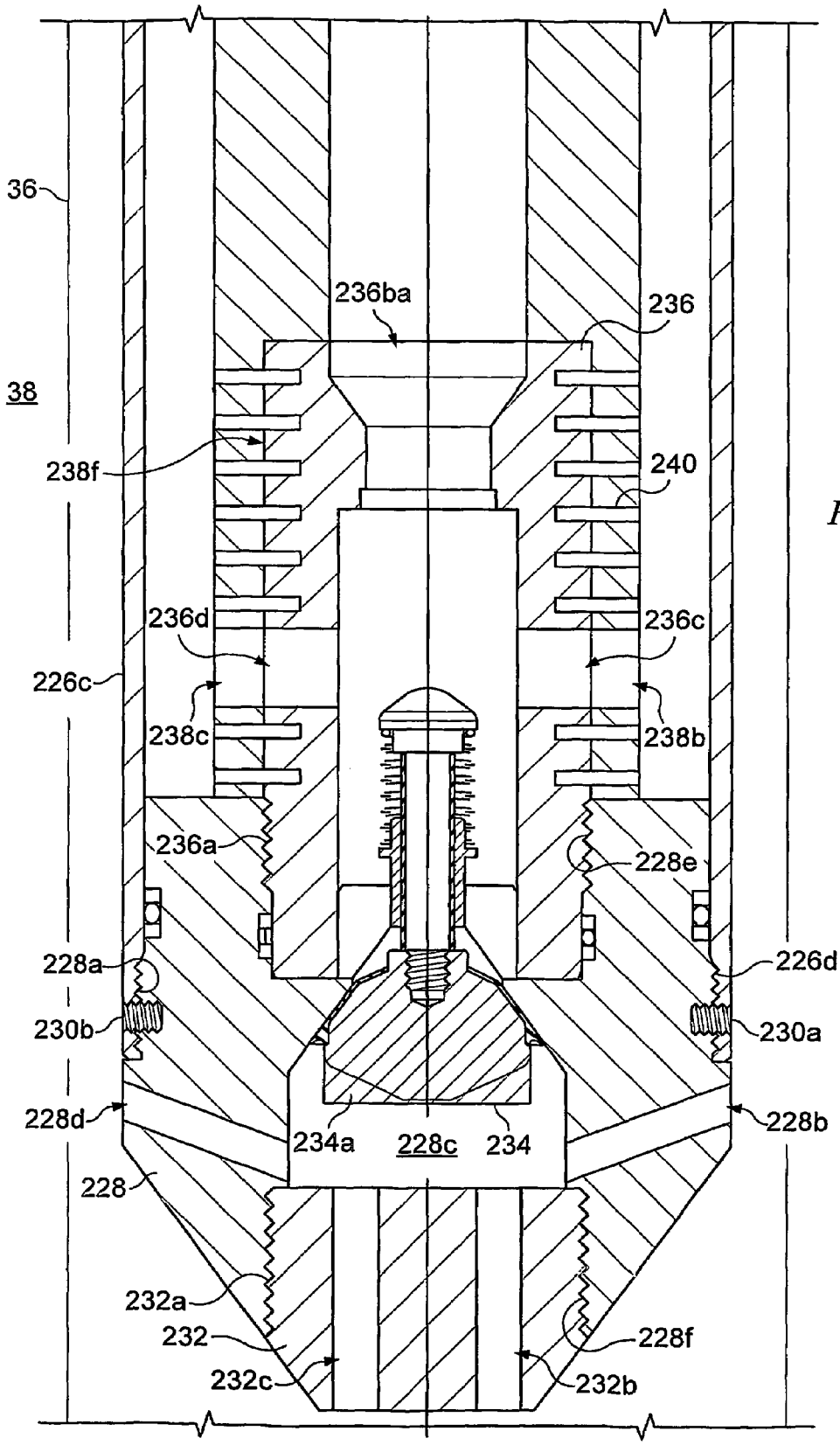
Figure 8:
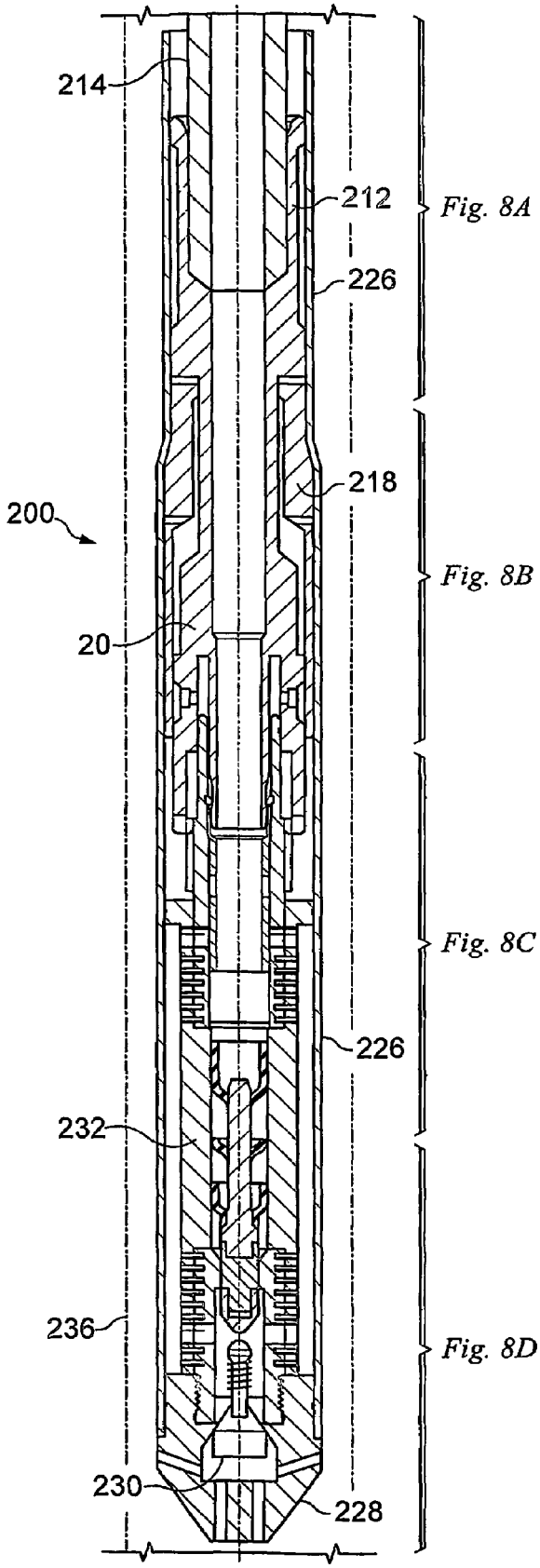
FIGS. 8, 8*a*, 8*b*, 8*c*, and 8*d* are fragmentary cross-sectional illustrations of the apparatus of FIGS. 7, 7*a*, 7*b*, 7*c*, 7*d*, and 7*e* during the radial expansion and plastic deformation of the tubular member.
Figure 8A:
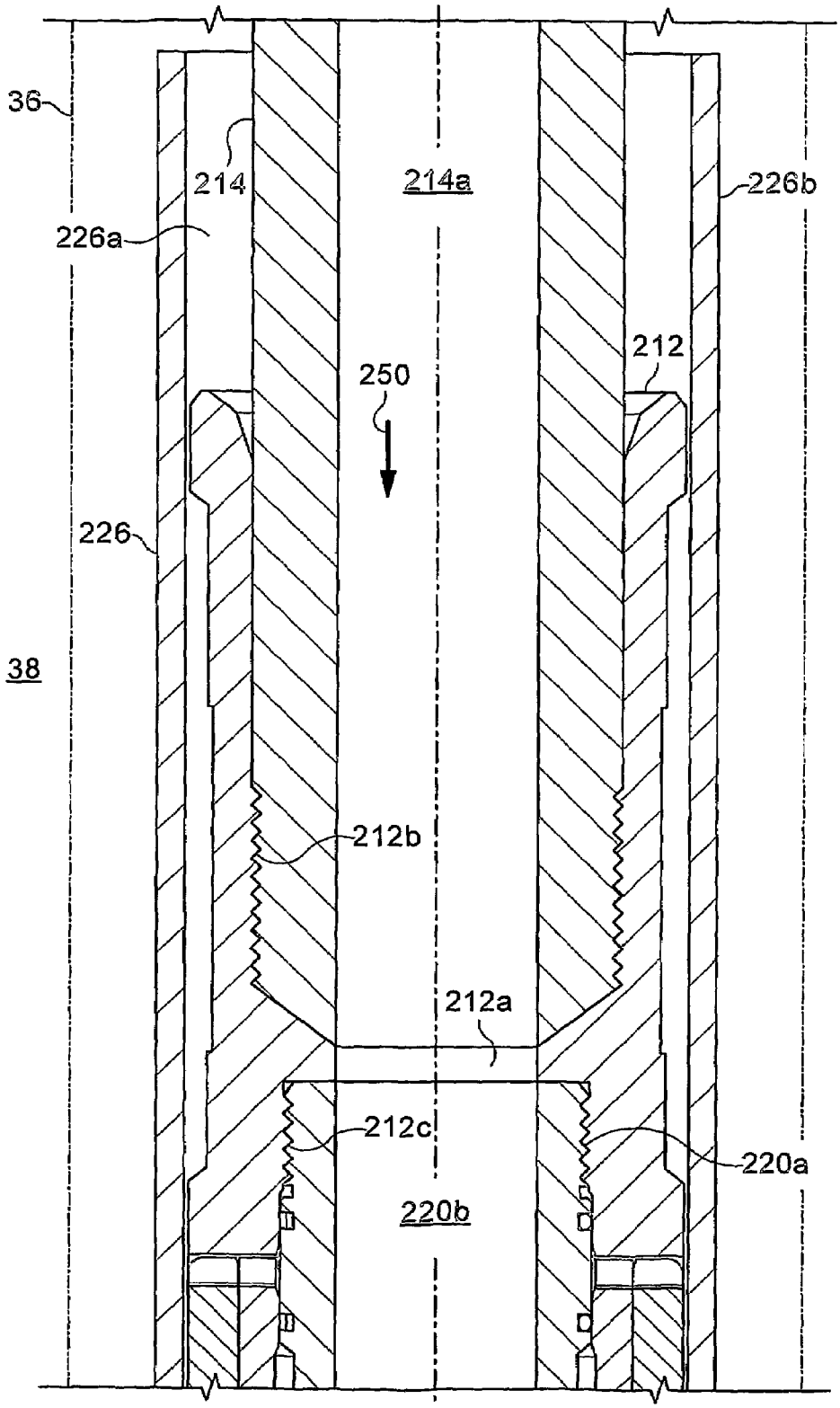
Figure 8B:
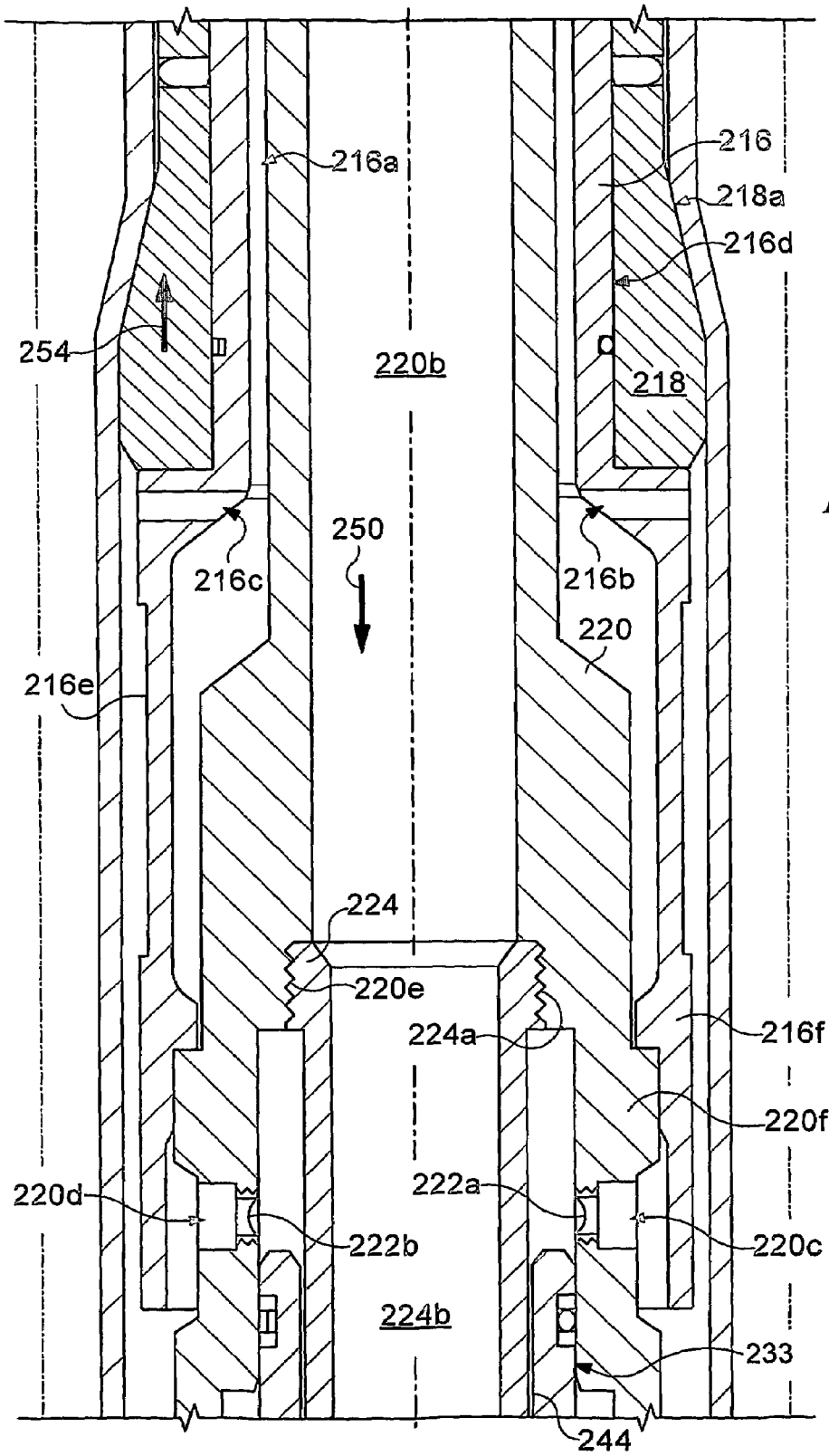
Figure 8C:
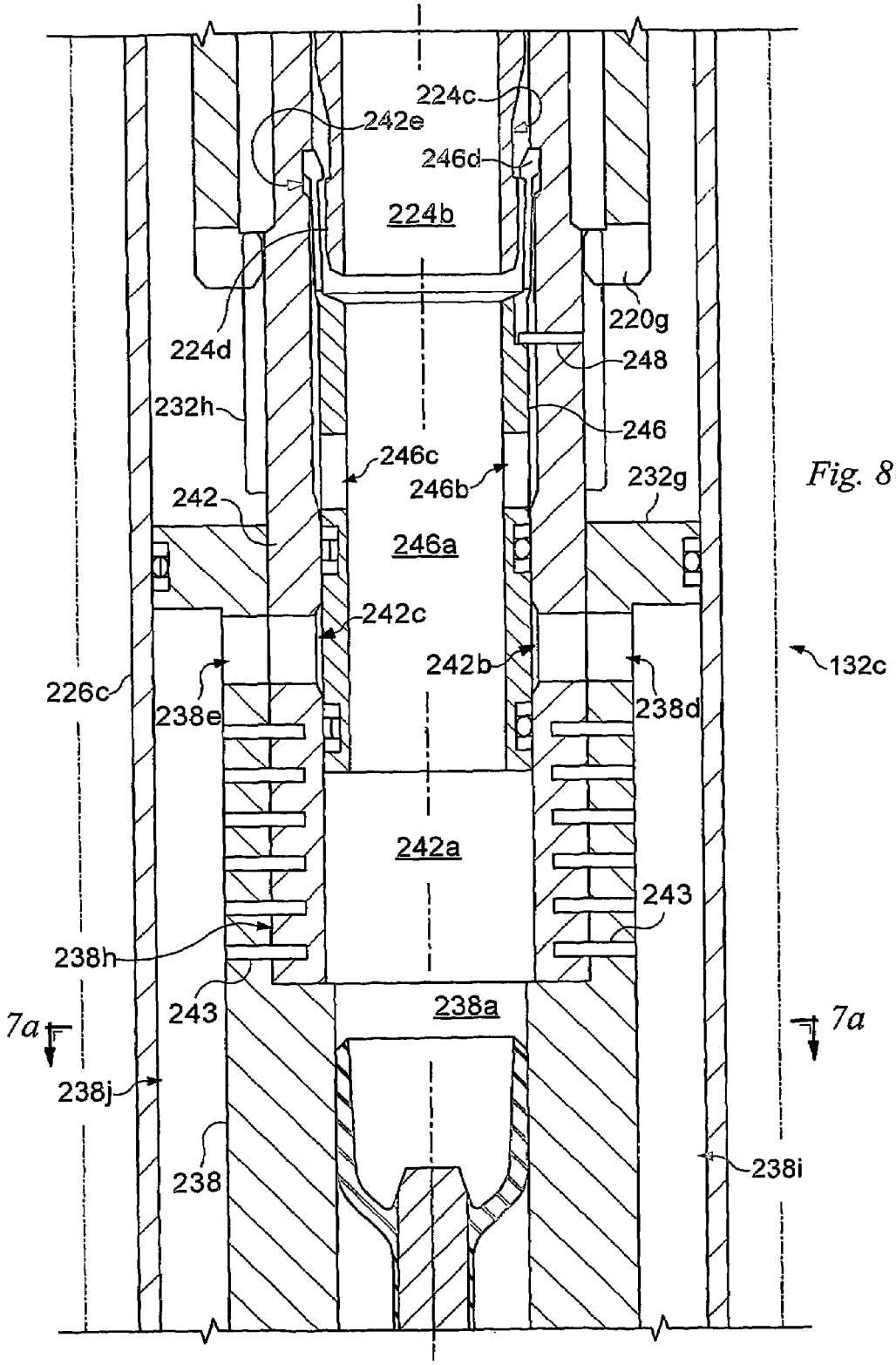
Figure 8D:
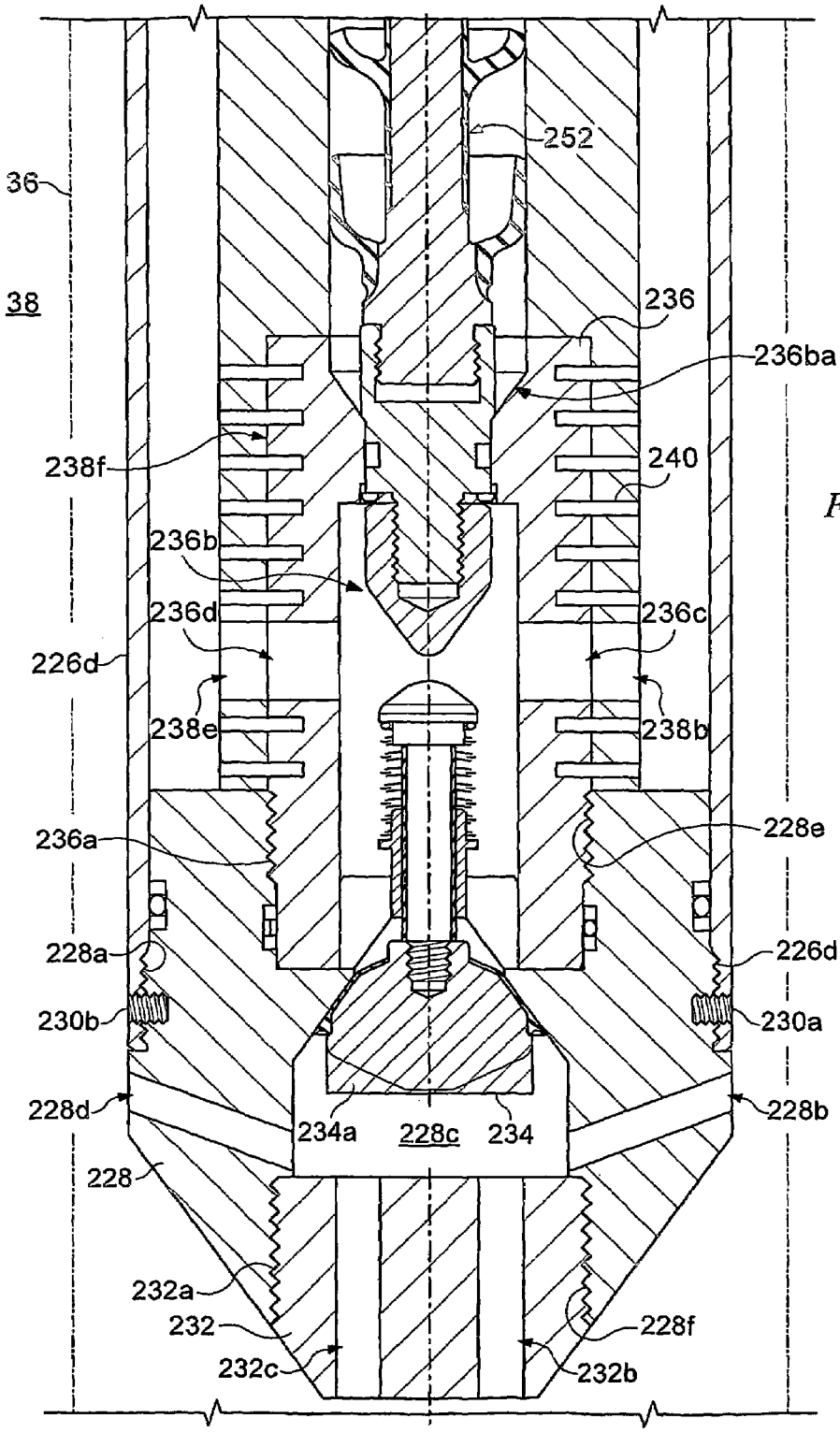
Figure 9:
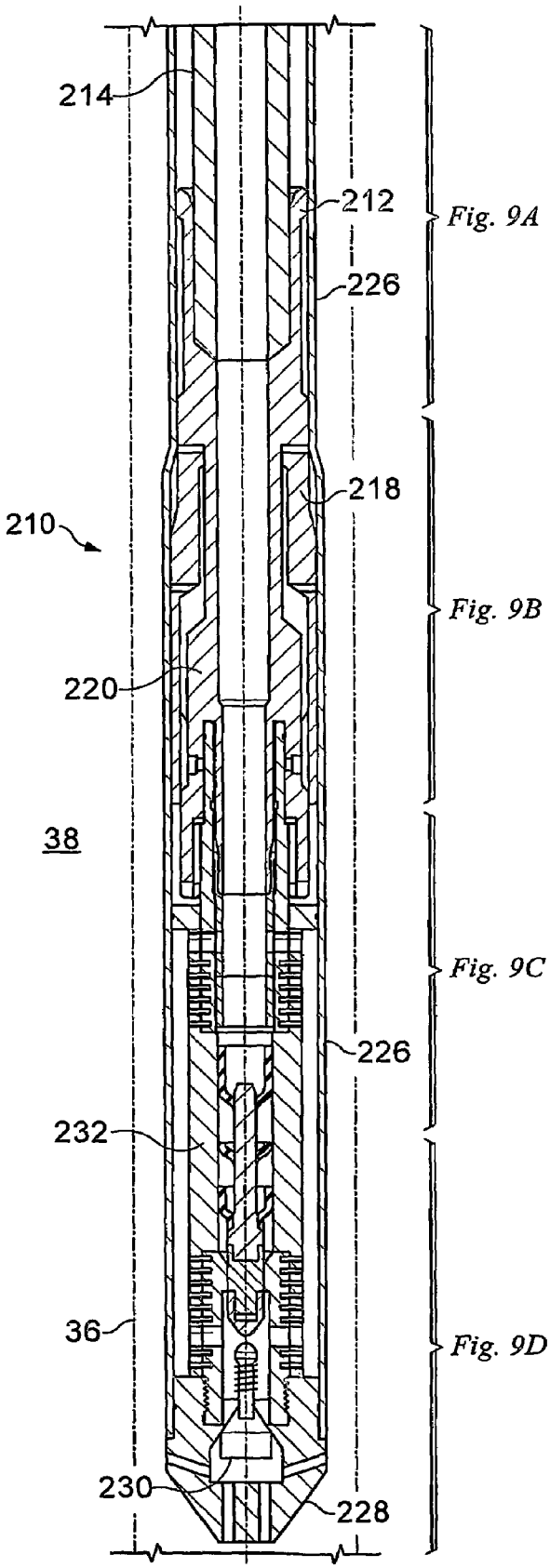
FIGS. 9, 9*a*, 9*b*, 9*c*, and 9*d* are fragmentary cross-sectional illustrations of the apparatus of FIGS. 7, 7*a*, 7*b*, 7*c*, 7*d*, and 7*e* during the injection of a hardenable fluidic sealing material into an annulus between the exterior of the apparatus and the wellbore.
Figure 9A:
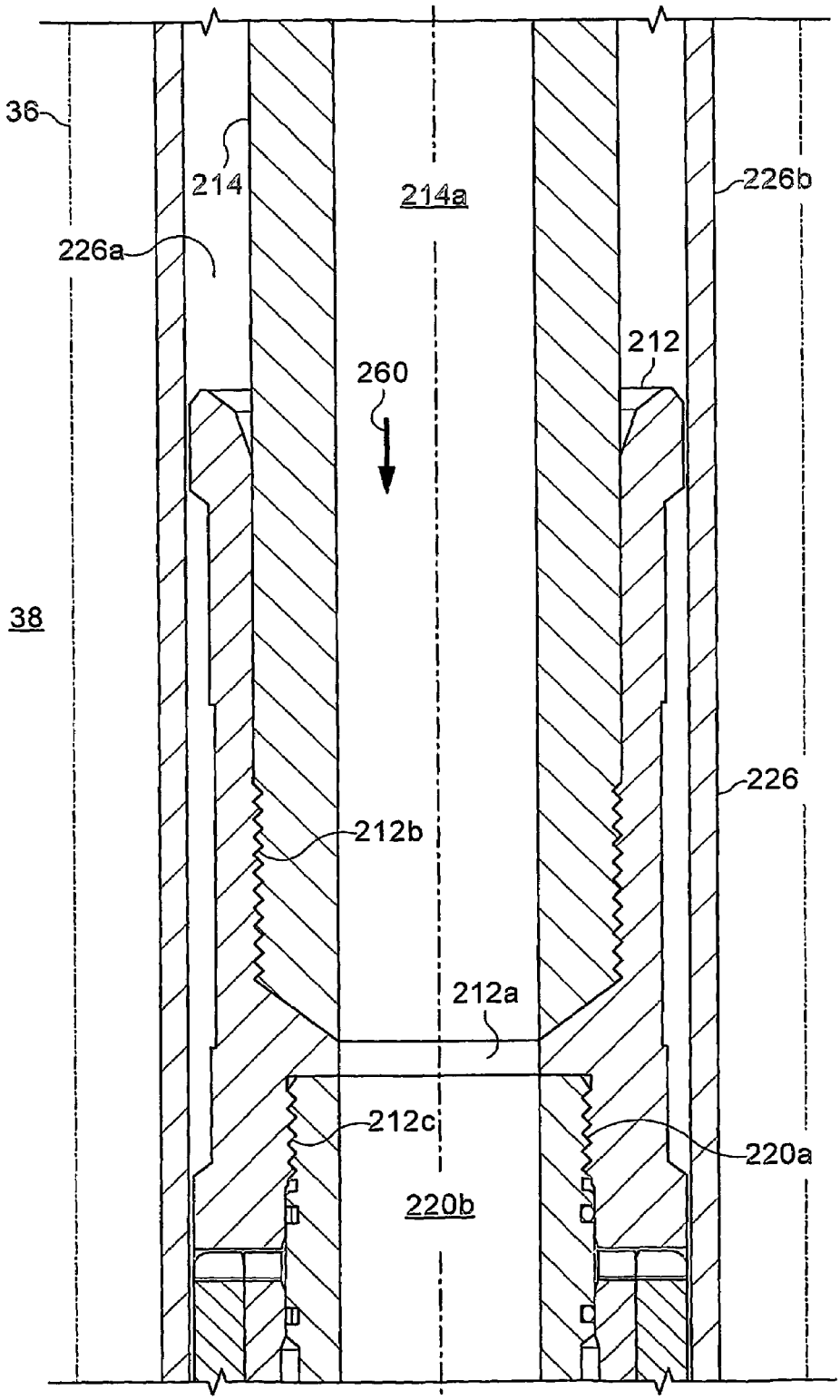
Figure 9B:
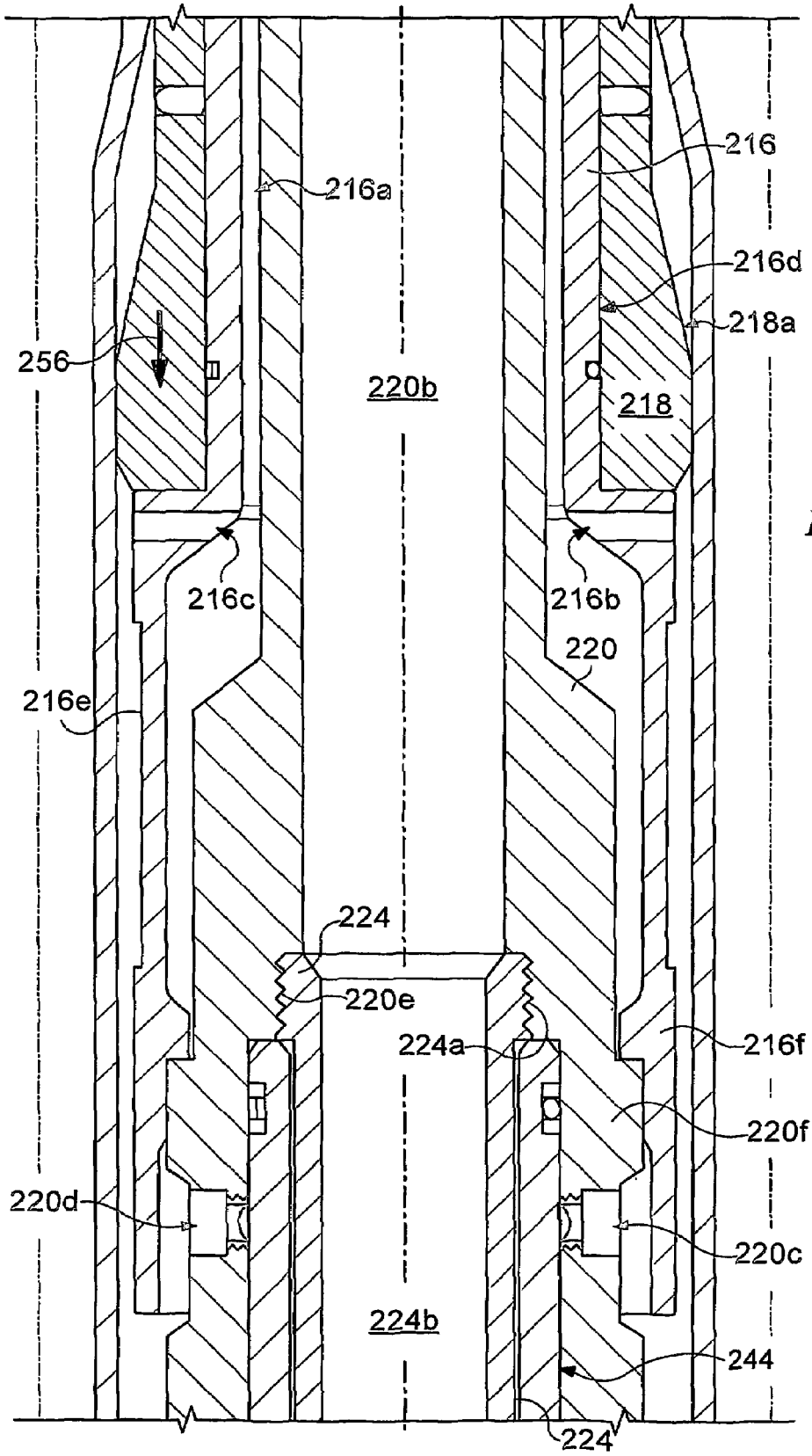
Figure 9C:
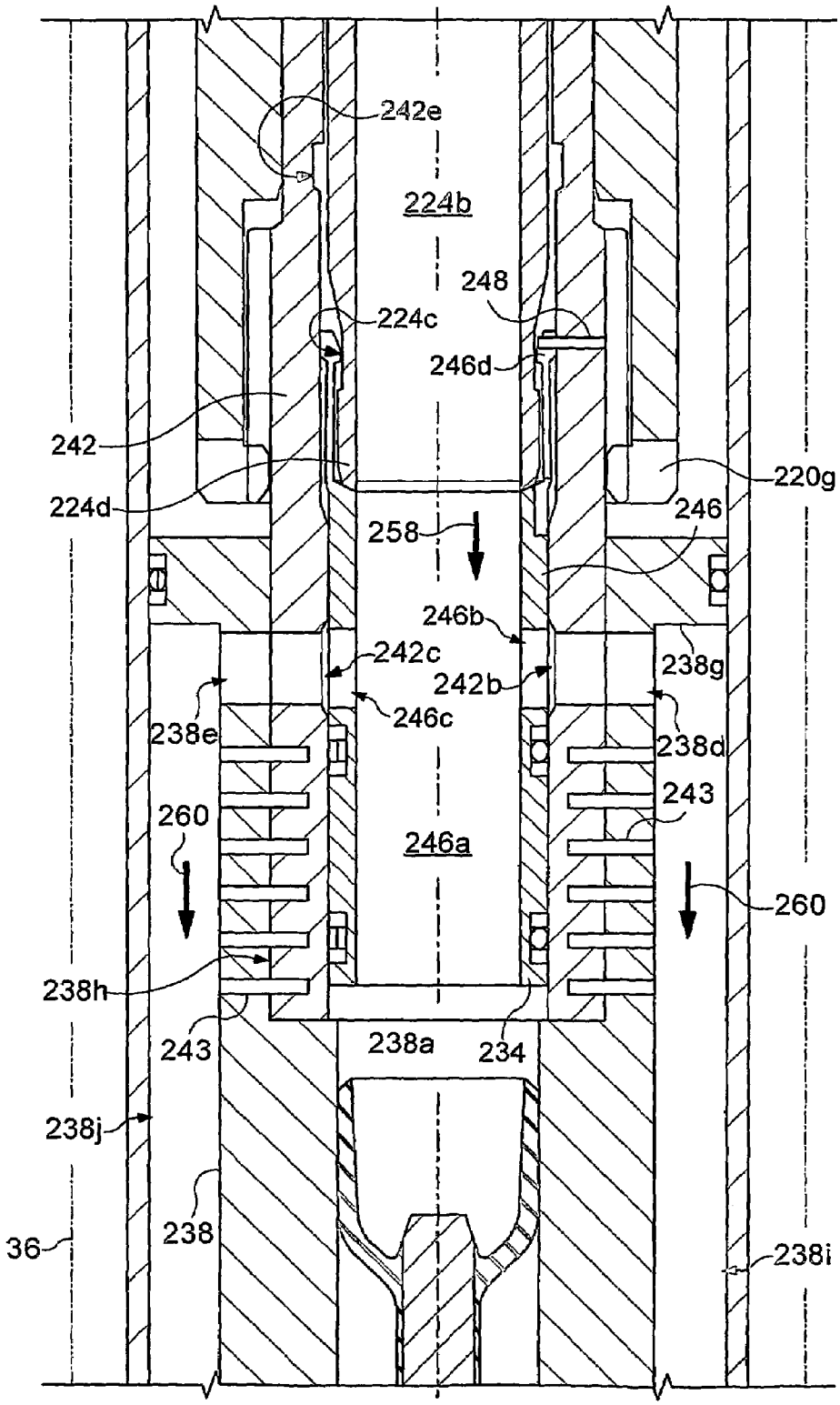
Figure 9D:
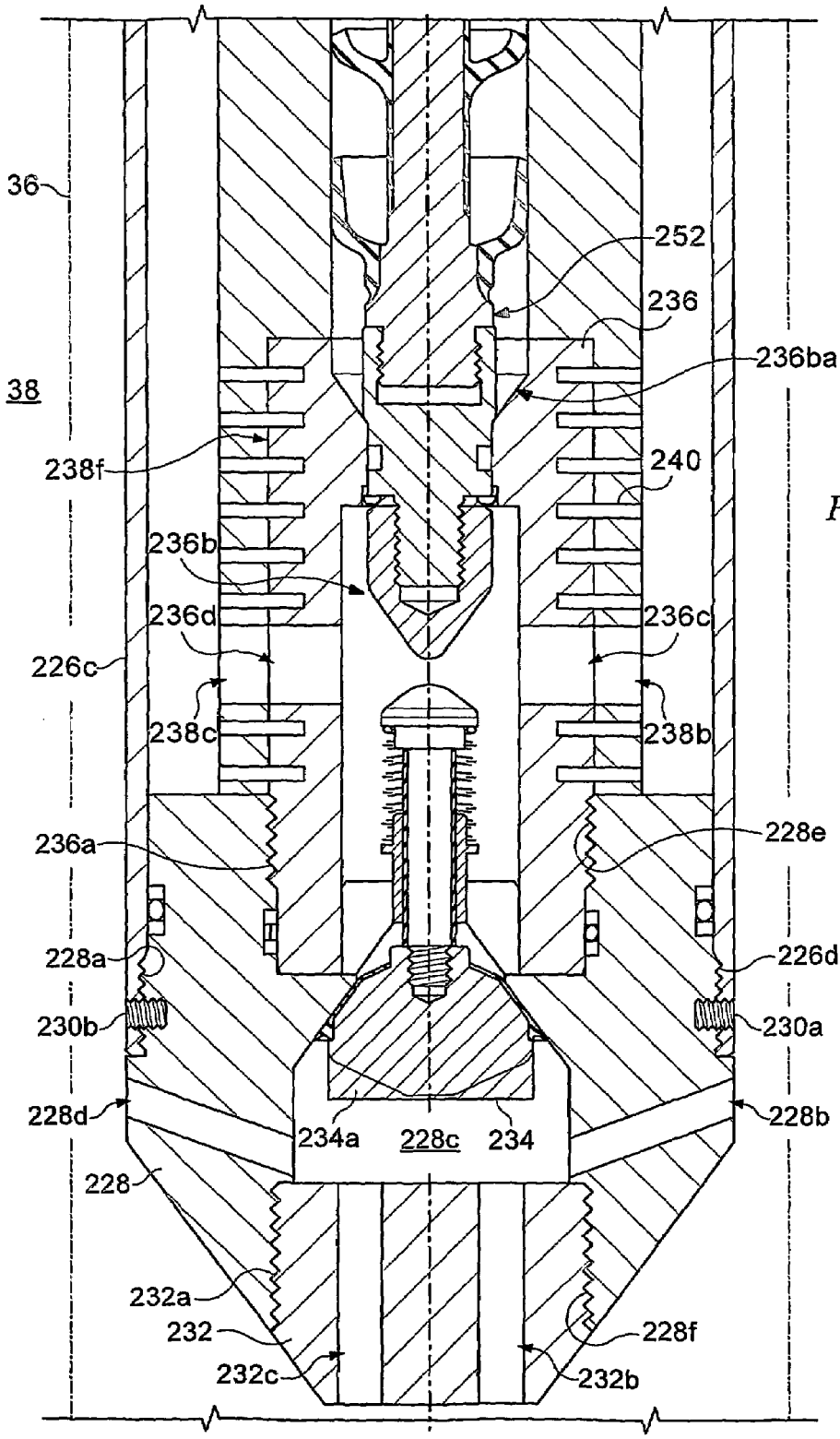

In an exemplary embodiment, as illustrated in FIG. 7*a*, the tubular body 238 further defines longitudinal passages, 238*i* and 238*j*, for fluidicly coupling the upper and lower flow ports, 238*d* and 238*e* and 238*b* and 238*c*, respectively.

One or more retaining pins 240 couple the other end of the tubular plug seat 236 to the internal annular recess 238*f* of the tubular body.

An end of a sealing sleeve 242 that defines an internal passage 242*a* and upper flow ports, 242*b* and 242*c*, and includes external splines 242*d* that mate with and receive the internal splines 220*g* of the tubular support 220 and an internal annular recess 242*e* is received within and mates with the internal annular recess 238*g* at the other end of the tubular body. The other end of the sealing sleeve 242 is received within an annulus defined between the interior surface of the other end of the tubular support 220 and the exterior surface of the tubular stinger 224, and sealingly engages the interior surface of the other end of the tubular support 220. In an exemplary embodiment, the sealing sleeve 242 is fabricated from aluminum in order to reduce weight and cost of the component. One or more retaining pins 243 coupled the end of the sealing sleeve 242 to the internal annular recess 238*g* at the other end of the tubular body 238. An annular passage 244 is further defined between the interior surface of the other end of the tubular body sealing sleeve 242 and the exterior surface of the tubular stinger 224.

A sliding sleeve valve 246 is movably received and supported within the internal passage 242*a* of the sealing sleeve 242 that defines an internal passage 246*a* and radial passages, 246*b* and 246*c*, and includes collet fingers 246*d* at one end positioned within the annular recess 242*e* of the sealing sleeve for releasably engaging the external flange 224*d* of the tubular stinger 224. The sliding sleeve valve 246 sealingly engages the internal surface of the internal passage 242*a* of the sealing sleeve 242, and blocks the upper flow ports, 242*b* and 242*c* and 238*d* and 238*e*, of the sealing sleeve and the tubular body, respectively. A valve guide pin 248 is coupled to the sealing sleeve 242 for engaging the collet fingers 246*d* of the sliding sleeve valve 246 and thereby guiding and limiting the movement of the sliding sleeve valve.

During operation, as illustrated in FIGS. 7, 7*a*, 7*b*, 7*c*, 7*d* and 7*e*, the apparatus 200 is positioned within a preexisting structure such as, for example, a wellbore 36 that traverses a subterranean formation 38. In an exemplary embodiment, during or after the positioning of the apparatus 200 within the wellbore 36, fluidic materials 250 may be circulated through and out of the apparatus into the wellbore 36 though the internal passages 214*a*, 212*a*, 220*b*, 224*b*, 246*a*, 242*a*, 238*a*, 236*b*, 228*b*, 228*c*, 228*d*, 232*b*, and 232*c*.

In an exemplary embodiment, as illustrated in FIGS. 8, 8*a*, 8*b*, 8*c*, and 8*d*, during operation of the apparatus 200, a conventional plug valve element 252 may then be injected into the apparatus through the passages 214*a*, 212*a*, 220*b*, 224*b*, 246*a*, 242*a*, 238*a*, and 236*b* until the plug valve element is seated in the plug seat 236*ba* of the internal passage 236*b* of the tubular plug seat 236. As a result, the flow of fluidic materials through the lower portion of the internal passage 236*b* of the tubular plug seat 236 is blocked. Continued injection of fluidic materials 250 into the apparatus 200, following the seating of the plug valve element 252 in the plug seat 236*ba* of the internal passage 236*b* of the tubular plug seat 236, pressurizes the internal annular passage 244 and thereby causes the rupture discs, 222*a* and 222*b*, to be ruptured thereby opening the internal passages, 220*c* and 220*d*, of the tubular support 220. As a result, fluidic materials 250 are then conveyed through the internal passages, 220*c* and 220*d*, thereby pressurizing a region within the apparatus 200 below the tubular expansion cone 218. As a result, the tubular support 212, tubular support 214, tubular support 216, tubular expansion cone 218, tubular support 220, and tubular stinger 224 are displaced upwardly in the direction 254 relative to the expandable tubular member 226, shoe 228, shoe insert 232, tubular plug seat 236, tubular body 238, sealing sleeve 242, and sliding sleeve valve 236 thereby radially expanding and plastically deforming the expandable tubular member.

During the continued upward displacement of the tubular support 212, tubular support 214, tubular support 216, tubular expansion cone 218, tubular support 220, and tubular stinger 224 in the direction 254 relative to the expandable tubular member 226, shoe 228, shoe insert 232, tubular plug seat 236, tubular body 238, sealing sleeve 242, and sliding sleeve valve 236, the upward movement of the sliding sleeve valve is prevented by the operation of the valve guide pin 248. Consequently, at some point, the collet fingers 246*d* of the sliding sleeve valve 246 disengage from the external flange 224*d* of the tubular stinger 224.

In an exemplary embodiment, as illustrated in FIGS. 9, 9*a*, 9*b*, 9*c*, and 9*d*, during operation of the apparatus 200, before or after radially expanding and plastically deforming the expandable tubular member 226, the tubular support 212, tubular support 214, tubular support 216, tubular expansion cone 218, tubular support 220, and tubular stinger 224 are displaced downwardly in the direction 256 relative to the expandable tubular member 226, shoe 228, shoe insert 232, tubular plug seat 236, tubular body 238, sealing sleeve 242, and sliding sleeve valve 236 by, for example, setting the apparatus down onto the bottom of the wellbore 36. As a result, the end of the sealing sleeve 242 that is received within the annulus defined between the interior surface of the other end of the tubular support 220 and the exterior surface of the tubular stinger 224 and that sealingly engages the interior surface of the tubular support 220 is displaced upwardly relative to the tubular support and tubular stinger thereby preventing fluidic materials from passing through the annular passage 244 into the radial passages, 220*c* and 220*d*, of the tubular support. Furthermore, as a result, the other end of the tubular stinger 224 impacts and displaces the sliding sleeve valve 246 downwardly in the direction 258 thereby aligning the internal passages, 238*d* and 238*e* and 242*b* and 242*c*, of the tubular body 238 and sealing sleeve 242, respectively, with the internal passages, 246*b* and 246*c*, respectively, of the sliding sleeve valve. A hardenable fluidic sealing material 260 may then be injected into the apparatus 200 through the internal passages 214*a*, 212*a*, 220*b*, 224*b*, and 246*a*, into and through the internal passages 238*d*, 238*e*, 242*b*, 242*c*, 246*b* and 246*c*, into and through the longitudinal grooves, 238*i* and 238*j*, into and through the internal passages, 236*a*, 236*b*, 238*b* and 238*c*, and then out of the apparatus through the internal passages 228*b*, 228*c*, 228*d* of the shoe 228*f* and 232*b* and 232*c* of the shoe insert 232 into the annulus between the exterior surface of the expandable tubular member 226 and the interior surface of the wellbore 36. As a result, an annular body of a hardenable fluidic sealing material such as, for example, cement is formed within the annulus between the exterior surface of the expandable tubular member 226 and the interior surface of the wellbore 36. Before, during, or after the curing of the annular body of the hardenable fluidic sealing material, the apparatus may then be operated as described above with reference to FIG. 8 to radially expand and plastically deform the expandable tubular member 226.

In several exemplary embodiments, the expandable tubular members 26, 126, and/or 226 are radially expanded and plastically deformed using one or more of the methods and apparatus disclosed in one or more of the following: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221, 443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on 1217/98, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S.

patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application PCT/US03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, and (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, the disclosures of which are incorporated herein by reference.

An apparatus for radially expanding and plastically deforming an expandable tubular member has been described that includes a tubular support member defining an internal passage and one or more radial passages and comprising internal splines; a tubular expansion cone coupled to the tubular support member comprising an external expansion surface; one or more rupture discs coupled to and positioned within corresponding radial passages of the tubular support member; a tubular stinger defining an internal passage coupled to and positioned within the tubular support member; an expandable tubular member coupled to the expansion surface of the tubular expansion cone comprising a first portion and a second portion, wherein the inside diameter of the first portion is less than the inside diameter of the second portion; a shoe defining one or more internal passages coupled to the second portion of the expandable tubular member; a tubular member coupled to the shoe defining an internal passage comprising a plug seat, one or more upper radial flow ports positioned above the plug seat, and one or more lower radial flow ports positioned below the plug seat, and comprising an external flange for sealingly engaging the interior surface of the expandable tubular member and external splines for engaging the internal splines of the tubular support member, wherein an end of the tubular member receives an end of the tubular stinger and is also received within and sealingly engages and end of the tubular support member; and a tubular sliding sleeve valve received within and sealingly engaging the internal passage of the tubular member defining an internal passage and one or more radial passages and comprising a collet for releasably engaging an end of the tubular stinger. In an exemplary embodiment, the radial passages of the tubular support member are positioned above the tubular stinger. In an exemplary embodiment, at least a portion of the tubular member comprises a composite material.

A system for radially expanding and plastically deforming a tubular member within a preexisting structure has been described that includes means for radially expanding and plastically deforming the tubular member within the preexisting structure; and means for injecting a hardenable fluidic sealing into an annulus between the tubular member and the preexisting structure. In an exemplary embodiment, the means for injecting a hardenable fluidic sealing into an annulus between the tubular member and the preexisting structure comprises: means for injecting a hardenable fluidic sealing into an annulus between the tubular member and the preexisting structure before radially expanding and plastically deforming the tubular member within the preexisting structure. In an exemplary embodiment, the means for injecting a hardenable fluidic sealing into an annulus between the tubular member and the preexisting structure comprises: means for injecting a hardenable fluidic sealing into an annulus between the tubular member and the preexisting structure before or after radially expanding and plastically deforming the tubular member within the preexisting structure.

A method of radially expanding and plastically deforming a tubular member within a preexisting structure has been described that includes radially expanding and plastically deforming the tubular member within the preexisting structure; and injecting a hardenable fluidic sealing into an annulus between the tubular member and the preexisting structure. In an exemplary embodiment, injecting a hardenable fluidic sealing into an annulus between the tubular member and the preexisting structure comprises: injecting a hardenable fluidic sealing into an annulus between the tubular member and the preexisting structure before radially expanding and plastically deforming the tubular member within the preexisting structure. In an exemplary embodiment, injecting a hardenable fluidic sealing into an annulus between the tubular member and the preexisting structure comprises: injecting a hardenable fluidic sealing into an annulus between the tubular member and the preexisting structure after radially expanding and plastically deforming the tubular member within the preexisting structure.

An apparatus for radially expanding and plastically deforming an expandable tubular member has been described that includes a support member; an expansion device coupled to the support member comprising an external expansion surface; one or more pressure sensors coupled to the support member; an expandable tubular member coupled to the expansion surface of the expansion device comprising a first portion and a second portion, wherein the inside diameter of the first portion is less than the inside diameter of the second portion; and a movable valve coupled to the support member for controlling the flow of fluidic materials through the interior of the expandable tubular member. In an exemplary embodiment, the pressure sensors comprise frangible elements. In an exemplary embodiment, the pressure sensors comprise valve elements for controlling the flow of fluidic materials within the interior of the expandable tubular member. In an exemplary embodiment, the support member defines one or more radial passages; and wherein the valve elements are positioned within corresponding radial passages in an exemplary embodiment, the apparatus further comprises a tubular member movably coupled to the support member that defines an internal passage having a plug seat. In an exemplary embodiment, the movable valve is received within the internal passage of the tubular member. In an exemplary embodiment, the tubular member defines one or more radial passages; and wherein the movable valve defines one or more radial passages. In an exemplary embodiment, the tubular member sealingly engages an interior surface of the expandable tubular member. In an exemplary embodiment, the tubular member is coupled to the second portion of the expandable tubular member. In an exemplary embodiment, the movable valve element is releasably coupled to the support member.

An apparatus for radially expanding and plastically deforming an expandable tubular member has been described that includes a support member defining one or more radial passages; an expansion device coupled to the support member comprising an external expansion surface; one or more frangible valve elements coupled to and positioned within corresponding radial passages of the support member; an expandable tubular member coupled to the expansion surface of the expansion device comprising a first portion and a second portion, wherein the inside diameter of the first portion is less than the inside diameter of the second portion; a tubular member defining an internal passage having a plug seat and one or more radial passages movably coupled to the support member and coupled to the second portion of the expandable tubular member and sealing engaging an interior surface of another portion of the second portion of the expandable tubular member; and a movable valve defining one or more radial passages releasably coupled to the support member and positioned within the internal passage of the tubular member.

A method of radially expanding and plastically deforming a tubular member within a preexisting structure has been described that includes injecting fluidic material into the tubular member; sensing the operating pressure of the injected fluidic material; and if the sensed operating pressure of the injected fluidic material exceeds a predetermined value, then radially expanding and plastically deforming the tubular member within the preexisting structure. In an exemplary embodiment, sensing the operating pressure of the injected fluidic material comprises sensing the operating pressure of the injected fluidic material using a sensor positioned within the expandable tubular member. In an exemplary embodiment, the method further comprises: if the sensed operating pressure of the injected fluidic material exceeds a predetermined value, then permitting the injected fluidic material to pass through a flow passage within the expandable tubular member. In an exemplary embodiment, method further comprises: injecting a hardenable fluidic sealing material through and out of the interior of the expandable tubular member into an annulus between the expandable tubular member and the preexisting structure. In an exemplary embodiment, the method further comprises: preventing the injected hardenable fluidic sealing material from passing though the flow passage. In an exemplary embodiment, the method further comprises: injecting a hardenable fluidic sealing into an annulus between the tubular member and the preexisting structure before radially expanding and plastically deforming the tubular member within the preexisting structure. In an exemplary embodiment, the method further comprises: injecting a hardenable fluidic sealing into an annulus between the tubular member and the preexisting structure after radially expanding and plastically deforming the tubular member within the preexisting structure.

A method of radially expanding and plastically deforming a tubular member within a preexisting structure has been described that includes sensing the operating pressure within the tubular member; and if the sensed operating pressure within the tubular member exceeds a predetermined valve, then radially expanding and plastically deforming the tubular member within the preexisting structure.

A method of radially expanding and plastically deforming a tubular member within a preexisting structure has been described that includes controlling the flow of fluidic materials within the tubular member using one or more movable valve elements; sensing an operating pressure of the fluidic materials within the tubular member; and if the sensed operating pressure within the tubular member exceeds a predetermined valve, then radially expanding and plastically deforming the tubular member within the preexisting structure using an expansion device. In an exemplary embodiment, the method further comprises: during the radially expansion and plastic deformation of the tubular member, displacing the expansion device away from the valve elements. In an exemplary embodiment, the method further comprises: supporting the tubular member within the preexisting structure using a support member; and releasably coupling one or more of the valve elements to the support member. In an exemplary embodiment, the method further comprises: coupling the valve elements to an end of the tubular member.

A method of radially expanding and plastically deforming a tubular member within a preexisting structure has been described that includes supporting the tubular member within the preexisting structure using a support member; controlling the flow of fluidic materials within the tubular member using one or more movable valve elements that are coupled to an end of the tubular member; sensing an operating pressure of the fluidic materials within the tubular member; and if the sensed operating pressure within the tubular member exceeds a predetermined valve, then radially expanding and plastically deforming the tubular member within the preexisting structure using an expansion device; wherein during the radial expansion and plastic deformation of the tubular member using the expansion device, the expansion device is displaced away from the valve elements; and wherein one or more of the valve elements are releasably coupled to the support member.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

In an exemplary embodiment, the apparatus of the present application is provided substantially as illustrated in Appendix A.

What is claimed is:

1. An apparatus for radially expanding and plastically deforming an expandable tubular member, comprising;

a tubular support member defining an internal passage and one or more radial passages and comprising internal splines;

a tubular expansion cone coupled to the tubular support member comprising an external expansion surface;

one or more rupture discs coupled to and positioned within corresponding radial passages of the tubular support member;

a tubular stinger defining an internal passage coupled to and positioned within the tubular support member;

an expandable tubular member coupled to the expansion surface of the tubular expansion cone comprising a first portion and a second portion, wherein the inside diameter of the first portion is less than the inside diameter of the second portion;

a shoe defining one or more internal passages coupled to the second portion of the expandable tubular member;

a tubular member coupled to the shoe defining an internal passage comprising a plug seat, one or more upper radial flow ports positioned above the plug seat, and one or more lower radial flow ports positioned below the plug seat, and comprising an external flange for sealingly engaging the interior surface of the expandable tubular member and external splines for engaging the internal splines of the tubular support member, wherein an end of the tubular member receives an end of the tubular stinger and is also received within and sealingly engages and end of the tubular support member; and a tubular sliding sleeve valve received within and sealingly engaging the internal passage of the tubular member defining an internal passage and one or more radial passages and comprising a collet for releasably engaging an end of the tubular stinger.

2. The apparatus of claim 1, wherein the radial passages of the tubular support member are positioned above the tubular stinger.

3. The apparatus of claim 1, wherein at least a portion of the tubular member comprises a composite material.

4. An apparatus for radially expanding and plastically deforming an expandable tubular member, comprising:

a support member;

an expansion device coupled to the support member comprising an external expansion surface;

one or more pressure sensors coupled to the support member;

an expandable tubular member coupled to the expansion surface of the expansion device comprising a first portion and a second portion, wherein the inside diameter of the first portion is less than the inside diameter of the second portion;

a tubular member coupled to the second portion of the expandable tubular member and movably coupled to the support member; and a movable valve coupled to the support member and positioned within the tubular member for controlling the flow of fluidic materials through the interior of the expandable tubular member.

5. The apparatus of claim 4, wherein the pressure sensors comprise frangible elements.

6. The apparatus of claim 4, wherein the pressure sensors comprise valve elements for controlling the flow of fluidic materials within the interior of the expandable tubular member.

7. The apparatus of claim 6, wherein the support member defines one or more radial passages; and wherein the valve elements are positioned within corresponding radial passages.

8. The apparatus of claim 4, wherein the tubular member defines an internal passage having a plug seat.

9. The apparatus of claim 4, wherein the movable valve element is releasably coupled to the support member.

10. An apparatus for radially expanding and plastically deforming an expandable tubular member, comprising:

a support member;

an expansion device coupled to the support member comprising an external expansion surface;

one or more pressure sensors coupled to the support member;

an expandable tubular member coupled to the expansion surface of the expansion device comprising a first portion and a second portion, wherein the inside diameter of the first portion is less than the inside diameter of the second portion;

a movable valve coupled to the support member for controlling the flow of fluidic materials through the interior of the expandable tubular member; and a tubular member movably coupled to the support member that defines an internal passage having a plug seat;

wherein the movable valve is received within the internal passage of the tubular member;

wherein the tubular member defines one or more radial passages; and wherein the movable valve defines one or more radial passages.

11. An apparatus for radially expanding and plastically deforming an expandable tubular member, comprising:

a support member;

an expansion device coupled to the support member comprising an external expansion surface;

one or more pressure sensors coupled to the support member;

an expandable tubular member coupled to the expansion surface of the expansion device comprising a first portion and a second portion, wherein the inside diameter of the first portion is less than the inside diameter of the second portion;

a movable valve coupled to the support member for controlling the flow of fluidic materials through the interior of the expandable tubular member; and a tubular member movably coupled to the support member that defines an internal passage having a plug seat;

wherein the tubular member sealingly engages an interior surface of the expandable tubular member.

12. An apparatus for radially expanding and plastically deforming an expandable tubular member, comprising:

a support member defining one or more radial passages;

an expansion device coupled to the support member comprising an external expansion surface;

one or more frangible valve elements coupled to and positioned within corresponding radial passages of the support member;

an expandable tubular member coupled to the expansion surface of the expansion device comprising a first portion and a second portion, wherein the inside diameter of the first portion is less than the inside diameter of the second portion;

a tubular member defining an internal passage having a plug seat and one or more radial passages movably coupled to the support member and coupled to the second portion of the expandable tubular member and sealing engaging an interior surface of another portion of the second portion of the expandable tubular member; and a movable valve defining one or more radial passages releasably coupled to the support member and positioned within the internal passage of the tubular member.

13. A method of radially expanding and plastically deforming a tubular member within a preexisting structure, comprising:

injecting fluidic material into the tubular member;

sensing the operating pressure of the injected fluidic material;

if the sensed operating pressure of the injected fluidic material exceeds a predetermined value, then radially expanding and plastically deforming the tubular member within the preexisting structure; and injecting a hardenable fluiclic sealing material through and out of the interior of the expandable tubular member into an annulus between the expandable tubular member and the preexisting structure.

14. The method of claim 13, wherein sensing the operating pressure of the injected fluidic material comprises sensing the operating pressure of the injected fluidic material using a sensor positioned within the expandable tubular member.

15. The method of claim 13, further comprising:

if the sensed operating pressure of the injected fluidic material exceeds a predetermined value, then permitting the injected fluidic material to pass through a flow passage within the expandable tubular member.

16. The method of claim 13, further comprising:

injecting a hardenable fluidic sealing into an annulus between the tubular member and the preexisting structure after radially expanding and plastically deforming the tubular member within the preexisting structure.

17. A method of radially expanding and plastically deforming a tubular member within a preexisting structure, comprising:

injecting fluidic material into the tubular member;

sensing the operating pressure of the injected fluidic material;

if the sensed operating pressure of the injected fluidic material exceeds a predetermined value, then radially expanding and plastically deforming the tubular member within the preexisting structure;

if the sensed operating pressure of the injected fluidic material exceeds a predeteimined value, then permitting the injected fluidic material to pass through a flow passage within the expandable tubular member; and injecting a hardenable fluidic sealing material through and out of the interior of the expandable tubular member into an annulus between the expandable tubular member and the preexisting structure.

18. The method of claim 17, further comprising:

preventing the injected hardenable fluidic sealing material from passing though the flow passage.

19. A method of radially expanding and plastically deforming a tubular member within a preexisting structure, comprising:

injecting fluidic material into the tubular member;

sensing the operating pressure of the injected fluidic material;

if the sensed operating pressure of the injected fluidic material exceeds a predetermined value, then radially expanding and plastically deforming the tubular member within the preexisting structure; and injecting a hardenable fluidic sealing into an annulus between the tubular member and the preexisting structure before radially expanding and plastically deforming the tubular member within the preexisting structure.

20. A method of radially expanding and plastically deforming a tubular member within a preexisting structure, comprising:

sensing the operating pressure within the tubular member;

if the sensed operating pressure within the tubular member exceeds a predetermined value, then radially expanding and plastically deforming the tubular member within the preexisting structure; and injecting a hardenable fluidic sealing material through and out of the interior of the expandable tubular member into an annulus between the expandable tubular member and the preexisting structure.

21. A method of radially expanding and plastically deforming a tubular member within a preexisting structure, comprising:

controlling the flow of fluidic materials within the tubular member using one or more movable valve elements;

sensing an operating pressure of the fluidic materials within the tubular member;

if the sensed operating pressure within the tubular member exceeds a predetermined value, then radially expanding and plastically deforming the tubular member within the preexisting structure using an expansion device; and injecting a hardenable fluidic sealing material through and out of the interior of the expandable tubular member into an annulus between the expandable tubular member and the preexisting structure.

22. The method of claim 21, further comprising:

during the radially expansion and plastic deformation of the tubular member, displacing the expansion device away from the valve elements.

23. The method of claim 21, further comprising: coupling the valve elements to an end of the tubular member.

24. A method of radially expanding and plastically deforming a tubular member within a preexisting structure, comprising:

controlling the flow of fluidic materials within the tubular member using one or more movable valve elements;

sensing an operating pressure of the fluidic materials within the tubular member;

if the sensed operating pressure within the tubular member exceeds a predetermined value, then radially expanding and plastically deforming the tubular member within the preexisting structure using an expansion device;

supporting the tubular member within the preexisting structure using a support member; and releasably coupling one or more of the valve elements to the support member.

25. A method of radially expanding and plastically deforming a tubular member within a preexisting structure, comprising:

supporting the tubular member within the preexisting structure using a support member;

controlling the flow of fluidic materials within the tubular member using one or more movable valve elements that are coupled to an end of the tubular member;

sensing an operating pressure of the fluidic materials within the tubular member;

if the sensed operating pressure within the tubular member exceeds a predetermined value, then radially expanding and plastically deforming the tubular member within the preexisting structure using an expansion device; and injecting a hardenable fluidic sealing material through and out of the interior of the expandable tabular member into an annulus between the expandable tubular member and the preexisting structure;

wherein during the radial expansion and plastic deformation of the tubular member using the expansion device, the expansion device is displaced away from the valve elements; and wherein one or more of the valve elements are releasably coupled to the support member.

* * * * *